US009649569B2

(12) United States Patent
Hill

(10) Patent No.: US 9,649,569 B2
(45) **Date of Patent: *May 16, 2017**

(54) WAVE SIMULATOR FOR BOARD SPORTS

(71) Applicant: Kenneth Douglas Hill, Lahaina, HI (US)

(72) Inventor: Kenneth Douglas Hill, Lahaina, HI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/251,228

(22) Filed: Aug. 30, 2016

(65) Prior Publication Data

US 2017/0043267 A1 Feb. 16, 2017

Related U.S. Application Data

(63) Continuation of application No. 13/361,805, filed on Jan. 30, 2012, now Pat. No. 9,457,290.

(Continued)

(51) Int. Cl.
*A63G 31/00* (2006.01)
*A63B 69/00* (2006.01)

(Continued)

(52) U.S. Cl.
CPC ..... *A63G 31/007* (2013.01); *A63B 69/0093* (2013.01); *A63H 33/30* (2013.01); *A63H 33/42* (2013.01); *E04H 4/0006* (2013.01)

(58) Field of Classification Search
CPC . A63G 21/18; A63G 3/02; A63G 3/00; A63B 69/125; E04H 4/0006
USPC ..... 405/79; 472/128; 4/491
See application file for complete search history.

(56) References Cited

U.S. PATENT DOCUMENTS 586,718 A * 7/1897 Wharton ..... E04H 4/0006 4/491
1,701,842 A * 2/1929 Fisch ..... A47K 3/10 4/491
1,871,215 A * 8/1932 Keller ..... E04H 4/0006 4/491
2,056,855 A * 10/1936 Herz ..... E04H 4/0006 4/491
2,815,951 A 12/1957 Baldanza (Continued)

FOREIGN PATENT DOCUMENTS

JP 52-41392 A 3/1977
WO 90/06790 A1 6/1990
WO 2004/076779 A1 10/2004
WO 2006/000777 A1 5/2006

OTHER PUBLICATIONS

"Flow Rider & Waterpolo Class Parent Handbook", The Wave Water Park, 2011, 8 pp.

(Continued)

*Primary Examiner* — Benjamin Fiorello
*Assistant Examiner* — Edwin Toledo-Duran
(74) *Attorney, Agent, or Firm* — Trenner Law Firm, LLC; Mark D. Trenner

(57) ABSTRACT

Examples of a wave simulator for board sports and other uses are disclosed. An example wave simulator includes means for forming a wave, the means having at least one inclined side wall and a bottom corresponding to a desired wave shape. The wave simulator includes means for flowing water along at least partially along the inclined side wall and bottom of the flume to form a simulated wave. The wave simulator includes means for restraining a board rider in the means for forming a wave. Streamlines of the simulated wave are substantially parallel to a crest line of the simulated wave, and an inclined water flow ends in a downward arc.

20 Claims, 65 Drawing Sheets

Related U.S. Application Data

(60) Provisional application No. 61/462,533, filed on Feb. 4, 2011, provisional application No. 61/479,407, filed on Apr. 27, 2011, provisional application No. 61/511,975, filed on Jul. 26, 2011, provisional application No. 61/524,336, filed on Aug. 17, 2011, provisional application No. 61/567,061, filed on Dec. 5, 2011.

(51) Int. Cl.
*A63H 33/42* (2006.01)
*E04H 4/00* (2006.01)
*A63H 33/30* (2006.01)

(56) References Cited

U.S. PATENT DOCUMENTS 3,350,724 A * 11/1967 Leigh ..... E04H 4/0006 4/491
3,473,334 A * 10/1969 Dexter ..... E04H 4/0006 4/491
3,477,233 A * 11/1969 Andersen ..... F04D 35/00 405/79
3,557,559 A * 1/1971 Barr ..... E04H 4/0006 4/491
3,562,823 A * 2/1971 Koster ..... E21D 11/00 4/491
3,598,402 A 8/1971 Frenzi
3,789,612 A * 2/1974 Richard ..... E04H 4/0006 4/491
3,802,697 A * 4/1974 Le Mehaute ..... A63G 3/02 4/491
4,199,274 A 4/1980 Loth
4,339,122 A 7/1982 Croul
4,459,837 A 7/1984 Hayashi et al.
4,730,355 A * 3/1988 Kreinbihl ..... E04H 4/0006 137/872
4,792,260 A 12/1988 Sauerbier
4,812,077 A * 3/1989 Raike ..... E04H 4/0006 4/491
4,954,014 A * 9/1990 Sauerbier ..... A63B 69/0093 4/491
4,979,244 A * 12/1990 Bastenhof ..... E04H 4/0006 137/875
RE34,042 E 8/1992 Merino
5,171,101 A * 12/1992 Sauerbier ..... A63B 69/0093 405/52
5,213,547 A 5/1993 Lochtefeld
5,236,280 A * 8/1993 Lochtefeld ..... A63B 69/0093 405/52
5,271,692 A * 12/1993 Lochtefeld ..... A63B 69/0093 405/52
5,342,145 A * 8/1994 Cohen ..... E04H 4/0006 4/491
5,387,159 A * 2/1995 Hilgert ..... A63B 69/0093 405/79
5,393,170 A * 2/1995 Lochtefeld ..... A63B 69/0093 4/491
5,401,117 A * 3/1995 Lochtefeld ..... A63B 69/0093 4/491
5,421,782 A 6/1995 Lochtefeld
5,453,054 A 9/1995 Langford
5,478,281 A 12/1995 Forton
5,503,597 A * 4/1996 Lochtefeld ..... A63G 21/18 4/904
5,564,859 A * 10/1996 Lochtefeld ..... A63B 69/0093 405/52
5,628,584 A * 5/1997 Lochtefeld ..... A63B 69/0093 405/52
5,664,910 A 9/1997 Lochtefeld et al.
5,667,445 A 9/1997 Lochtefeld
5,720,056 A 2/1998 Aymes
5,738,590 A * 4/1998 Lochtefeld ..... A63B 69/0093 472/117
5,860,766 A 1/1999 Lochtefeld et al.
5,899,633 A * 5/1999 Lochtefeld ..... A63B 69/0093 405/52
5,899,634 A * 5/1999 Lochtefeld ..... B05B 17/085 239/17
5,911,190 A 6/1999 Lochtefeld et al.
6,019,547 A 2/2000 Hill
6,132,317 A * 10/2000 Lochtefeld ..... A63B 69/0093 472/117
6,319,137 B1 * 11/2001 Lochtefeld ..... A63B 69/0093 472/117
6,336,771 B1 * 1/2002 Hill ..... A63G 31/007 4/491
6,361,445 B1 * 3/2002 Zeilinger ..... A63B 17/02 472/116
6,375,578 B1 * 4/2002 Briggs ..... A63G 21/18 472/117
6,460,201 B1 10/2002 Lochtefeld
6,482,095 B2 * 11/2002 Zeilinger ..... A63B 17/02 104/69
6,629,803 B1 * 10/2003 McFarland ..... E04H 4/0006 405/79
6,676,529 B2 1/2004 Pernal
6,676,530 B2 1/2004 Lochtefeld
6,716,107 B2 * 4/2004 Lochtefeld ..... A63B 69/0093 472/117
6,726,403 B1 * 4/2004 Kriticos ..... E04H 4/0006 4/491
6,932,541 B2 * 8/2005 McFarland ..... E04H 4/0006 405/79
RE39,171 E * 7/2006 Lochtefeld ..... B05B 17/085 239/17
7,192,217 B2 3/2007 Hanna et al.
7,326,001 B2 2/2008 McFarland
7,547,255 B2 6/2009 Lochtefeld
7,568,859 B2 * 8/2009 McFarland ..... A63G 31/007 405/79
7,658,571 B2 2/2010 McFarland
7,666,104 B2 * 2/2010 Lochtefeld ..... A63B 69/0093 405/52
7,722,291 B2 * 5/2010 McFarland ..... A63G 31/007 405/79
7,815,396 B2 10/2010 McFarland et al.
7,951,011 B2 5/2011 Lochtefeld
8,516,624 B2 8/2013 Klimaschewski
8,602,685 B1 * 12/2013 McFarland ..... A63B 69/0093 405/79
2005/0047869 A1 3/2005 Lochtefeld
2005/0207845 A1 * 9/2005 McFarland ..... E04H 4/0006 405/79
2008/0286048 A1 11/2008 Carnahan et al.
2008/0312003 A1 12/2008 Bogar
2009/0169305 A1 * 7/2009 Lochtefeld ..... A63G 31/007 405/79
2009/0264211 A1 10/2009 Smythe
2009/0275416 A1 * 11/2009 Murphy ..... A63G 31/007 472/128
2010/0135727 A1 6/2010 McFarland
2010/0260548 A1 10/2010 Shipley et al.
2011/0052322 A1 3/2011 McFarland
2011/0116870 A1 5/2011 Aufleger et al.
2011/0143846 A1 * 6/2011 Davis ..... A63C 19/00 472/128
2011/0188937 A1 8/2011 McFarland
2012/0201605 A1 * 8/2012 Hill ..... A63B 69/0093 405/79

OTHER PUBLICATIONS

Stingray [online]. Waves, Ltd [retrieved on Apr. 25, 2012]. Retrieved from the internet: <URL: www.wavesltd.co.uk/products/stingray>.

(56) References Cited

OTHER PUBLICATIONS

Paine, Michael "Hydrodynamics of Surfboards", [online], 1974, [retrieved on Apr. 25, 2012]. Retrieved from the internet: <URL: http://users.tpg.com.au/users/mpaine/thesis.html>.
"River Surfing in Munich" [online]. Jul. 5, 2005, [retrieved on Apr. 25, 2012]. Retrieved from the internet: <URL: http://www.toytowngermany.com/lofi/index.php/t73618-0.html>.
"River Surfing" [online]. Apr. 14, 2012, [retrieved on Apr. 25, 2012]. Retrieve from the internet: <URL: http://en.wikipedia.org/wiki/River_surfing>.
Kelly, John "How Bungee Boarding Works" [online], [retrieved on Apr. 25, 2012]. Retrieved from the internet: <URL: http://adventure.howstuffworks.com/outdoor-activities/water-sports/bungee-boarding.htm>.
"Bridge Surfing" [online], Feb. 3, 2011 [retrieved on Apr. 25, 2012] Retrieved from the internet: <URL: http://www.youtube.com/watch?v=4Ty4RYV49kM>.
"Dam Thats Fun" [online], Sep. 19, 2006, [retrieved on Apr. 25, 2012]. Retrieved from the internet: <URL: http://www.youtube.com/watch?v=wWWolkcsG4g&feature=related>.
"River Boarding" [online], Nov. 22, 2007, [retrieved on Apr. 25, 2012]. Retrieved from the internet: <URL: http://www.youtube.com/watch?v=qZ5VI6j2qL0>.
"Banshee Riverboards Demo" [online], Jan. 19, 2007, [retrieved on Apr. 25, 2012]. Retrieved from the internet: <URL: http://www.youtube.com/watch?NR=1&feature=fvwp&v=8R0MW-qoTEc>.
"Bungee Skim 101" [online], May 1, 2008, [retrieved on Apr. 25, 2012]. Retrieved from the internet: <URL: http://www.youtube.com/watch?v=kdE3sROALn0&feature=related>.
"Visa Row Rider", [online], Aug. 1, 2009, [retrieved on Apr. 25, 2012] Retrieved from the internet: <URL: http://www.youtube.com/watch?v=UcY6DVIu4g4>.
"Nick on Flowrider", [online]. Jul. 3, 2008, [retrieved on Apr. 25, 2012]. Retrieved from the Internet: <URL: http://www.youtube.com/watch?feature=endscreen&NR=1&v=spg9L1HbAfE>.
"Ride the Row—Vista Comp Jul. 11, 2010" [online], Mar. 3, 2011, [retrieved on Apr. 25, 2012]. Retrieved from the internet: <URL: http://www.youtube.com/watch?v=WdWz1GBuUw>.
"Surfing a Manmade Wave" [online], Jun. 12, 2008, [retrieved on Apr. 25, 2012]. Retrieved from the internet: <URL: http://www.youtube.com/watch?v=aAC42TQ2-us&feature=related>.
"Endless Summer I: Discovery of Cape St. Francis" [online], Nov. 5, 2008, [retrieved on Apr. 25, 2012]. Retrieved from the internet: <URL: http://www.youtube.com/watch?v=CrNb1oL-7NM>.
"EverTriedNew5Gum's channel" [online], Apr. 25, 2011, [retrieved on Apr. 25, 2012]. Retrieved from the Internet: <URL: http://www.youtube.com/5gum#p/u/7/JQLfsxE4Ci4>.
"Video: 5 Elixer", [online], [retrieved on Apr. 25, 2012]. Retrieved from the internet: <URL: http://www.wrigley.com/global/brands/5-gum.aspx#panel-1>.
"Bungee Boarding, A New Way to Skim the Beach and Surf the River", [online], Jul. 2, 2008, [retrieved on Apr. 26, 2012]. Retrieved from the internet: <URL: http://www.ballerhouse.com/2008/07/02/bungee-boarding-a-new-way-to-skim-and-surf-the-river/>.
Hornung, H.G., et al., "A Stationary Oblique Breaking Wave for Laboratory Testing of Surfboards", J. Fluid Mech. (1976) vol. 78, part 3, pp. 459-480.
Killen, P.D., et al., "A Facility for Wave Riding Research", 8th Australasian Fluid Mechanics Conference, University of New Castle, N.S.W. Nov. 28/Dec. 2, 1983.
Killen, P.D., "Model Studies for a Wave Riding Facility", 1980, pp. 51-55.

* cited by examiner

Fig. 37a
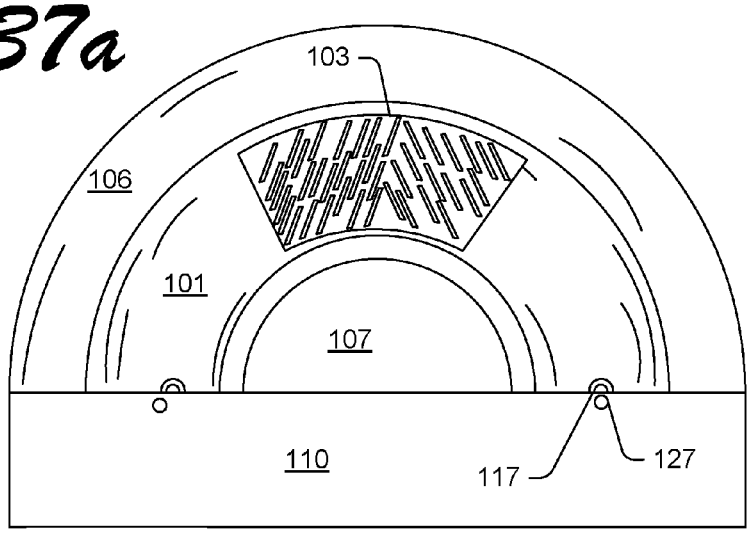
Fig. 37b
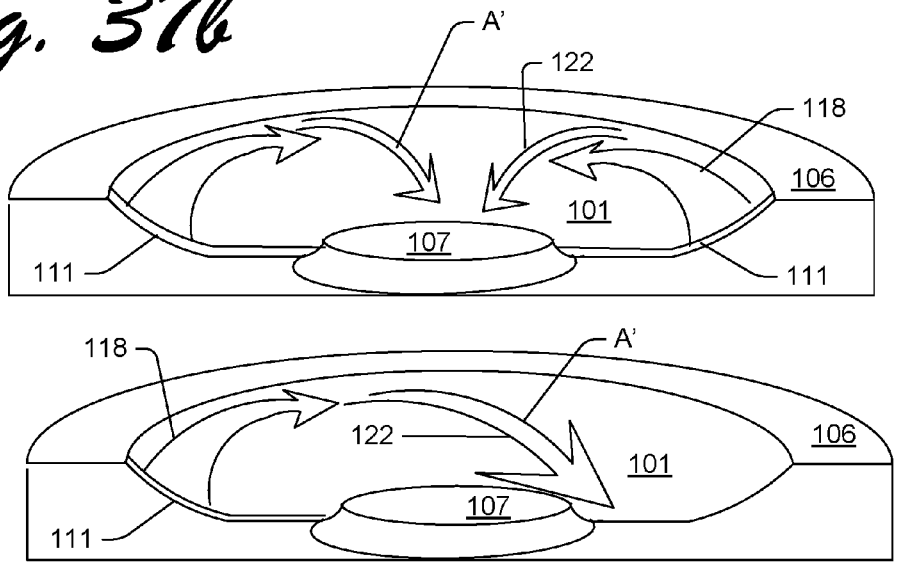
Fig. 37c

WAVE SIMULATOR FOR BOARD SPORTS

PRIORITY CLAIM

This patent application is a continuation of U.S. patent Ser. No. 13/361,805 filed Feb. 21, 2012 titled "Wave Simulator For Board Sports" of Kenneth Douglas Hill, which claims the benefit of U.S. Provisional Patent Application No. 61/462,533 filed Feb. 4, 2011, U.S. Provisional Patent Application No. 61/479,407 filed Apr. 27, 2011, U.S. Provisional Patent Application No. 61/511,975 filed Jul. 26, 2011, U.S. Provisional Patent Application No. 61/524,336 filed Aug. 17, 2011, and U.S. Provisional Patent Application No. 61/567,061 filed Dec. 5, 2011, each titled "Boardsports wave simulator apparatus and method" of Kenneth Douglas Hill, and each hereby incorporated herein by reference for all that is disclosed therein as though fully set forth herein.

BACKGROUND

Products are commercially available that simulate waves or even simulate waves artificially for use in various board sports such as surfing, windsurfing, and wakeboarding. Most of the continuous wave simulators have attempted to duplicate a wave by supplying a flow of water that is substantially "trough to crest", that is, from the lowest point of the "wave" to the highest point, or "crest". For example, U.S. Patent Application No. 2009/0275416 shows a device that utilizes an inclined surface to simulate a wave. The water flow is subject to the inclined nature of this device. Other simulators include wave pools, which tend to occupy large amounts of space and therefore can be expensive to build and maintain.

BRIEF DESCRIPTION OF THE DRAWINGS

FIG. 1*b* is a plan view of the beginner's surf ride of 1*a*.

FIG. 37*a* is a plan view of a semi-circular down-the-line wave simulator according to the wave simulator.

FIGS. 37*b* and 37*c* show partial-cutaway perspective views of different versions of a semi-circular down-the-line wave simulator according to the wave simulator.

DETAILED DESCRIPTION

Figure 1A:
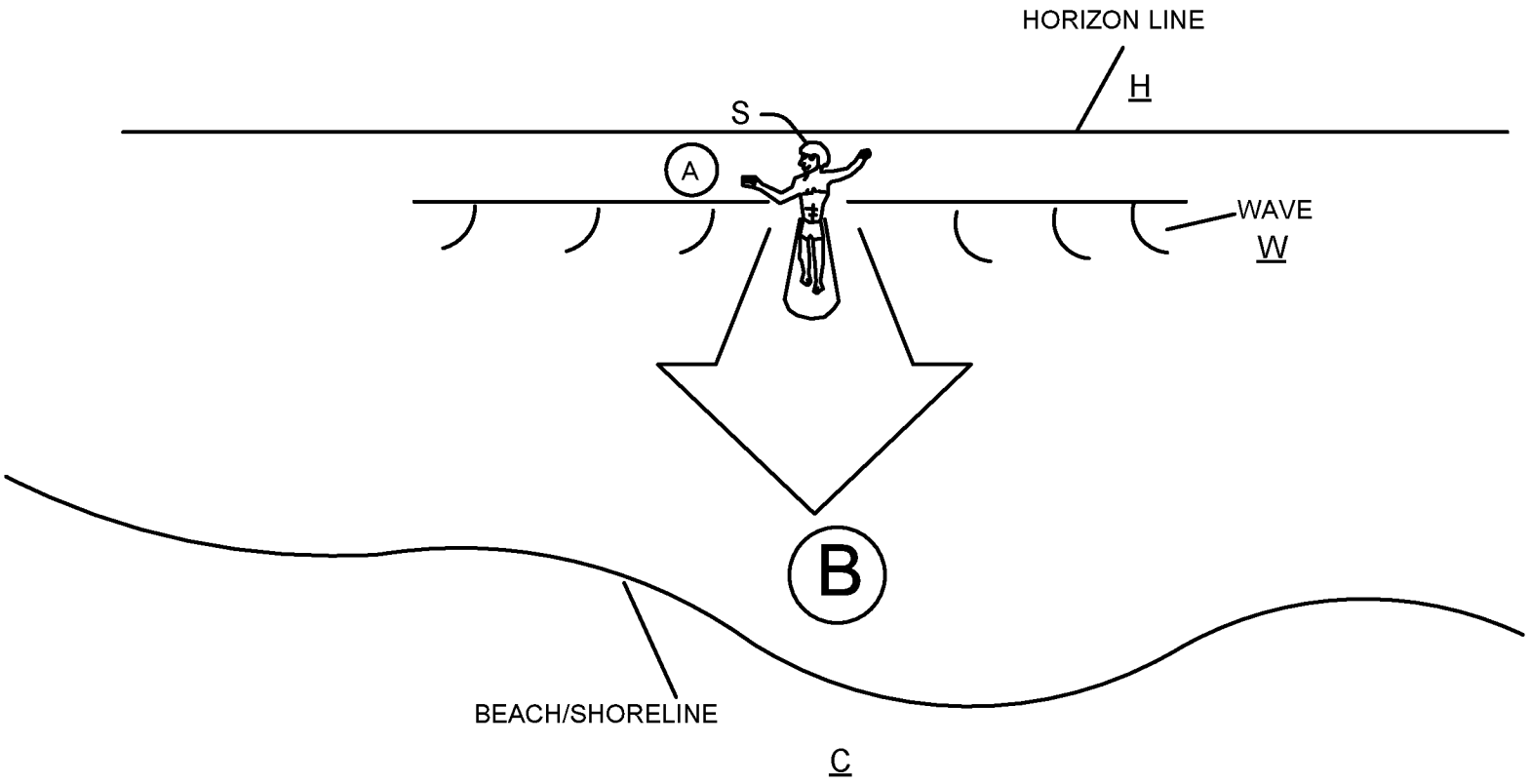
FIG. 1*a* is a view from the shoreline of a beginner's surfing on a wave.

Wave simulators that are currently available do not simulate a "down-the-line" surf wave. A down-the-line surfing wave may be described as having a long and peeling wall of water, and a rider of such a wave aims for (that is, actually surfs towards) a point further down the crest of the wave than the point the rider dropped into the wave. In addition, the wave simulators that do exist are not economical and/or have large footprints.

Examples of the wave simulator disclosed herein can be used to economically simulate an "ideal" wave for various board riding disciplines (e.g., board sports) and other uses. More specifically, an example described herein simulates a "down-the-line" wave by creating a ridable inclined flow of water. The direction of the flow may be substantially perpendicular to the incline of the flow, and thus simulates a "down-the-line" wave riding experience.

To simulate an "ideal" wave riding experience, an example wave simulator makes use of a generally wave-shaped or concave flume. A wave shaped flow of water is provided along the flume so that the streamlines of the flow are substantially parallel to the uppermost crestline of the wave simulation. The direction of the wave simulation water flow of the wave simulator may be substantially perpendicular to a line drawn from the simulated wave's trough to what would be the top of the simulated wave's crest.

A lower portion of the flume, which is substantially horizontal with respect to the concave and inclined portion of the flume, is also provided with a flow of water which allows a rider to turn in the horizontal flow and up onto the inclined flow of water, e.g., to perform maneuvers. In this way the horizontal area serves as the trough of the simulated wave for board riding purposes, with the flow upon the concave inclined portion of the flume simulating the down-the-line wave's face. A standing wave formation formed in the flume or a towrope, and/or a combination thereof, may be used to position the rider such that the rider can perform maneuvers in the simulated wave.

It can be shown in the figures described below how examples of the wave simulator can be used to simulate a down-the-line surfing experience by utilizing an inclined concave ramp surface and a water flow over the ramp surface, wherein the means of supplying the water flow is formed in the shape of the desired wave shape, and the water flow's streamlines are substantially parallel to the crest line of the simulated wave. The crest line can be simulated at the topmost inclined part of the wave-simulating ramp, wherein the ramp has a similar shape to the vent and being positioned next to the vent or nozzle array.

In another example, a substantially flat surface adjoins the concave ramp as the simulated wave's "trough", and both are connected so as to be one continuous surface. This substantially flat surface is also provided with a water flow, so that a rider can turn in the flat area to come up onto the ramp and perform maneuvers. The horizontal flat surface may have a containing wall for containing the flow of water. In other examples where there is no flat surface, the entire riding area may be an arc section, pipe section or even a parabolic shape.

In another example, a shaped surface may be either attached to the concave ramp, or formed thereon, to simulate a barreling wave from the water flow on the ramp. In other examples, a portion of the ramp may be flexible, and a mechanism may be provided to flex the ramp in such a manner as to simulate a barreling wave from the water flow.

In another example, a gravity driven water flow from atop portion of the concave ramp is provided, for cost savings and physical exercise needs of a rider.

In another example, a secondary vent (or vents) may be provided downstream of a primary vent, to lengthen the simulated wave's face for extended maneuvers.

In another example, the water may be pumped at various velocities across various parts of the flat trough and/or the concave ramp, so that various waves can be simulated and various boards can be ridden on the simulated wave.

In another example, two inclined ramps and flat areas can be adjoined for a hybrid version of the wave simulator. Additionally, a half-pipe version of the wave simulator may be constructed. Differently sized concave wave-simulating ramps in a half-pipe configuration may be provided for further variety of maneuvers using the wave simulator.

In another example, sliding bars and pipes of various types may adjoin various parts of the wave simulator, so that board riders can slide thereupon to simulate board sport sliding stunts on the wave simulator.

In an example, the wave simulator includes an "open channel" flume, and modular flume pieces are provided in diverse combinations in the open channel to make a variety of different down-the-line wave simulator configurations.

In another example, different vent shapes can be mounted to the front of a pressurized water reservoir, to provide a variety of different shaped wave simulations and accommodate a myriad of different combinations of flumes that may be constructed from the modular flume pieces of the wave simulator.

In another example, a permanently mounted, multi-shaped water vent is provided on a reservoir, and parts of the vent may be covered or uncovered to generate variously shaped water flows for use on variously shaped modular down-the-line wave simulation flumes according to the wave simulator.

In another example, the vent shape may be formed into an over-vertical arc to emanate a simulated tubular wave. In other examples, the face of a vent plate may be conformed to simulate a barreling wave shape according to the wave simulator.

A secondary water flow may be provided adjacent the wave-simulating flume. In an example configuration the secondary flow is provided by an upper water trough. In other configurations, the upper flow may be provided via an upper pool and weir combination. The velocities and thicknesses of the wave-simulating water flow and/or the upper secondary water flow may be variable in nature to simulate different waves according to the wave simulator.

In another example, a lower pool of water is provided adjacent the lower edge of a down-the-line wave simulating flume. The lower edge of the flume and an upper edge of the lower pool may adjoin each other in such a manner that a rider can make a seamless bottom turn maneuver from the high velocity water flow of the wave simulating flume, into the still pool, and back onto the flume. An upper pool of water adjacent an upper edge of the flume may be provided in conjunction with a lower pool of water. A weir may connect the upper pool with the upper edge of the down-the-line wave simulating flume. Accordingly, a rider can bank off of the water flow from the upper pool weir, perform maneuvers in the upper pool and re-enter the flume, or the rider can exit the ride into either the lower or upper pool of water. A variable weir may be provided as part of an upper pool and may comprise a grating and floatable member, to simulate a dynamic and changing wave. An additional pool of water may be provided downstream of the wave simulating water ramp to assist with rider exit.

In another example, a standing wave-forming ramp structure may be conformed as part of the down-the-line wave simulating flume (or attached separately thereto) to simulate standing waves in conjunction with the down-the-line wave simulation.

In another example, a standing wave formation and barreling wave-simulation are simulated simultaneously, and adjacent each other, in the down-the-line wave simulating flume's water flow.

In another example, the down-the-line wave simulating flume may be shaped. For example, the flume may be made circular or even semi-circular, for a unique and different down-the-line wave simulation experience.

In another example, an inclined and wave-shaped flow of water may be provided by means of a reservoir and an inclined outlet which provides a surfable water flow into and along an open channel in the flume.

In another example, a movable gate is provided adjacent a reservoir and an inclined outlet to simulate tubular barreling waves which can be changed or made to disappear in real-time during a surf rider's ride upon the wave simulator.

The foregoing examples are illustrative only, and not intended to be limiting in any way. These and other examples can be more fully understood from the following detailed description and the accompanying drawings.

Before continuing, it is noted that as used herein, the terms "includes" and "including" mean, but are not limited to, "includes" or "including" and "includes at least" or "including at least." The term "based on" means "based on" and "based at least in part on."

It is also noted that the terms used herein are well-known in the aquatic board sports and land-based board sports. Unless specifically defined otherwise herein, common definitions of such board sport-related terms have their meaning as well-documented, for example at http://www.riptionary-.com and Surfline.com "Surfology: Surfing A-Z Almanac" and online videos showing examples of down-the-line surfing on actual ocean waves. In addition, terms used in the fields of fluid dynamics and standard construction and engineering terms may also be used herein.

A down-the-line surfing wave may be described as having a long and peeling wall of water, and a rider of such a wave aims for (surfs towards) a point further down the crest of the wave than the point the rider dropped into the wave. As shown in FIGS. 1*a* and 1*b*, a surf rider S, in this case a novice surfer, normally learns to ride a wave by progressing in a straight line fashion toward the beach, from a point A to a point B on an ocean wave W with the surfboard (or other type of riding board) being more or less perpendicular to the shoreline C upon which the wave is breaking (horizon line H is shown for perspective).

Such a wave as used by beginners need not be a peeling wave, and may be mostly whitewater (i.e., a "closeout" wave with no unbroken face on the wave). However, once a surf rider progresses and learns a respective sport or sports (for there are many board sports that use waves to ride upon), they tend to ride waves in a completely different manner.

Figure 2A:
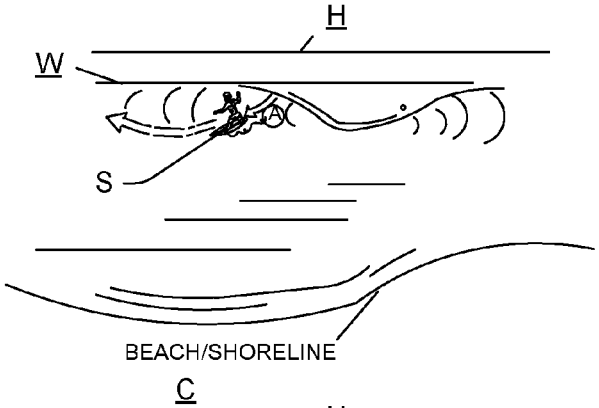
FIGS. 2*a* through 2*b* is a time sequential frontal view of an advanced surfer's ride on an ocean wave.
Figure 2B:
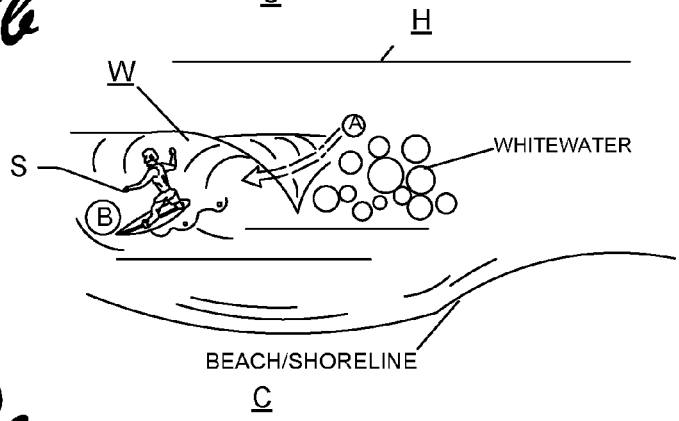

This "down the line" wave riding is depicted in sequence in FIGS. 2*a* through 2*b*. As the rider S drops into wave W, the rider initially is in a similar position as the beginner novice surfer in FIG. 1, that is, the board is perpendicular to the shoreline and the rider travels in a straight line towards shoreline C. However, as the surfer in FIG. 2*a* is not a beginner, the rider does what most all non-beginner wave riders do: the rider then turns the board so that the rider is substantially parallel to the shore and rides the wave with the board more or less parallel to the crest line of the breaking wave. This allows the rider to perform maneuvers on the wave that beginners cannot, in part because they do not have the experience, but they also do not ride the wave down-the-line so that they are continuously riding on the unbroken wave face with a breaking crest upon which to perform maneuvers.

Figure 2C:
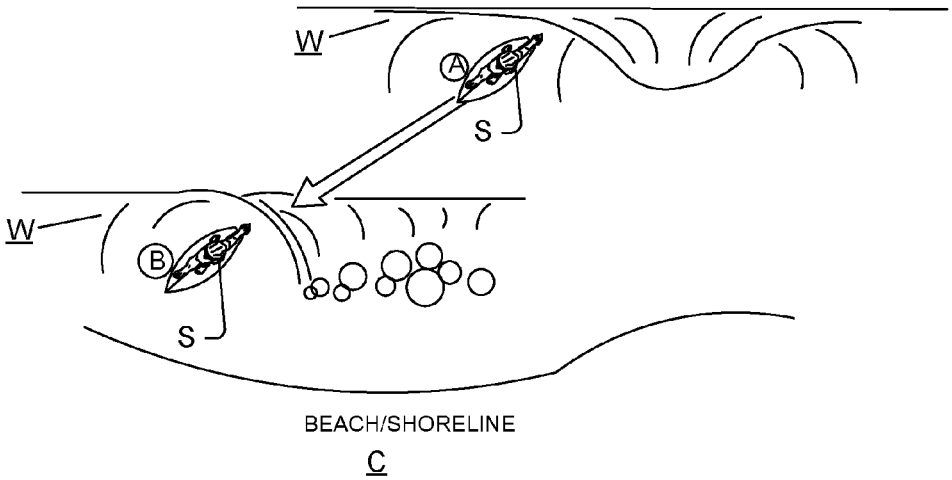
FIG. 2*c* is a plan view of the surf ride of FIGS. 2*a* and 2*b*.

As shown in FIGS. 2*b* and 2*c*, the surf rider S has progressed forward and toward the shoreline C along the wave S's unbroken wave face, with the whitewater of the wave being behind the rider as the rider progresses toward the shore C, and diagonally to a point B from a point A on the ride. This advanced type of wave riding can be simulated, wherein the rider is substantially parallel to the shoreline and wave's crest as the rider performs maneuvers on the wave. This type of wave is sometimes referred to as a "peeler", or peeling wave, as the unbroken wave face breaks diagonally down the reef or sandbar, peeling into what is typically a barreling wave B', with whitewater being left in the wake of the wave's path.

Figure 2E:
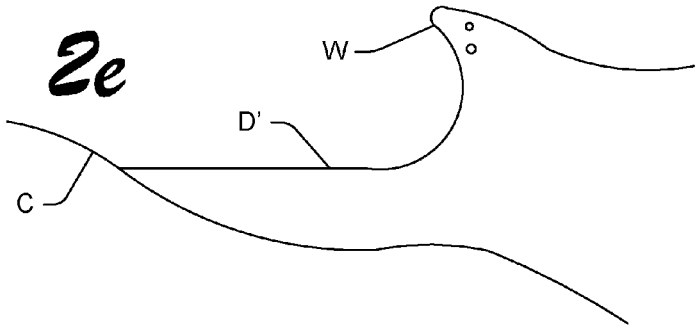
FIG. 2*e* is a side cutaway view of an ocean wave.
Figure 2F:
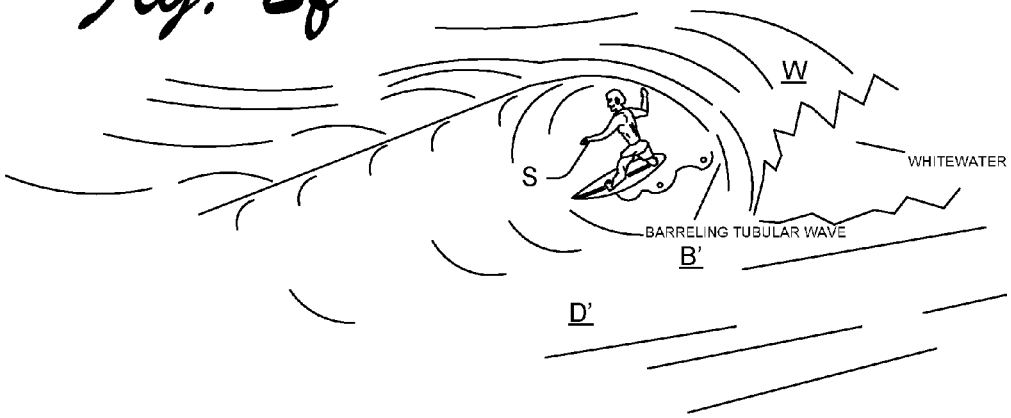
FIG. 2*f* is a perspective view of a surfer riding a peeling wave in a down-the-line fashion.
Figure 2G:
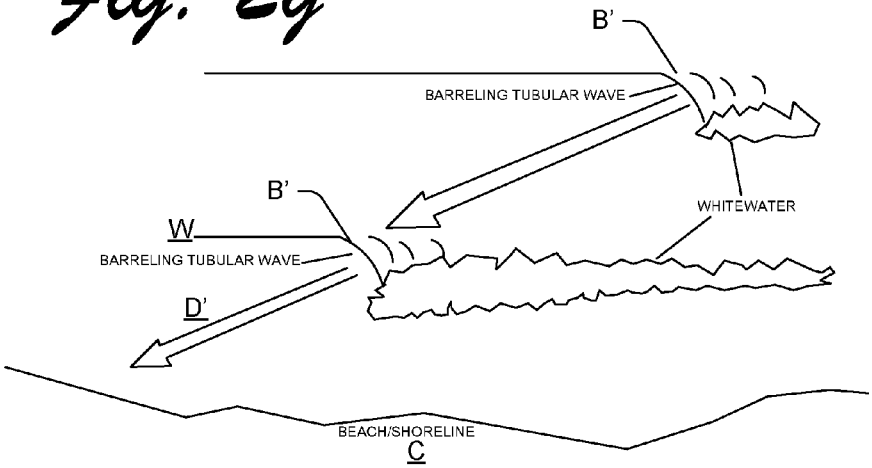
FIG. 2*g* is a plan view time sequential of an advanced surfer's ride on a peeling wave.

Such a peeling wave is depicted in FIGS. 2*e* through 2*g*, with a barreling wave section B' and a relatively flat bottom turn water area D' in front of the wave W is shown as well for the surfer S to bank and turn therein to then travel up wave W's inclined surface to perform maneuvers thereupon.

A universal aspect of most oceanic aquatic board sports is that participants, including traditional surfers, seek out what they consider to be perfect waves, and such waves are almost always considered to be down-the-line type waves (i.e., the wave breaks along at a diagonal relative to the shore and preferably possess a barreling peeling wall with a crisp crest line and lip, with a smooth horizontal trough zone for turning back into the wave's face). The one aspect of these board sports that is sometimes missing is a consistent means of practice, because these types of waves, and the swells that cause the waves to form, are subject to prevailing local weather conditions for quality, and are dependent on far-away storm conditions to produce wave swell.

In light of the foregoing, the wave simulator disclosed herein desires to economically provide a simulated down-the-line surf wave-riding practice, and methods to produce such simulated waves in a compact footprint/area.

Before continuing, it should be noted that the examples described above are provided for purposes of illustration, and are not intended to be limiting. Other devices and/or device configurations may be utilized to carry out the operations described herein.

Figure 3A:
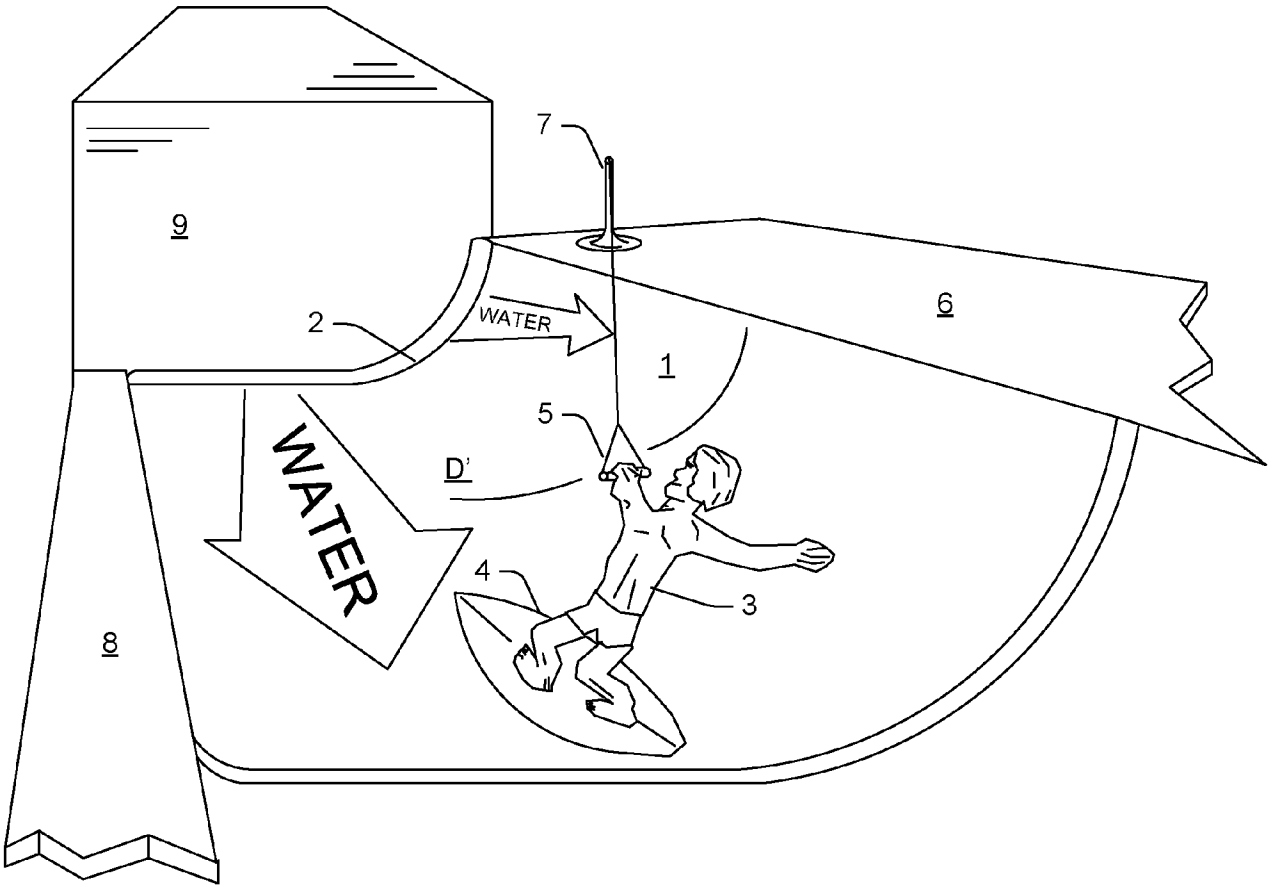
FIG. 3*a* is a perspective cutaway view of the wave simulator.

FIG. 3*a* shows a flume with a ramp or inclined side wall 1 with a substantially flat trough area D'. A pressurized water source is represented by arrows in FIG. 3*a*, and emanates from a vent or nozzle array 2. A board rider 3 rides atop a board 4 as the water moves towards the rider along the concave wall of ramp 1 and the substantially flat trough area D'.

The wave simulator may be used with many types of boards for riding, including but not limited to surfboards with fins, wakeboards (with or without fins), kite boards, "soft-top" surfaced boards, or hybrid or experimental boards, all with or without foot straps upon individual personal rider preference. Skimboards, which typically have no fins as they are used in very shallow near shore waves, can be used as well and may be particularly useful in thinner flow wave simulations as may be provided by the wave simulator.

The rider 3 holds onto a tow rope handle 5 which may be attached to an upper deck 6 via a stanchion or support post 7. A lower platform 8 is also provided as shown. A rider 3 may enter the wave simulator from either the upper deck 6 or lower deck 8. The vent 2 may be attached to a reservoir 9, so that water pumped into the reservoir 9 becomes pressurized therein and flows at velocity out of the vent 2 onto the ramp 1.

The use of a tow handle and line assembly, or handle in general, has in the last thirty years or so been used with many new aquatic board sports that have emerged. For example, tow surfers use jet skis and tow ropes with handles to catch up to and ride massive waves on outer reefs, and some use the same set-up to do "tow-ats", wherein the board rider is towed directly at a wave face to do a massive carve or an aerial off of the wave. Wake boarders use tow handles to ride behind boats. Kite boarders use handles attached to large kites via lines to ride across water and on waves, and wind surfers use handled booms with attached sails to do the same. Therefore, the use of a handle and line by the wave simulator for riding a simulated wave may be considered consistent in many ways with existing aquatic board sports practice.

Figure 3B:
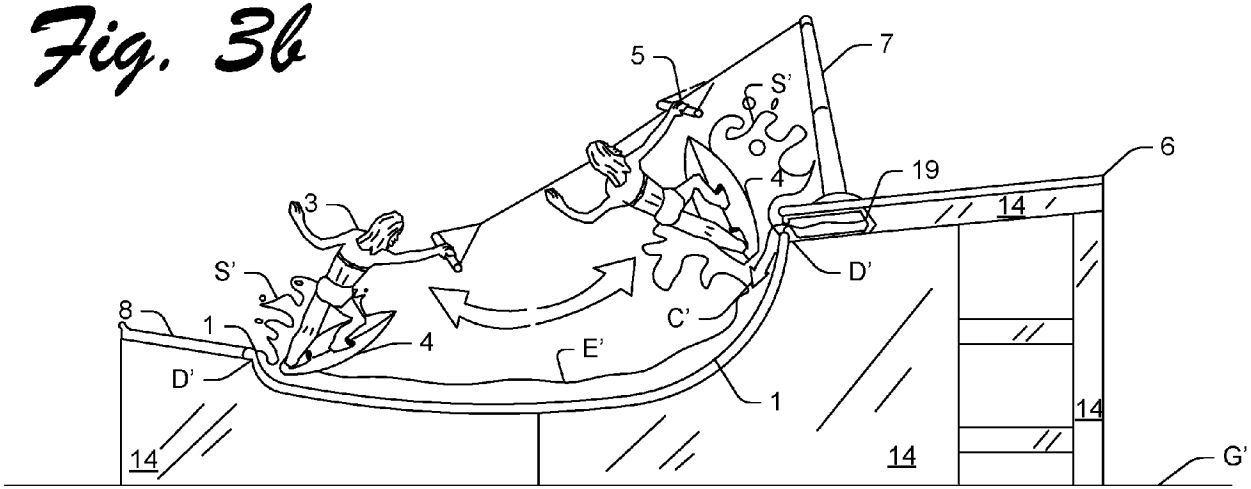
FIG. 3*b* is a side partial cutaway view depicting the typical riding action of a user of the wave simulator.

FIG. 3*b* shows the typical board riding action on the wave simulator. A rider 3 pivots across the normally supercritical flow E' in area D' while on board 4 while holding tow handle and line assembly 5, with the line usually being attached to a stanchion pole 7 as shown. The rider does what is commonly referred to as a bottom turn in the area D' of the ramp 1, and then uses the speed generated from the turn to bank up onto the upper inclined flow on ramp 1 to do a top turn with associated water spray S', as shown. A top secondary flume 19 may also be provided, as shown, with a separate subcritical flow of water C' flowing down the ramp 1 from an upper secondary flume 19 as desired. Flow emanating from a top secondary flume 19 may make a mound of water in the upper part of the ramp where its subcritical flow C' meets supercritical flow E', and riders may bank off of this "lip" of water on the boards.

Figure 3D:
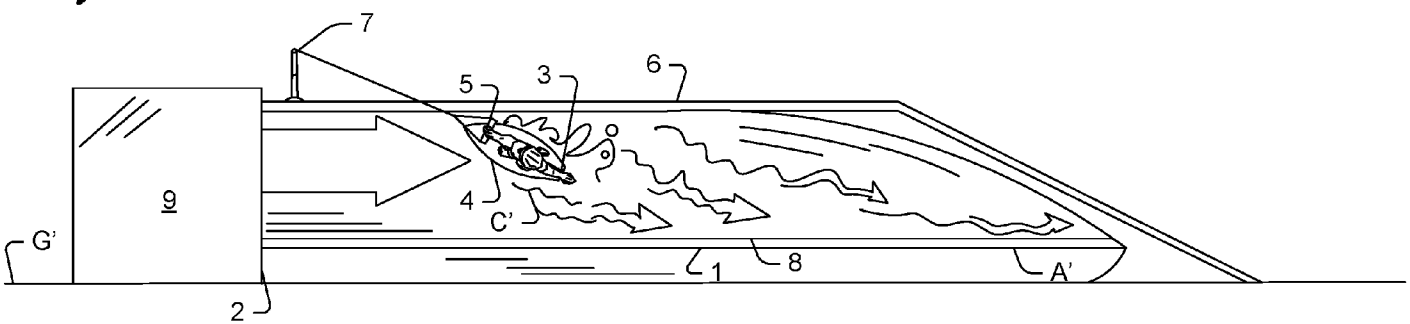
FIG. 3*d* shows a typical flow pattern of the wave simulator.
Figure 3C:
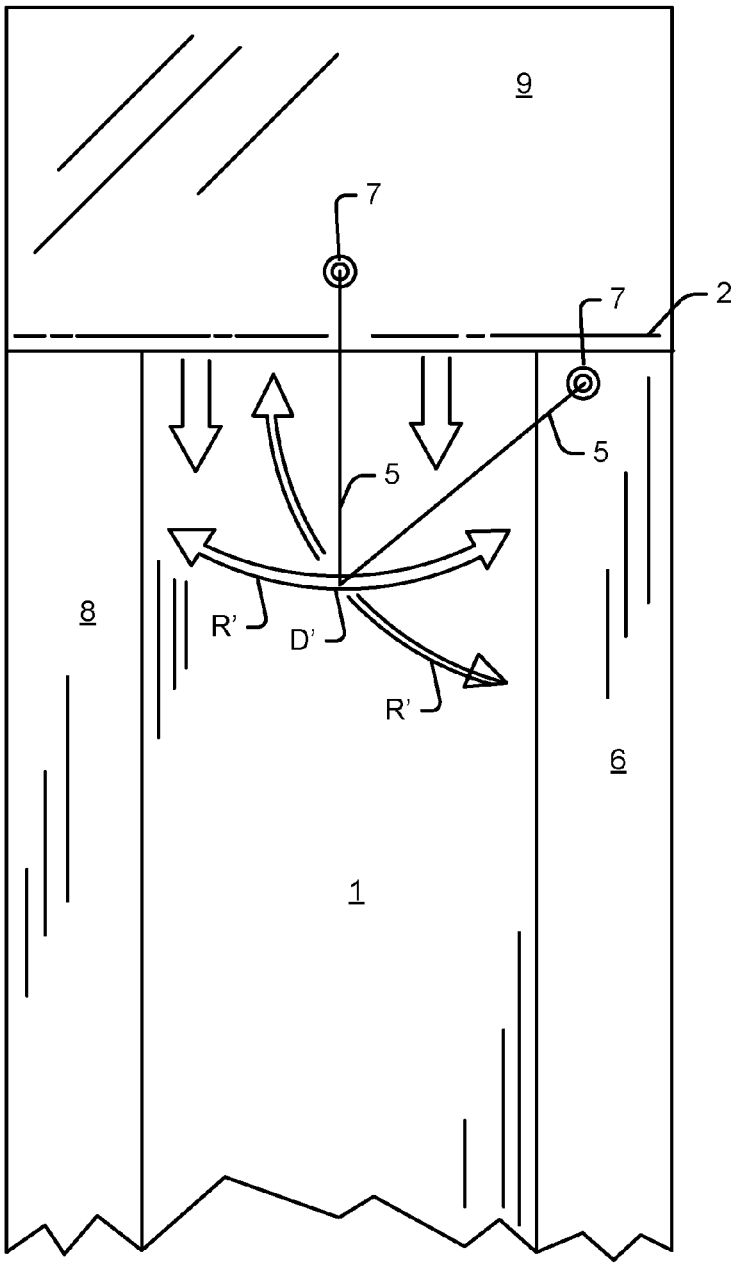
FIG. 3*c* is a top cutaway view showing exemplary riding arcs of a surf rider of the wave simulator.

As shown in FIG. 3*c*, the handle and line assembly 5 makes different rider path arcs R' depending on the location of the stanchion 7. Several stanchion posts 7 may be provided attached to various points of the ride for this very purpose. As the rider's path of travel on the simulated wave flow is limited in this fashion, the wave simulator can be made quite narrow and compact. In an example, the wave simulator is able to fit in indoor venues where wave simulators have heretofore been unknown, such as family entertainment centers and fitness centers. As only a narrow strip of wave-shaped flow (for example, around 4 to 6 feet in length, minimally, to accommodate the board and rider plus a sufficient length of grated exit area) is necessary for the successful operation of the wave simulator, this goal may be achievable, and a backyard version of the wave simulator may therefore be a viable and marketable option.

FIG. 3*d* shows a typical flow pattern of the wave simulator. Typically, pressurized supercritical flow E' emanates from a vent 2, and the rider rides on this flow. As gravity and friction act on the flow, it loses speed and drops down the wall of ramp 1 at some distance downstream of the vent 2, and then becomes a subcritical flow C'. The transition of the flow from supercritical to subcritical may be accompanied by a hydraulic jump or a standing wave. When supercritical flow suddenly turns subcritical, hydraulic jumps may form. These formations may also be ridden and turned upon by a rider of the wave simulator.

Figure 4A:
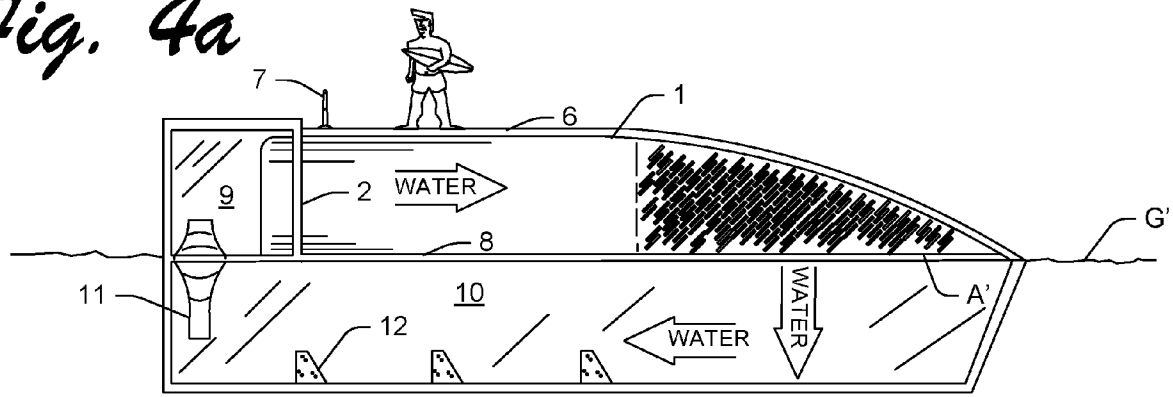
FIG. 4*a* is a side cutaway view of a permanent installation of the wave simulator.
Figure 4B:
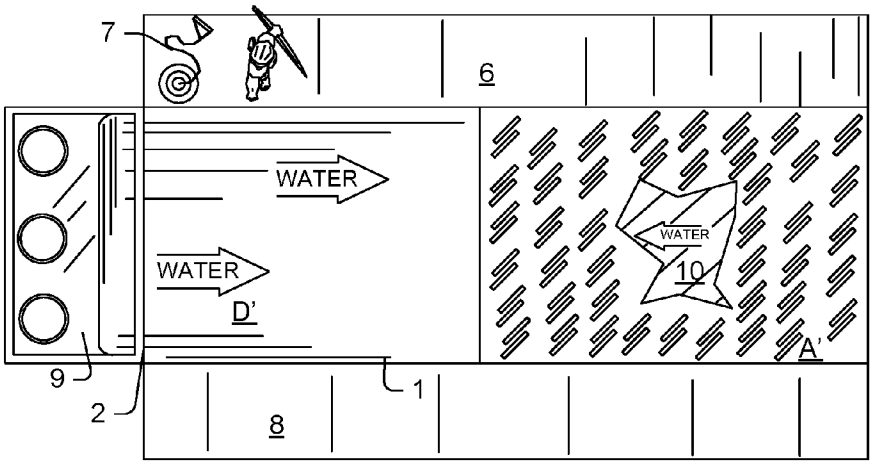
FIG. 4*b* is a plan view of the wave simulator as shown in 4*a*.
Figure 4C:
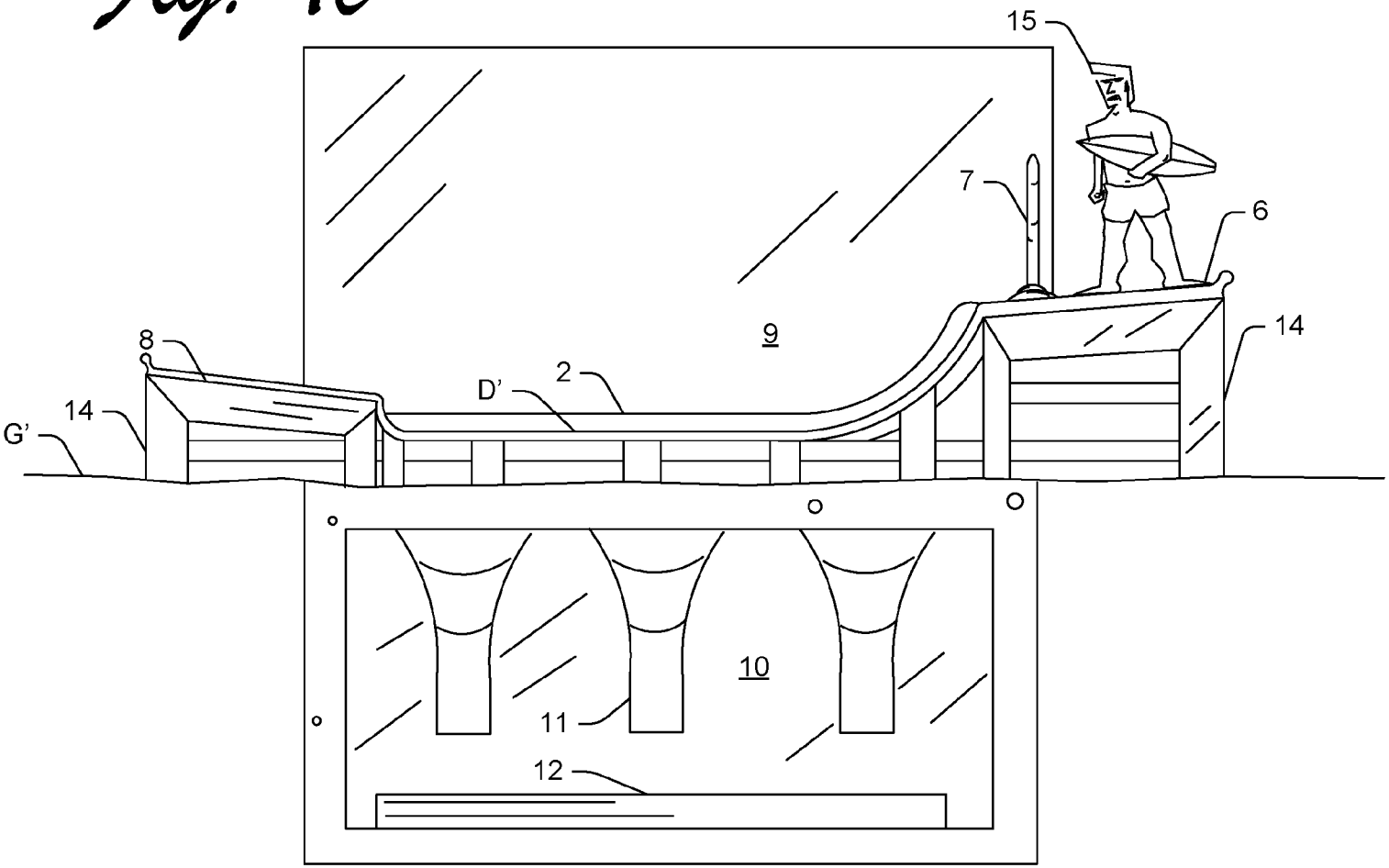
FIG. 4*c* is a side cutaway of the wave simulator shown in FIGS. 4*a* and 4*b*.

FIGS. 4*a*, 4*b* and 4*c* show a preferred configuration of the wave simulator. A volume of water is disposed in a channel 10, which itself is placed in an area of ground G'. The volume of water is then pumped via submersible pumps 11 into a reservoir 9. The water become pressurized in the reservoir 9 and then flows at velocity through a concave/wave-shaped vent or vents 2 onto the concave ramp and flat bottom-turn trough area D'. The pressurized water flow proceeds across the surface of the ramp until the water flow loses velocity and then returns to channel 10 via a grated area A'. Grated area A' is also the rider exit area, and may be padded as desired. As shown in the drawings, baffle blocks 12 may be disposed in the channel 10 to lessen the velocity of the water flow from grated area A'.

As shown in FIG. 4*c*, a lightweight support structure comprised of a scaffolding assembly 14 may be employed to support the upper platform deck 6, lower platform 8, concave ramp 1, and flat area D'. The scaffolding is preferably made of aluminum or steel bar, and made to be transportable as needed. The parts of a scaffolding system 14 that support the flume may be shaped to perfectly cradle the flume, with the transition curves of the support scaffolding matching the curvature of the flume and its bottom turn area D'. The scaffolding/support structure 14 normally is deployed on an area of ground G' to support the wave simulator thereupon. A spectator 15 has been shown for an exemplary scale of the wave simulator.

Figure 4D:
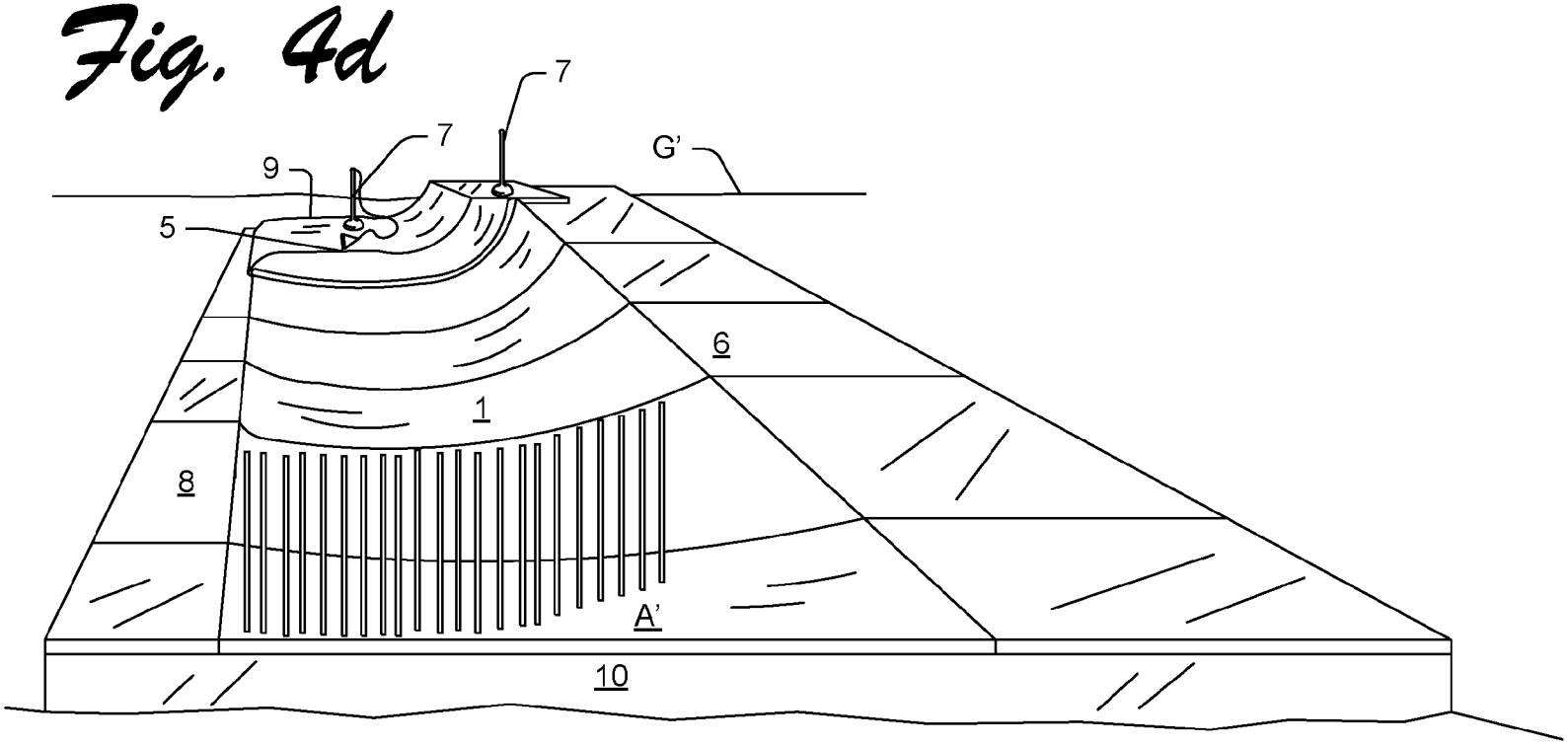
FIG. 4*d* is a perspective view showing the typical curvatures of a wave simulating flume according to the wave simulator.

FIG. 4*d* shows a perspective view of an exemplary flume. As shown, the ramp 1 is normally more inclined the nearer it is to the vent 2, and slowly tapers down to a relatively flat exit area A' as shown. The ramp 1 gradually tapers down due to the force of gravity on the flow. Of course, this is only exemplary of a typical ramp 1 curvatures, shape and length and the ramp 1 of the flume may be formed with any incline angle and any shapes thereon that are desirable. FIG. 4*d* also shows a ramp-shaped reservoir 9, which may be slid upon by riders as well.

A 1:1:1 ratio of ramp height to area D' length to ramp transition length has been found to be a useful guideline in some versions of the wave simulator, for example, to make a 4 foot high wave simulation the ramp may be around four feet wide (i.e., a four foot transition) until adjoining the flat turn area D', which itself is about 4 feet in width. A smaller height ramp may still make use of a longer bottom turn area D' or larger ramp 1 transition width, but the opposite does not usually hold true, e.g., an 8 foot high ramp normally does not work well with a 4 foot wide ramp transition and four foot turning area D'. These are, of course, only general guidelines and different ride profiles and dimensional ratios may be employed according to the wave simulator to satisfy the end-user of a product made according to the wave simulator.

Referring to the specific components of the wave simulator and typical composition and structure, concave ramp 1 and the flat bottom turn area D' are normally made out of fiberglass and are sectional with flanged ends, not unlike a waterpark-grade waterslide. The sections of a ramp 1 and bottom turn area D' can therefore be easily shipped and bolted together on-site. As shown best in FIGS. 4*a* and 4*d*, a ramp 1 and flat area D' slowly taper down at the trailing end, as the vented flow of water cannot stay on the wall for any length far downstream of the vent 2 due to the forces of gravity and friction. Additionally, as best shown in FIG. 4*c*, the far edge of area D' where adjoining the lower platform 8 is slightly curved upward to meet the platform, so as to contain the flow of water in the ramp area. This curvature of the area D' is normally about 4 inches to about 24 inches high. The width of the flat area D' is normally about 3 feet to 15 feet wide, and the height of the inclined portion of a concave ramp 1 is normally around 3 feet to 8 feet high. The combination of area D', the curvature toward the lower platform 8, and the concave ramp 1 may form a flume, and can be made in one continuous conformation. The platforms 8 and 6 may both be canted as shown to guide any excess water spray or flow from the wave simulator back into the flume, and are preferably made of lightweight and slip resistant materials such as textured plastic, wood, steel, aluminum or fiberglass. The platforms 6 and/or 8 may be molded into the flume as desired.

With regards to the nature of the channel 10 and reservoir 9, as well as baffle blocks 12, they are normally made of materials not unlike a swimming pool, such as concrete, although a portable version of the wave simulator may use stainless steel, fiberglass or thermoplastics for these components. The pumps 11 are normally vertical turbine submersible pumps like those used for municipal water supply systems or as used for other high-volume GPM (gallons-per-minute) waterpark attractions on the market today. The vent 2 may be made of stainless steel, thermoplastics, or similar materials, and is preferably constructed so as to make the flow of water emanating therefrom as laminar as possible, meaning a smooth flow of water is desirable. Therefore, the inner facing surfaces of the vent 2 are curved and filleted in such a manner so as to affect a laminar flow of water therefrom. However, a high velocity, or supercritical, water flow may be necessary for turns and stunts on most versions of the wave simulator, so a delicate balance of flow velocity, laminarity, and sufficient water depth for surf maneuvers is a prime goal of the wave simulator.

An inflatable bladder (not shown) or bladders may be positioned either inside the reservoir 9 or outside the reservoir attached to the vent 2, and positioned in proximity to the vent 2 so that as they are inflated and deflated to effect the water flow, for example, by being thinner and faster or thicker and slower by alternatively lessening and increasing the relative bore/opening size(s) of the vent 2 as the bladders are inflated and deflated. Many bladders may be used so that the flow can be manipulated in the aforementioned manner in various parts of the vent 2 at any one moment in time. An adjustable vent may also comprise a hinged gate, single weir, or assembly of adjustable gates affronting the orifice of vent 2.

According to one example of the wave simulator, the flow of water may be directed by the angularization of shaped vanes (not shown) within a vent 2, or of the permanent or movable angling of a vent or vents 2 in relation to the flume. An upwardly angled flow toward the inclined surface of the flume from an angled vent may aid the rider in riding the inclined flow thereon.

Preferably, the wave simulator is capable of supplying a flow of water across the flume assembly of ramp 1 and flat area D' that is minimally 1 inch, and preferably 4 to 14 inches, and moving with a velocity sufficient to enable a rider 3 to perform a turn in area D' with sufficient force that water flow propels the rider up the concave face of the ramp 1, where the rider can perform a maneuver or stunt on the water flow on the face of the ramp 1, and then rider 3 can return to the bottom of the ramp and design and perform further enjoyable maneuvers and stunts on the simulated down-the-line wave as provided by the wave simulator.

The stanchion pole 7 is normally made of stainless steel and is usually bolted to the upper platform 6 or reservoir 9. Other means may be used to secure a tow handle and ropeline assembly 5 to the wave simulator, such as a wire and slider assembly, or a spring loaded line take up reel device such as those used by water skiers and wakeboarding boats. A looped fastener securely attached to any desired point on the structure of the wave simulator may also be used to secure the tow line of handle assembly 5. The tow handle 5 may be about 6 to 12 inches long, or longer in cases where the rider desires to simulate board sports such as kite boarding or windsurfing, where the handles are longer and usually have lines attached thereto for a harness to affix to the lines via a harness hook on a rider's harness.

In an example, tow handle 5 may be only needed by a surf rider 3 initially, and that once the rider gets onto the simulated down-the-line wave face of the wave simulator the rider may stay on the simulated wave by pumping down-the-line as real surfers do on peeling waves in the ocean. Such pumping action by the surfer may not result in much actual travel forward along the length of a flume, but the wave riding simulation may still feel authentic to the rider. This "handle-less" condition may be sought to simulate wave riding for typically non-handled board sports, for example, traditional surfers. A thickening and/or slowing of the flow of water may be employed to accomplish this effect, for example, by slowing down the pump motors via controls and/or enlarging the vent 2's aperture in across the whole of same or in specific portions thereof. The formations of hydraulic jumps, or standing waves on the face of a flume may also be used by a rider to surf the wave simulator without the use of handle 5.

The grating area A' may be made of actual waterpark-grade grating, or may be a recessed area (not shown) with foam or plastic balls therein to lessen rider impact in the exit area, with the bottom of the recess being itself grated to allow for the passage of water therethrough to the channel 10. If only a grating is used in an area A', then the grating may have perforated or slit padding provided thereover for rider safety and adequate water passage. A water permeable fabric or mesh may also be used instead of grating for the purpose of returning water to the channel 10 from the flume.

Figure 5A:
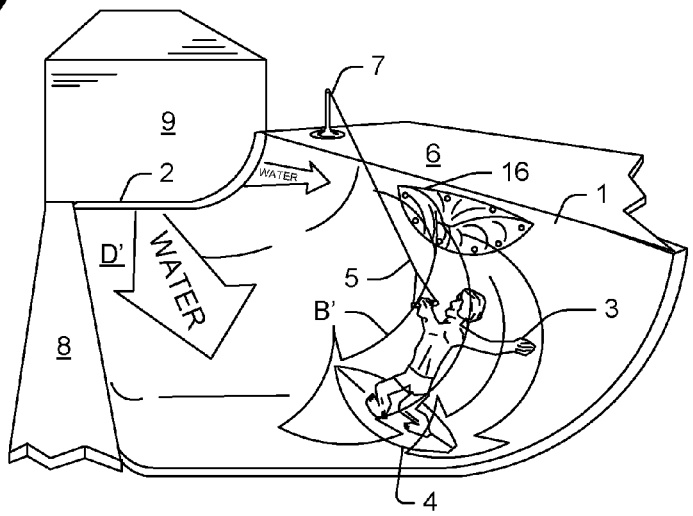
FIG. 5*a* is a side perspective partial cutaway view of a barreling wave simulation as provided by the wave simulator.
Figure 5B:
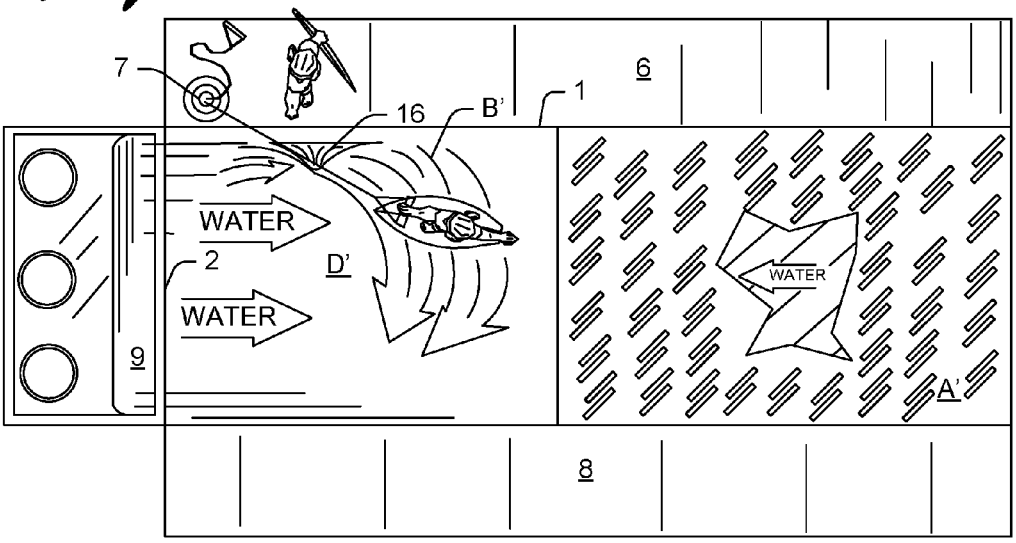
FIG. 5*b* is a plan view of the example shown in FIG. 5*a*.

As shown in FIGS. 5*a* and 5*b*, a shaped member 16 may be bolted or otherwise affixed to the upper part of a ramp 1 so that the flow of water of the wave simulator may encounter its angled surface and throw out a simulated barrel wave B' for a rider 3 to ride inside of and also to do turns off of the top part thereof. Barreling waves are often considered the most prized types of waves for surf riding, for not only riding inside the tubular barrel part of the wave but also for floating over the barrel and doing maneuvers on the whitewater that is formed by the breaking lip of the barrel wave B', as well as maneuvers on the lip of the wave itself. Many different styles and shapes of a member 16 may be provided so that many different types of barrel waves and other types of wave formations may be simulated by the wave simulator. A member 16 may be designed and fabricated to only make a whitewater wave simulation, for example, or may make a wedge wave or lip of water for the rider to ride on or hit with the board. The member 16 may be constructed of a number of materials, preferably fiberglass, but alternatively of materials including but not limited to plastic, closed cell foam glued to a hard backing, or polycarbonate clear plastic. The tubular wave simulation as made by this example of the wave simulator may be substantially deep enough for a rider to be within the simulated barreling wave for any length of time the rider desires, as long as the rider has the skill and stamina to ride therein. Alternatively, the ramp 1 may be formed from a mold that is shaped to make a barreling down-the-line wave simulation, for example, a fiberglass ramp 1 that is shaped with a barreling wave forming conformation 16 molded into the "crest", or top, of the ramp 1.

Figure 6A:
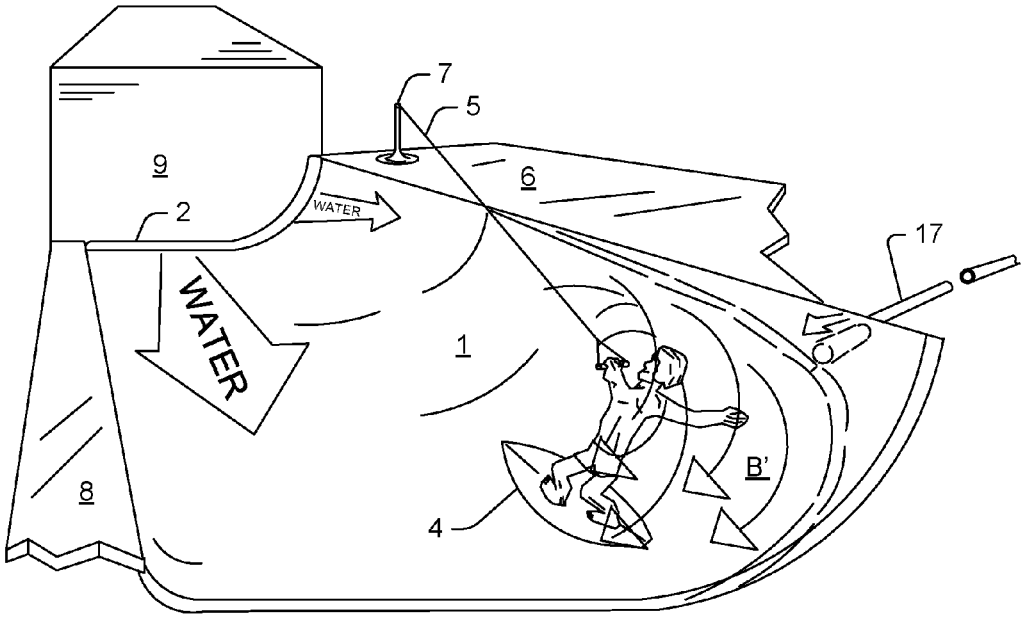
FIG. 6*a* is side perspective partial cutaway view of another example of the wave simulator.
Figure 6B:
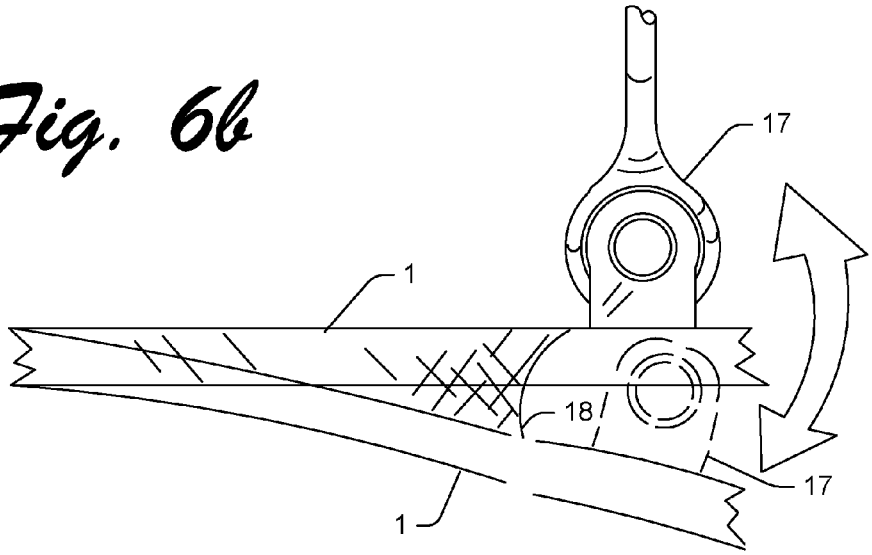
FIG. 6*b* is a close up of the movement of a movable wave simulation wall of the wave simulator.

Another example of the wave simulator is shown in FIGS. 6*a* and 6*b*. A ramp 1 may have a flexible upper portion of its wall in certain sections or lengths, so that a pushrod assembly 17 may be attached to a motive means (not shown) to push the wall of a flume 1 to become more vertically inclined and, in cases of extreme flexion, angled with respect to the flow of water across it. As the flow of water encounters this part of the ramp 1, the water flow may form a throwing lip of water upon which a surf rider may perform maneuvers and, in extreme cases, this flexion/angularization of the wall may cause a simulated barreling tubular wave B' to form, similar to that formed in FIGS. 5*a* and 5*b*. Both the lip and barrel of a tubing wave B' are desirable for the surfing action of riders as provided by the wave simulator. The flexing action as provided for by an actuated pushrod attached to a flexible wall of a flume can also be used to change the characteristics of a simulated down-the-line wave during a rider's turn on the wave, which may add to the overall amusement and enjoyment provided by the wave simulator. A flexible elastomeric fabric or mesh 18 may be attached between the upper wall of flume 1 and platform 6 in this example for safety purposes.

Figure 7A:
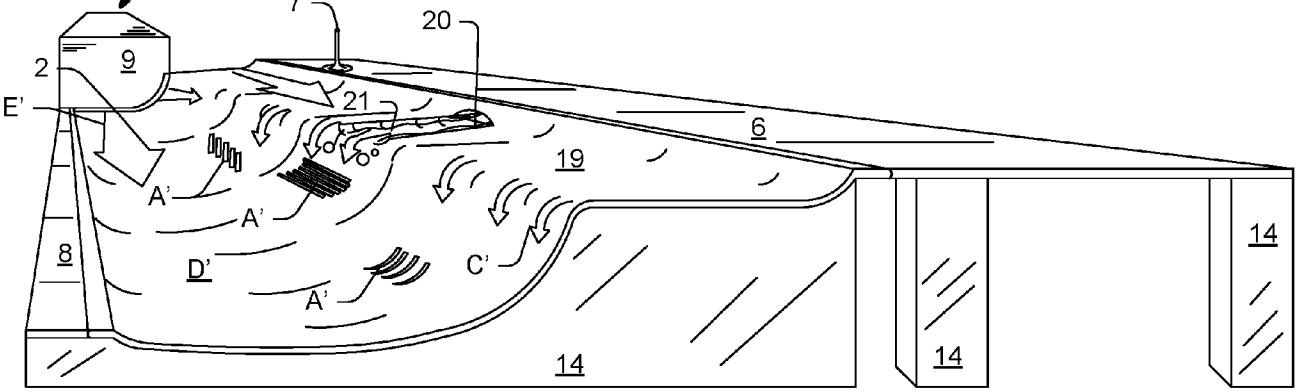
FIG. 7*a* is a side perspective partial cutaway view of another example of the wave simulator that features a gravity flow of water.

In FIG. 7*a* an example is shown where a subcritical flow C' of water is provided adjacent the top a ramp 1 via a secondary flume 19 that is attached either to the top of the ramp 1 and/or to the platform 6. Secondary flume 19 may be affixed underneath an upper platform 6 with only a small bore "slit" opening, from around 1 inch to about 6 inches, to allow for the subcritical flow C' to flow down the ramp 1 from secondary flume 19. The water to a secondary flume 19 may be provided either from a reservoir 9 or from channel 10, and normally has its own pumping system (not shown). A supercritical flow E' is provided as shown in trough area D'. Grated areas A' may be positioned in a similar manner as shown in the Figure to remove undesirable water flow that may clog the supercritical flow E' as the water flow meets the subcritical flow C'. Alternatively, a permeable membrane or fabric may be used for drainage.

This example of the wave simulator has several advantages. First, a rider can get speed from the supercritical flow in a turn and carve towards and up the downwardly flowing subcritical flow on the wall of ramp 1, and this action may require more exertion and/or energy from a rider than other versions of the wave simulator. Therefore, this example is well-suited as an exercise device or cardiovascular exercise platform, for example, and may be far more enjoyable than most forms of exercise on the market today for similar purposes. Also, since only a portion of this example requires the more expensive (due to the pumping costs) supercritical flow, the wave simulator is less capital intensive to manufacture and operate.

In one example of the wave simulator another vent 20 is provided as shown in FIG. 7*a*, and from the vent 20 is pumped a heavy yet slow flow of water to form water mass 21. As a rider of the wave simulator tends to ride up and down the same axis due to the mechanics of the system, water mass 21 may be provided so that a rider has a "lip" of water to perform maneuvers on and also to throw a more spectacular spray of water from a top maneuver thereon. A separate pump and pipe assembly (not shown) may be used for a vent 20, or may use a flow of water from a secondary flume 19.

The system of a vent 20, pump assembly (not shown) and water mass 21 may be used on any example of the wave simulator so as to provide a means of performing top maneuvers thereupon.

Figure 7B:
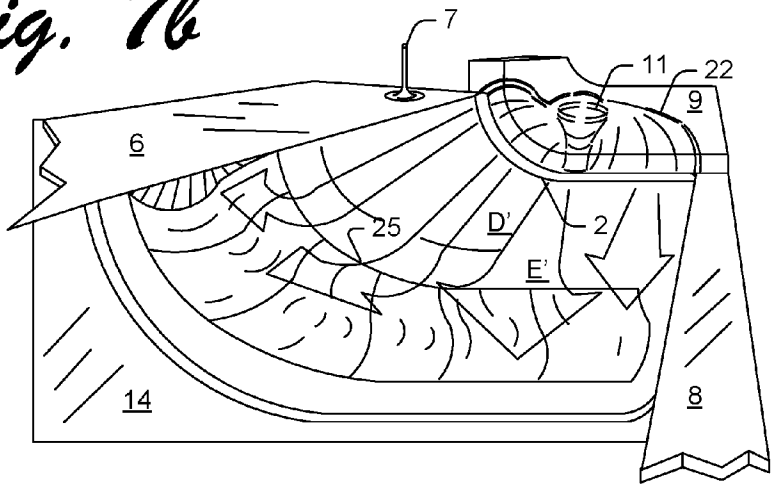
FIG. 7*b* shows a means of forming a standing wave on the wave simulator.

FIG. 7*b* shows another example of the wave simulator. A ramp member 25 may be fitted to the surface of the flume to make a hydraulic jump or standing wave formed from the flow of water thereover. Such standing wave and/or hydraulic jump formations made by a ramp either attached to or molded directly into a flume may allow riders of the wave simulator to ride the simulated down-the-line wave without a tow handle. A rider may either initially use the tow handle and line 5 to get onto the standing wave or simply drop onto the standing wave from either deck 8 or 6. This example of the wave simulator is useful for bodyboarding or traditional surfing of the wave simulator, as they normally do not use tow handles to ride waves.

Figure 8A:
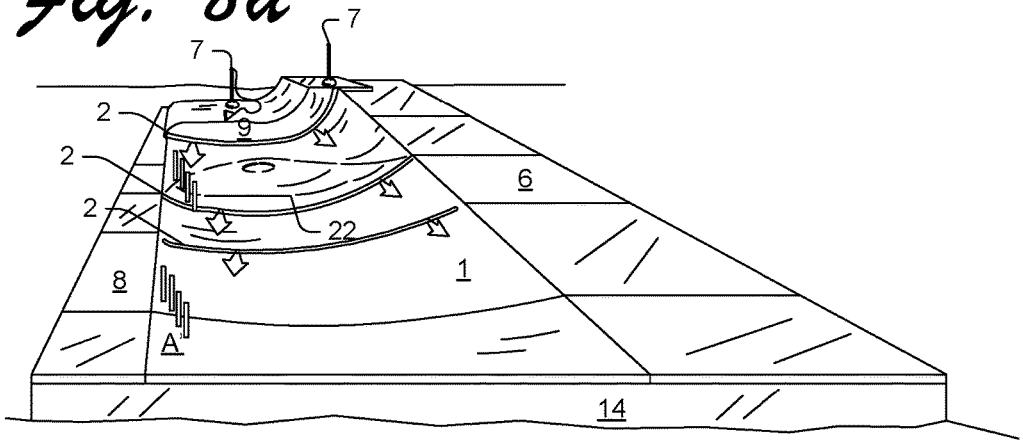
FIG. 8*a* shows additional flow supply means according to this example of the wave simulator.
Figure 8B:
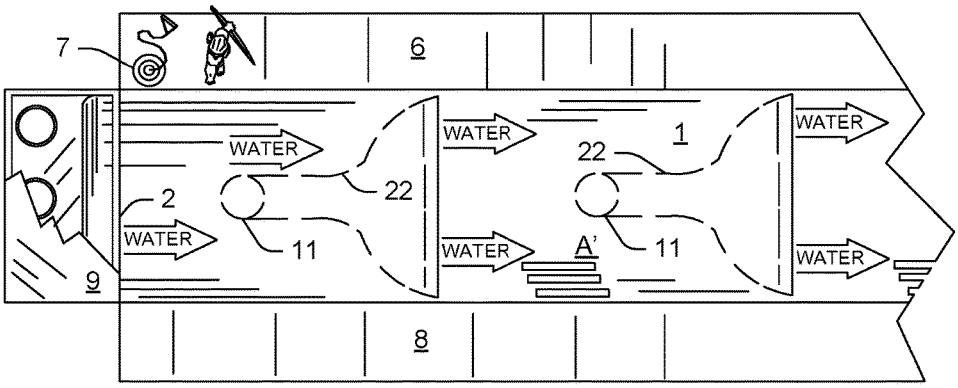
FIG. 8*b* is a plan view of FIG. 8*a*.

FIGS. 8*a* and 8*b* show another example of the wave simulator. As shown in the Figures, a secondary vent 2 may be provided in a flume downstream of an upstream vent 2 that is attached to a reservoir 9. This may provide for an extended riding area of the wave simulator, as gravity and friction forces eventually slow the flow down and also prevent the flow from staying in any position other than the horizontal for any length of time. Therefore, the ridable part of the flow on the inclined portions of the ramp 1 is short-lived, and usually only about 4 to 10 feet long along the wall of the ramp. A curvilinear duct system 22 may be employed as shown to extend the flow via a secondary vent 2. Of course, a third, fourth and so on, vents 2, preferably with separate pumps 11 as shown, may be employed in this fashion upon the flume. Curvilinear duct system 22 is normally manufactured out of stainless steel, but may alternatively be made of other materials, such as thermoplastics, fiberglass or aluminum. Grated or otherwise permeable areas A' may be disposed in the flume to remove water that has lost its velocity and may therefore be a hindrance to the surf riding action on the wave simulator.

Figure 8C:
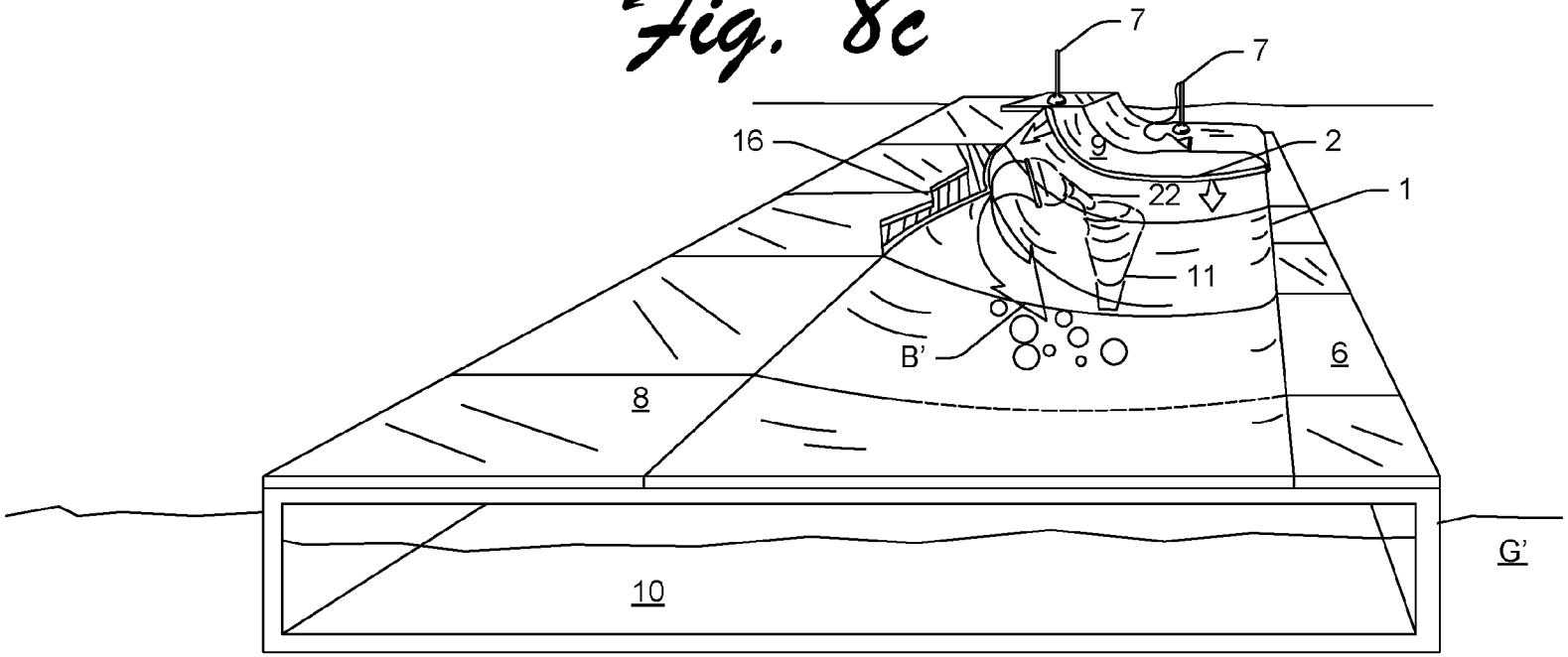
FIG. 8*c* shows a side perspective partial cutaway view of another means of forming a barreling wave simulation according to the wave simulator.

FIG. 8*c* shows a secondary vent 2 that has been positioned at an angle so that the flow therefrom is directed at a barrel member 16, which in this case has been molded directly into the fiberglass of a flume 1. Pump 11 draws fluid directly from channel 10 to direct onto and over member 16 to form barreling wave B'. A ride operator, via pump controls for a pump of this example of the wave simulator, can turn the barreling wave on or off, as well as control the strength of the tubing wave B' itself.

As also shown in FIG. 8*c*, an alternatively formed reservoir 9 may be provided, which can be slid upon by riders in this concave-shaped example. A rider may elect to re-enter the ride flow or exit the ride after a sliding stunt on a concave reservoir 9.

Figure 9:
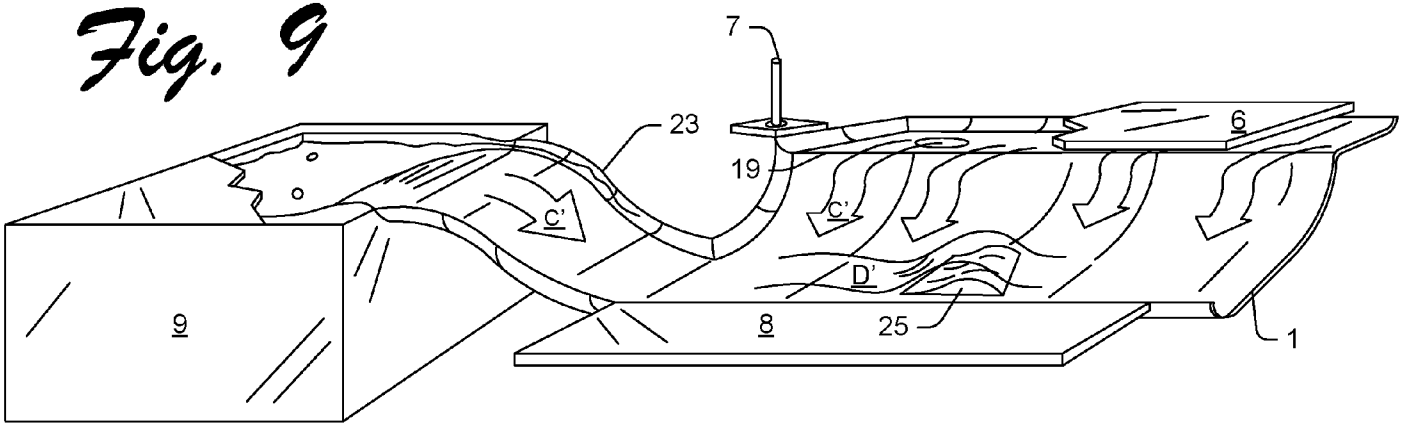
FIG. 9 shows an example of the wave simulator utilizing a gravity-fed simulated river for the flow of part of the wave simulator.
Figure 10:
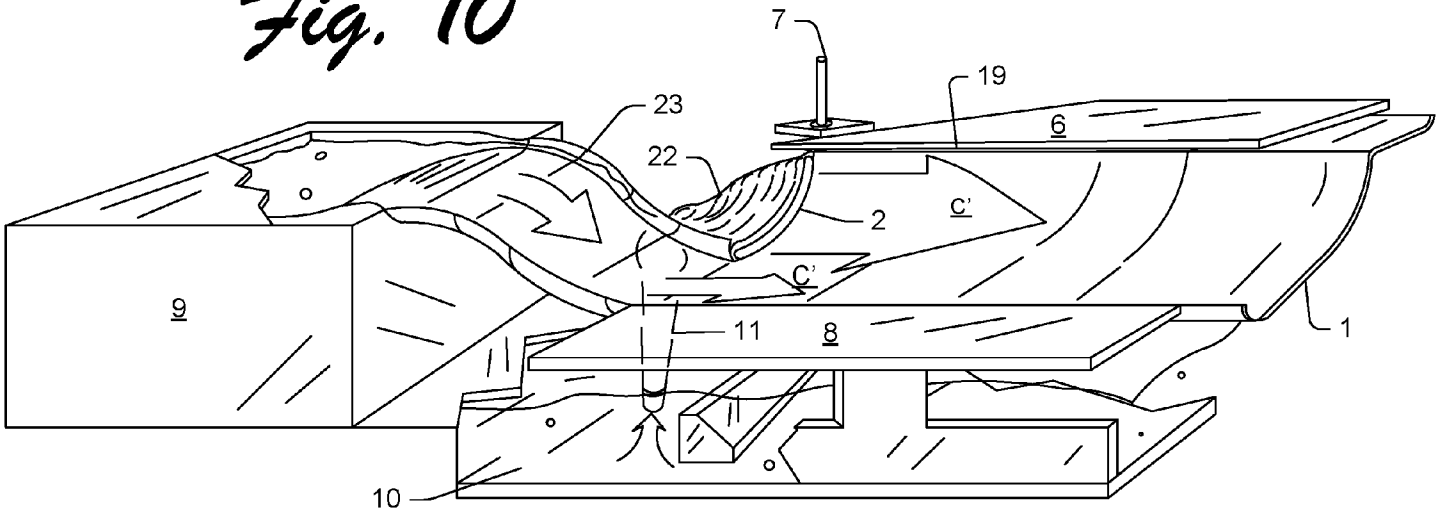
FIG. 10 shows a variation of the example shown in FIG. 9.

FIG. 9 depicts an alternative example of the wave simulator. The top of a reservoir 9 may be opened and a gravity feed flume 23 may be provided and affixed as shown, to provide a gravity fed river type flow in the area D' of the flume as shown. A subcritical flow C' may be provided as shown. This gives a different type of surf simulation. A shaped foil or aero foil 25 may be provided as shown to make a standing wave for riding thereon. Alternatively, as shown in FIG. 10, a separate pumping system comprising a shaped duct system 22 and attached concave wave simulating vent 2, which are attached to a pump 11 that receives a water supply from a reservoir 10, pumps a mostly supercritical flow E' onto the ramp 1. A subcritical or supercritical flow of water may be provided in the area D' of flume, that is, the horizontal bottom turn zone of the flume. This example of the wave simulator may also provide an alternative and enjoyable down-the-line surfing simulation experience.

Figure 11:
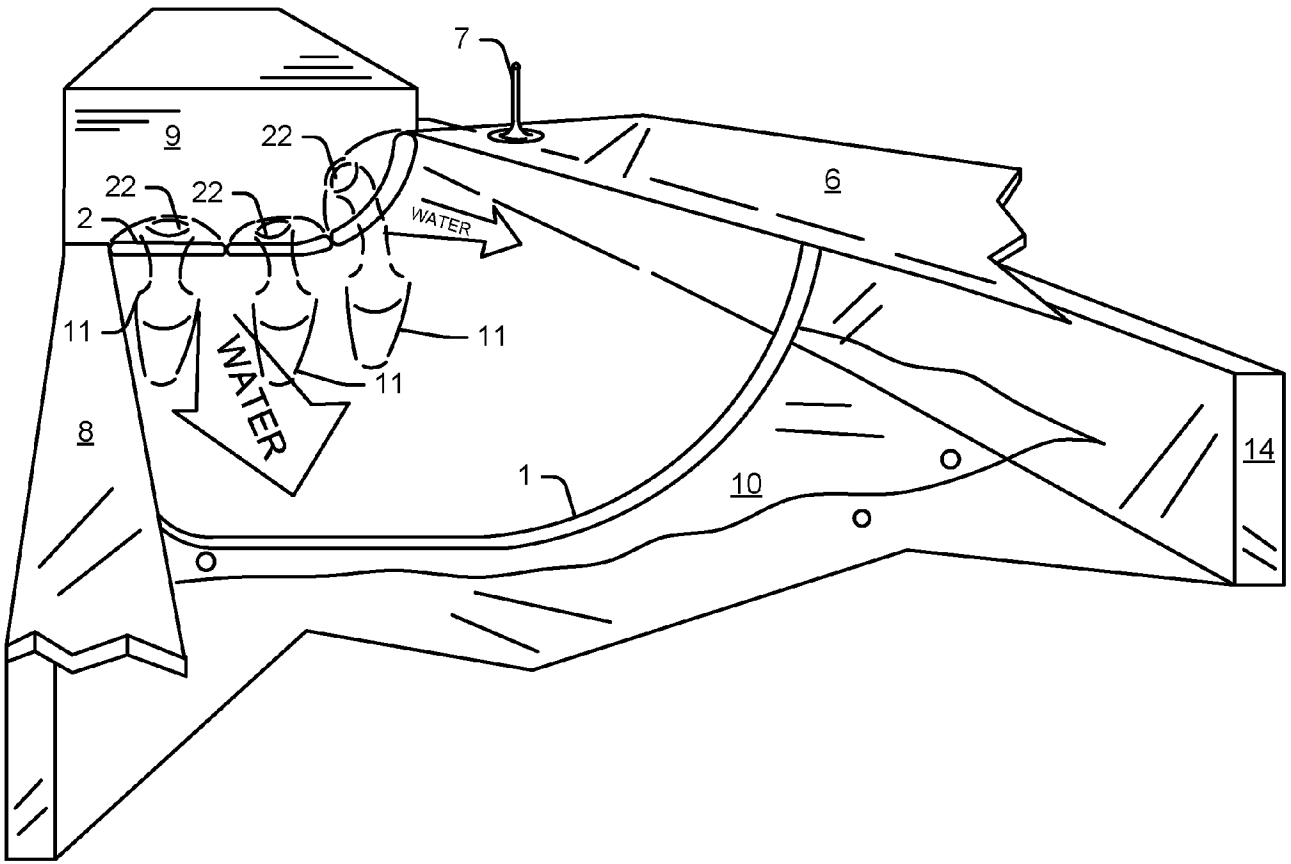
FIG. 11 shows a side perspective partial cutaway view of a multi pump and vent example of the wave simulator.
Figure 21A:
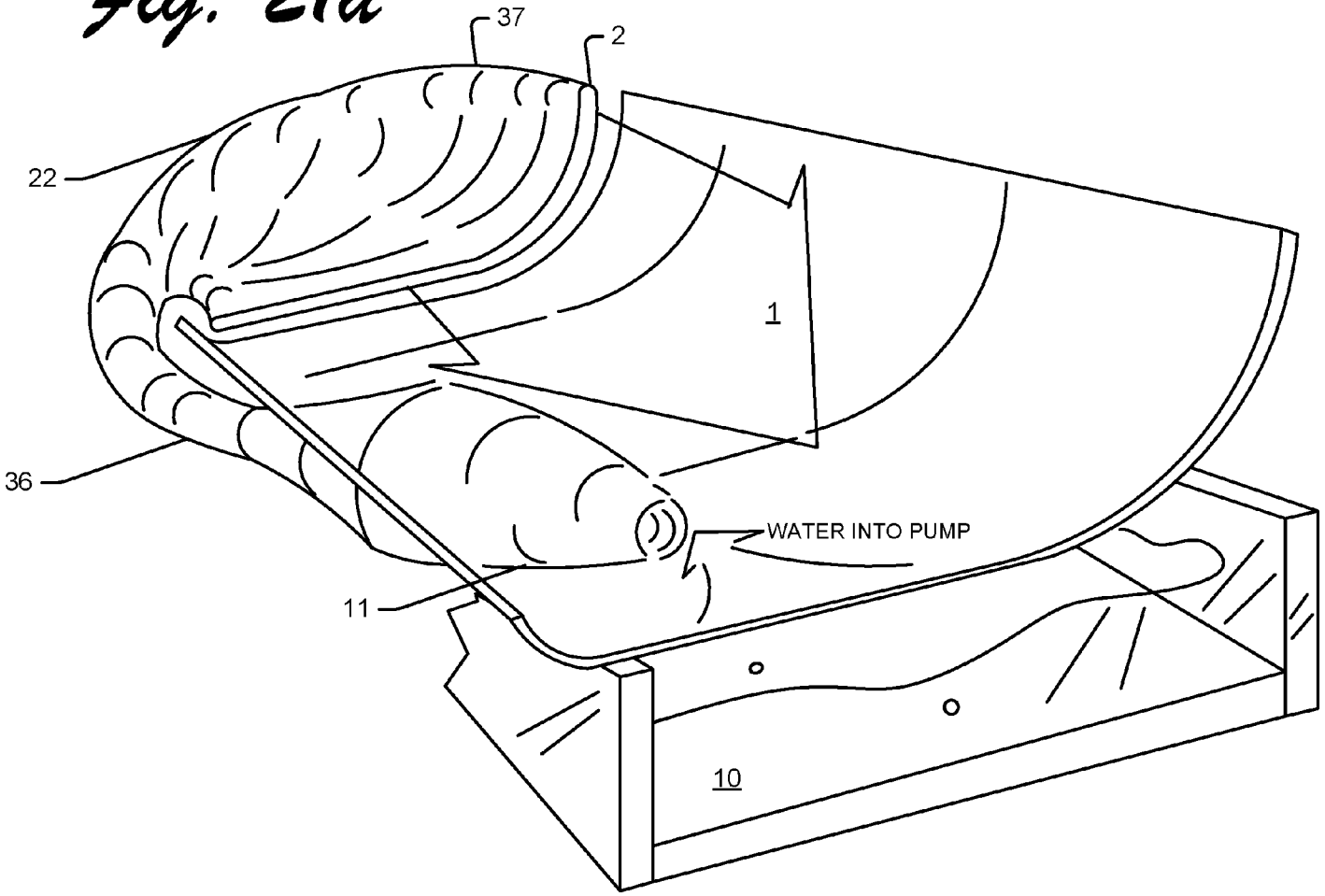
FIGS. 21*a* and 21*b* show a side ghosted perspective view and perspective view, respectively, of a ducting and vent system as utilized in some examples of the wave simulator.
Figure 21B:
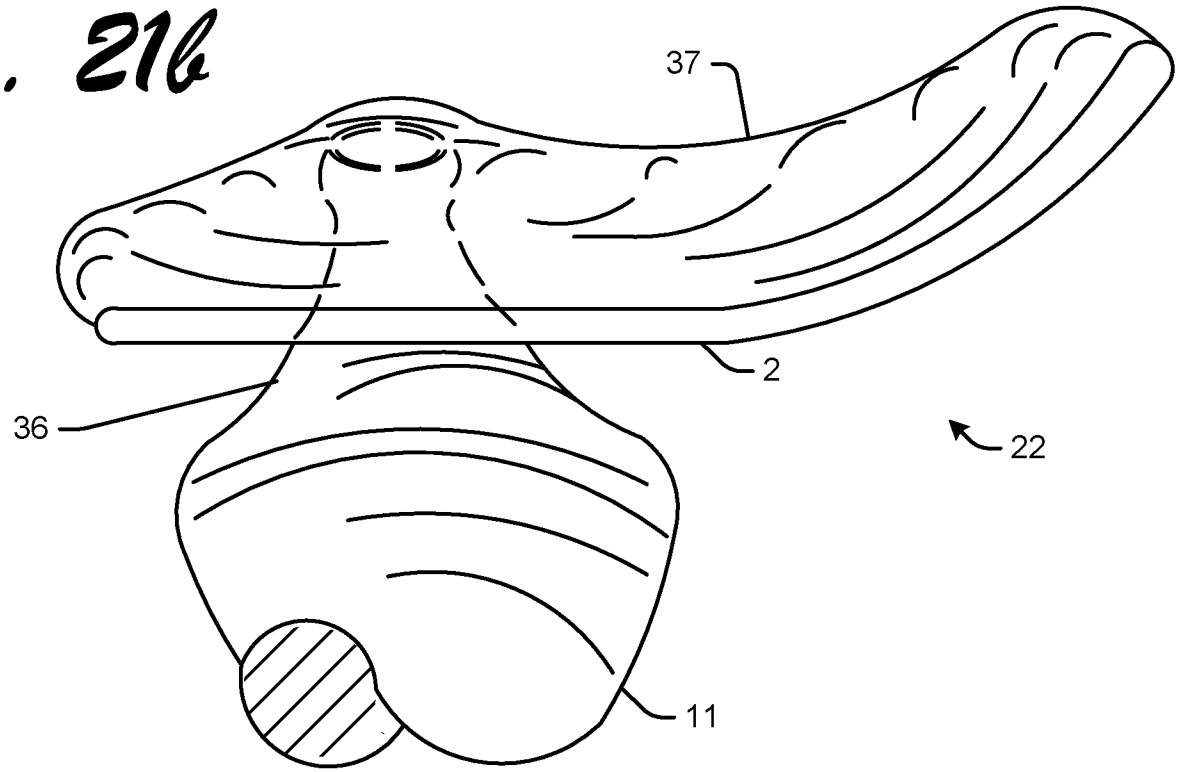

As shown in FIG. 11, pumps 11 may be directly connected to curved vents 2 via duct systems 22. The pumps may have individual controls, so that an operator of the wave simulator can vary the flow rates across various portions of the ride surface, even while a rider is on the simulated down-the-line wave. In this manner an unpredictable and fun board riding experience is provided by the wave simulator. Of course, a one-pump system, in conjunction with a curvilinear duct system 22 and concave vent 2, may be utilized as well in this example, and may be well-suited for smaller versions of the wave simulator, for example, a down-the-line wave simulator for use in homes, fitness centers, family entertainment centers, and dry amusement parks and traveling fairs and circuses. A one-pump system is shown in FIGS. 21*a* and 21*b*.

Figure 12A:
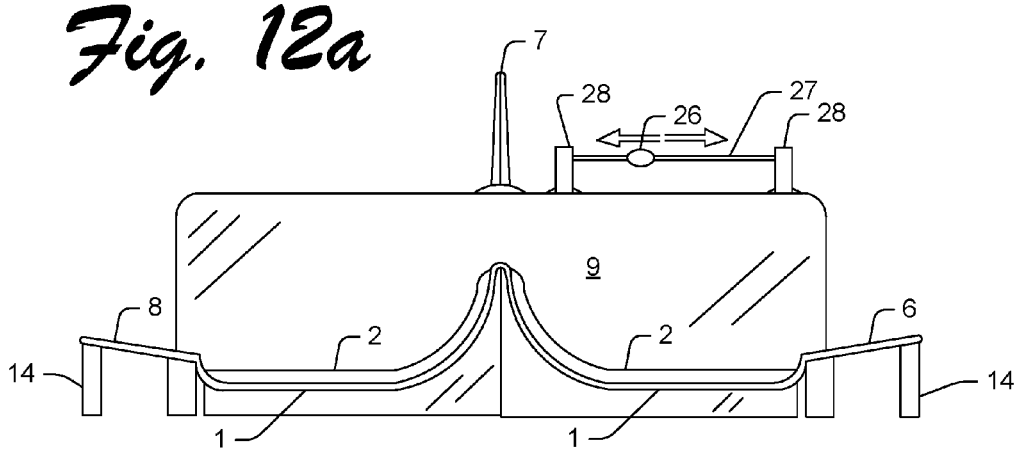
FIG. 12*a* shows a side cutaway view of a dual-sided version of a wave simulator according to the wave simulator.
Figure 12B:
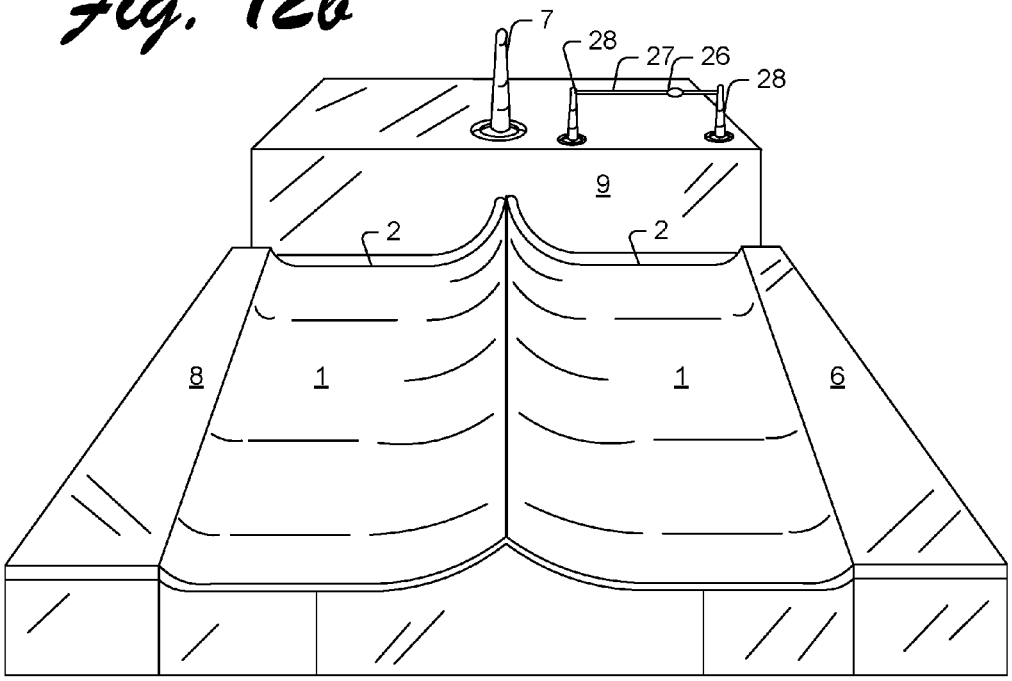
FIG. 12*b* is a top perspective cutaway view of the wave simulator as shown in FIG. 12*a*.

FIGS. 12*a* and 12*b* show another example of the wave simulator. A dual-sided ramp 1 is provided as shown, so that a rider may traverse from one down-the-line wave to another by riding or catching air over the uppermost portion of the ramp(s) 1. An aerial trick may be the means of transition for a rider from one flume to the other in this example of the wave simulator. Alternatively, there may be a divider (not shown) placed between the two flumes so that two riders may ride simultaneously, at the ride operator's discretion.

Also shown in FIG. 12*a* is a slider assembly for use in attaching the handle and rope line assembly 5 thereto. The slider assembly may be comprised of a slider 26 mounted to a slider wire 27 that is supported by vertical supports 28. A similar sliding support system may comprise a traveler mounted on a sliding channel (not shown).

Figure 13:
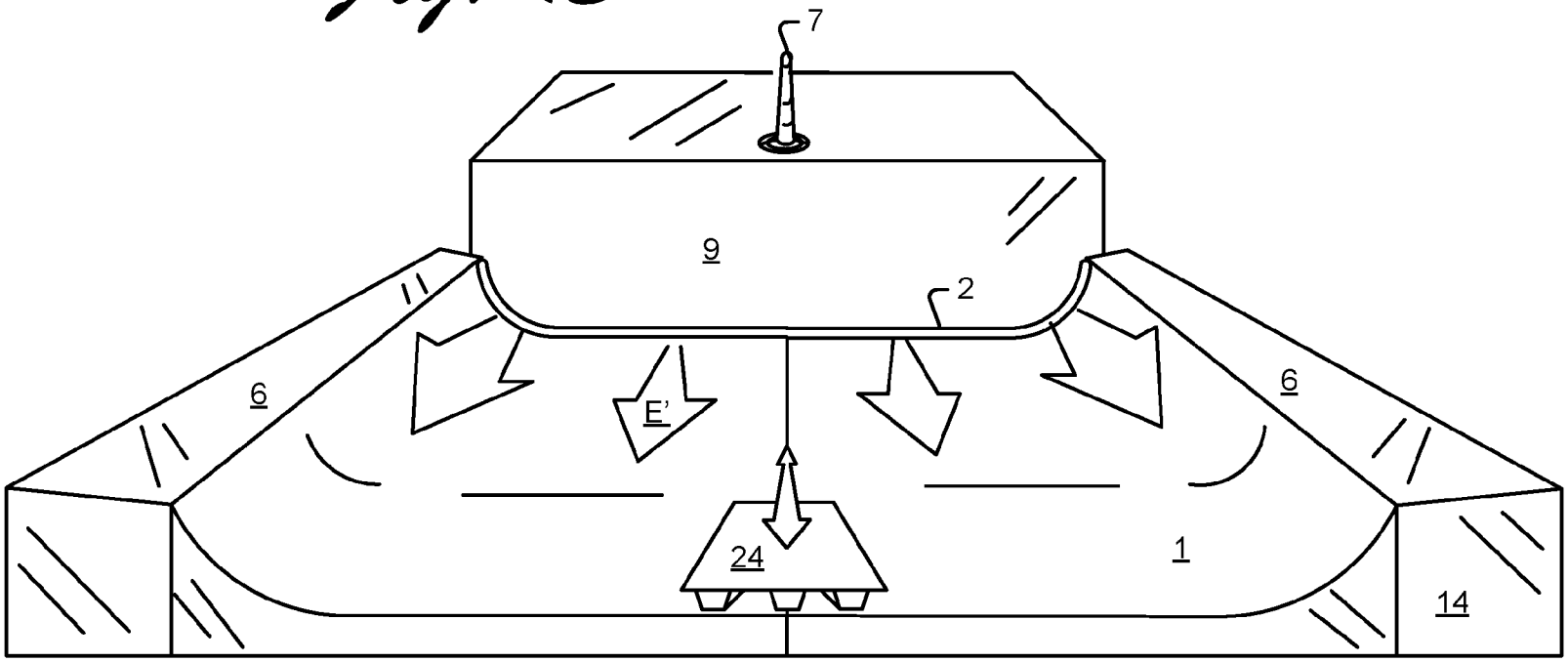
FIG. 13 shows a side perspective partial cutaway view half-pipe configuration of the wave simulator.

FIG. 13 shows a half-pipe configuration of the wave simulator. A supercritical flow may be desirable for this example of the wave simulator. Riders may drop into the half pipe flow via the upper decks 6, and go either back-and-forth from wall to wall or just ride one wall like a down-the-line wave. Alternatively, a walkway divider 24 may be placed centrally in this example of the wave simulator, to divide the simulator into two ridable down-the-line wave simulations. One wall of the half-pipe's flume may be made considerably lower than the other wall of the half-pipe for a different riding experience as desired. When looking from a grated area A' towards the vent 2, the right side of the half-pipe simulates a right-breaking wave, and the left side simulates a left-breaking wave.

Figure 14:
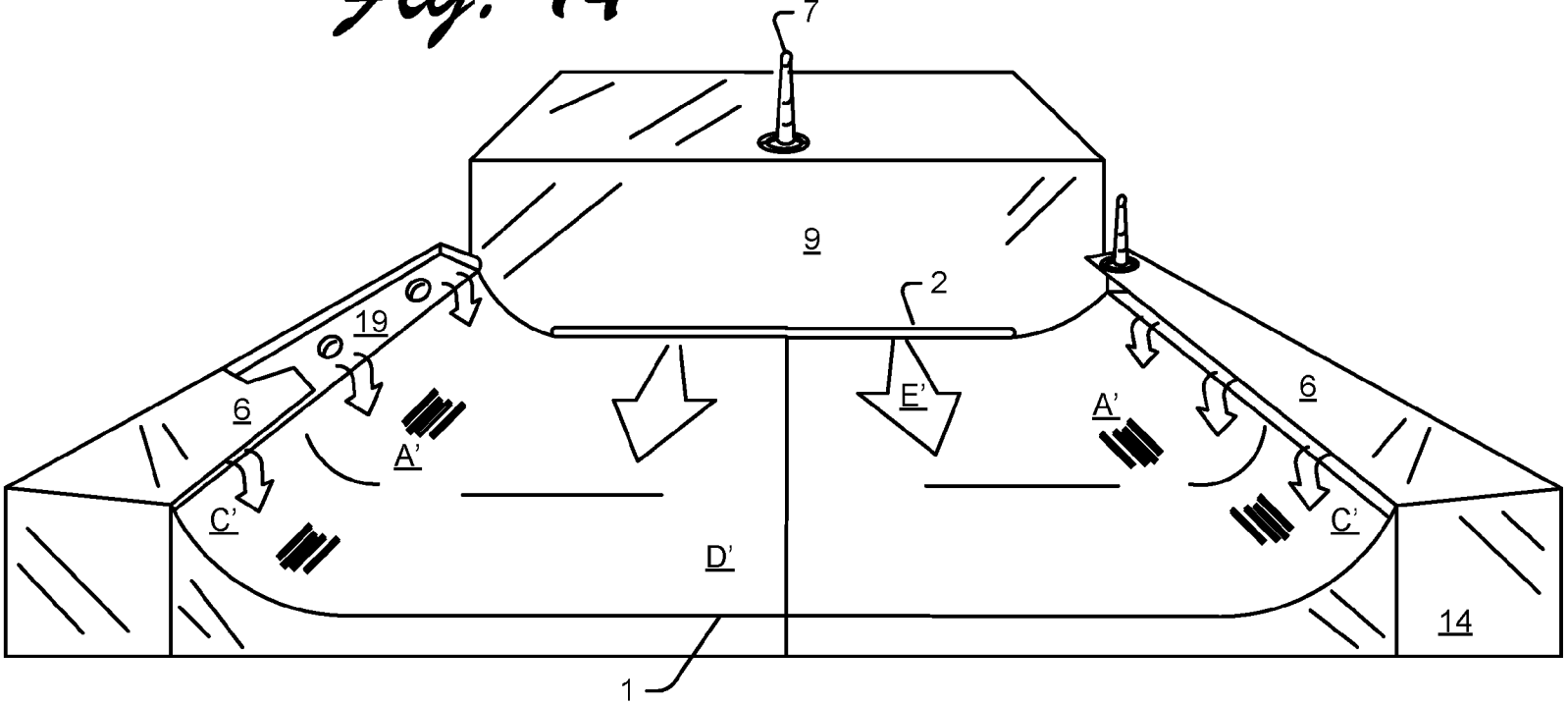
FIG. 14 shows a side perspective partial cutaway view of an alternative half-pipe configuration.

FIG. 14 shows an alternative half pipe configuration of the wave simulator. A subcritical flow of water C' is provided on the inclined walls of the flume(s) via a top flow-down secondary flume 19, and a supercritical flow of water is provided in the flat area D' of the half-pipe configuration. A rider may then turn at some speed in the flat area's flow and up the downward flow along the walls of flume. Alternatively, one of the walls of flume may utilize a combination of a pump 11, duct system 22 and concave vent 2 to supply a supercritical flow on either wall, and a walkway divider 24 may be deployed in the center of the half-pipe as desired. One wall of the half-pipe may be made considerably lower than the other for a different riding experience as desired. Grates or permeable membranes in areas A' may be used as shown and may be useful in removing low velocity water in the trough of the simulated wave. Water that has lost its velocity may be disadvantageous to the wave riding simulation of the wave simulator.

Figure 15:
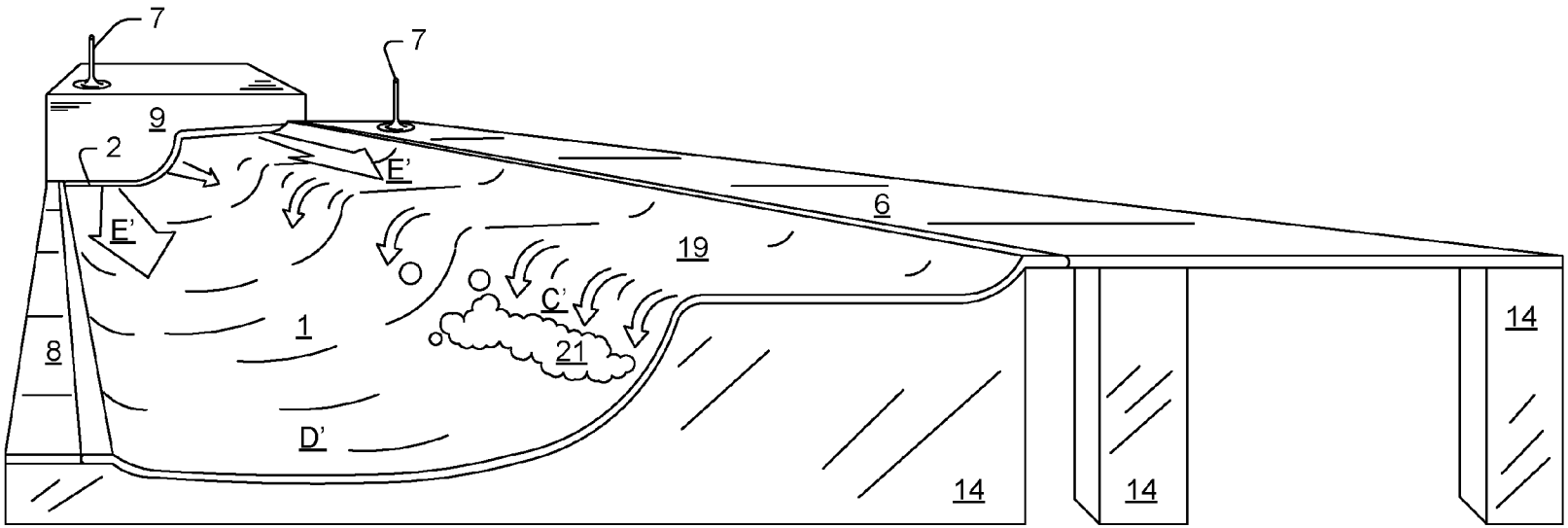
FIG. 15 shows a side perspective partial cutaway view of a flow means according to the wave simulator.
Figure 16:
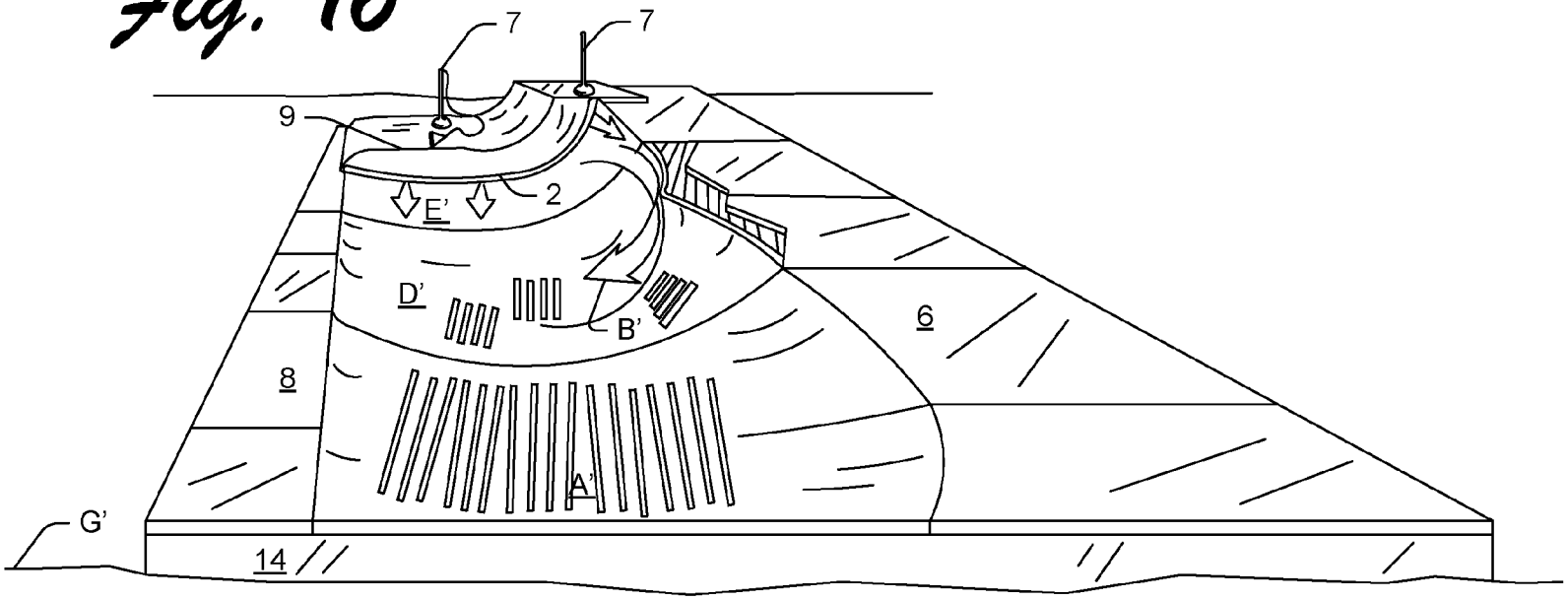

FIG. 15 shows an example of the wave simulator wherein a supercritical flow E' is provided along the upper secondary flume 19 as well as along the ramp 1 and in bottom turn area D'. This adds an interesting aspect to the wave simulator in that not only does the supercritical flow E' flow down the ramp 1 of the flume, but also in that a rider may go up and ride this flow in the horizontal area of secondary flume 19 as well. The supercritical flow E' in secondary flume 19 may slow to a subcritical flow C' and then flow into the supercritical flow in the flume. An interesting flow convergence water mass 21 can be simulated, that is good for a rider to bank a turn thereon. In this manner the water mass 21 is not unlike the pitching crest, or lip, of a breaking down-the-line ocean wave.

Figure 16:
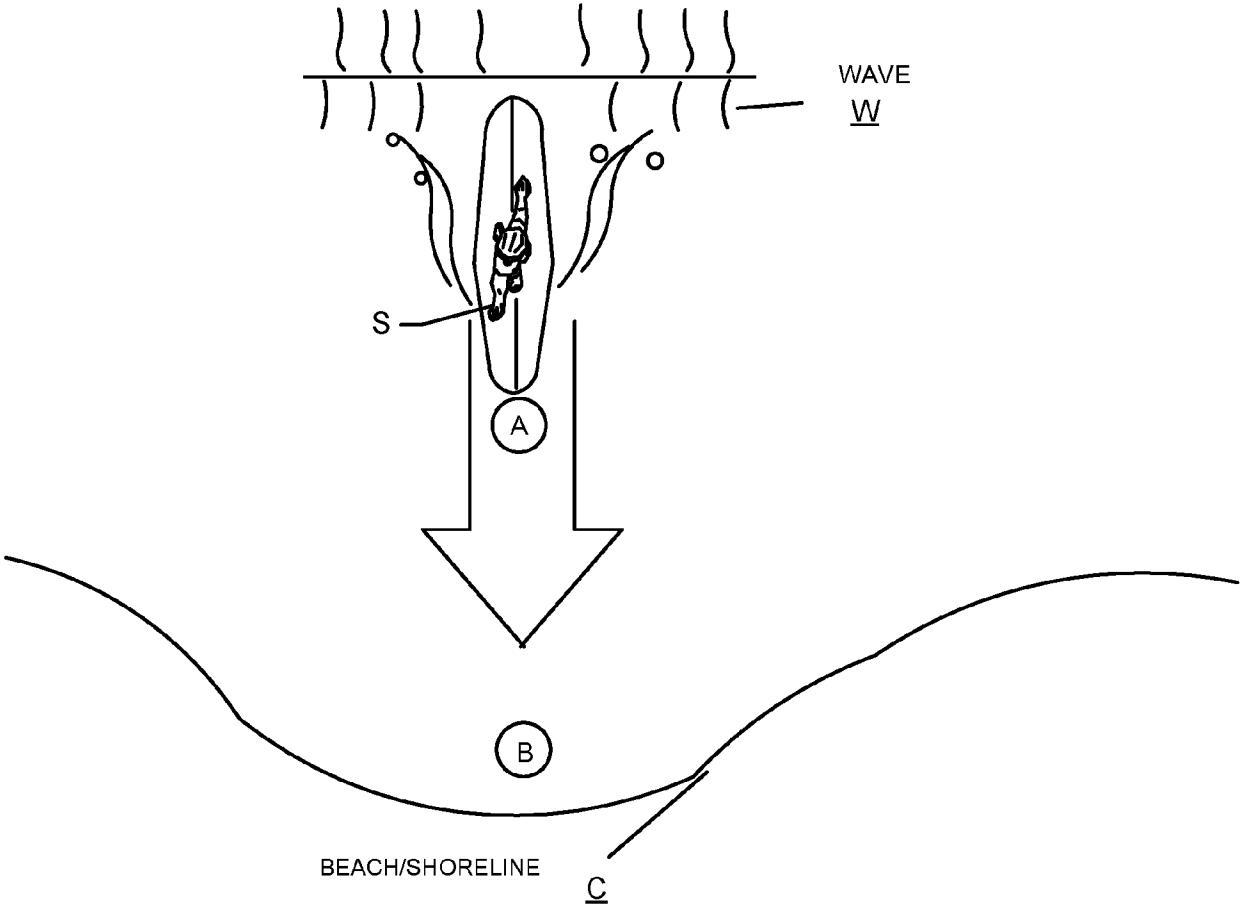
FIG. 16 shows a side perspective partial cutaway view of a molded version of the wave simulator.

FIG. 16 shows a version of the flume wherein the ridable inclined wall of the flume is molded in such a fashion to hook and curve towards a barrel wave forming conformation 16. The flume may be molded in this fashion or any fashion deemed to provide an enjoyable down-the-line surfing simulation according to the wave simulator.

Figure 17A:
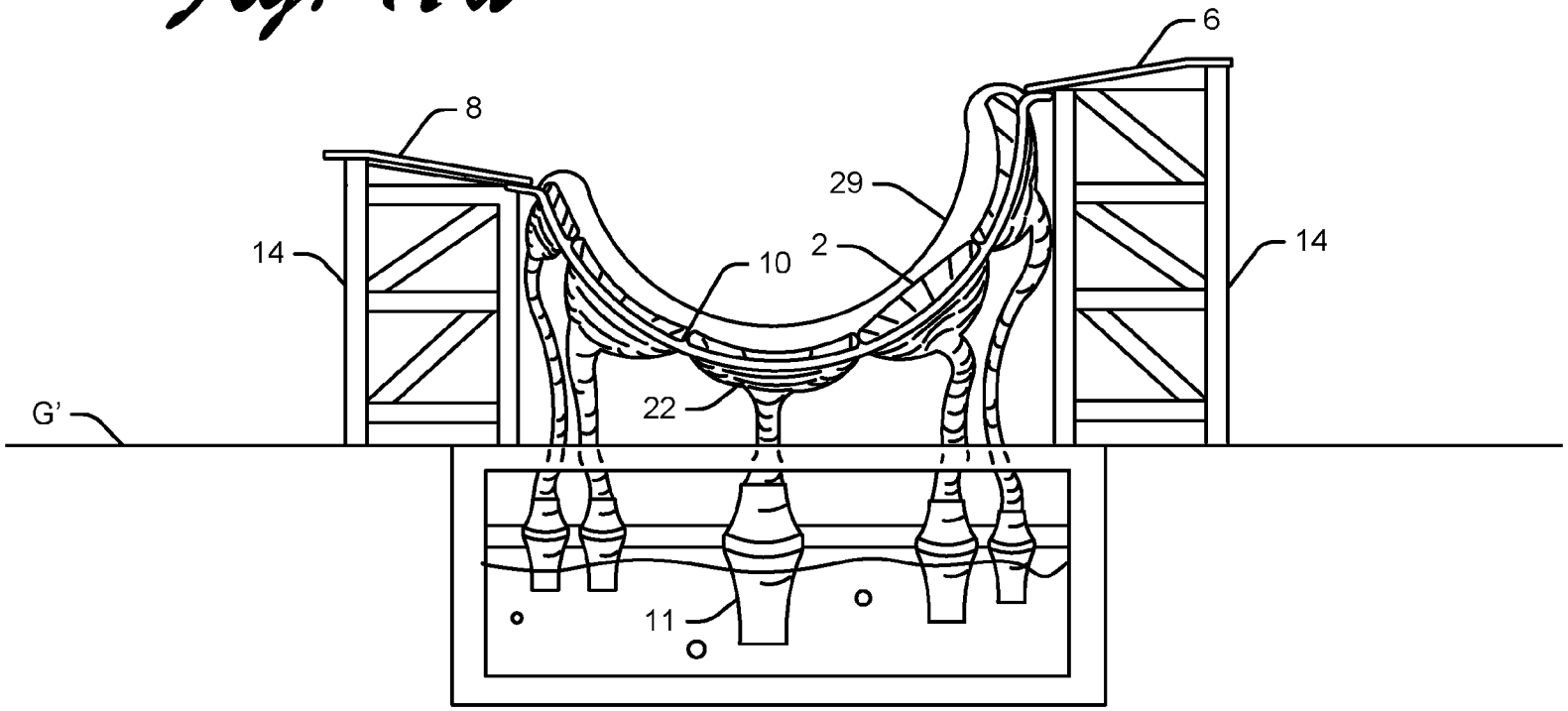
FIGS. 17*a* and 17*b* show in side cutaway views a partial pipe/arc section version of the wave simulator.
Figure 17B:
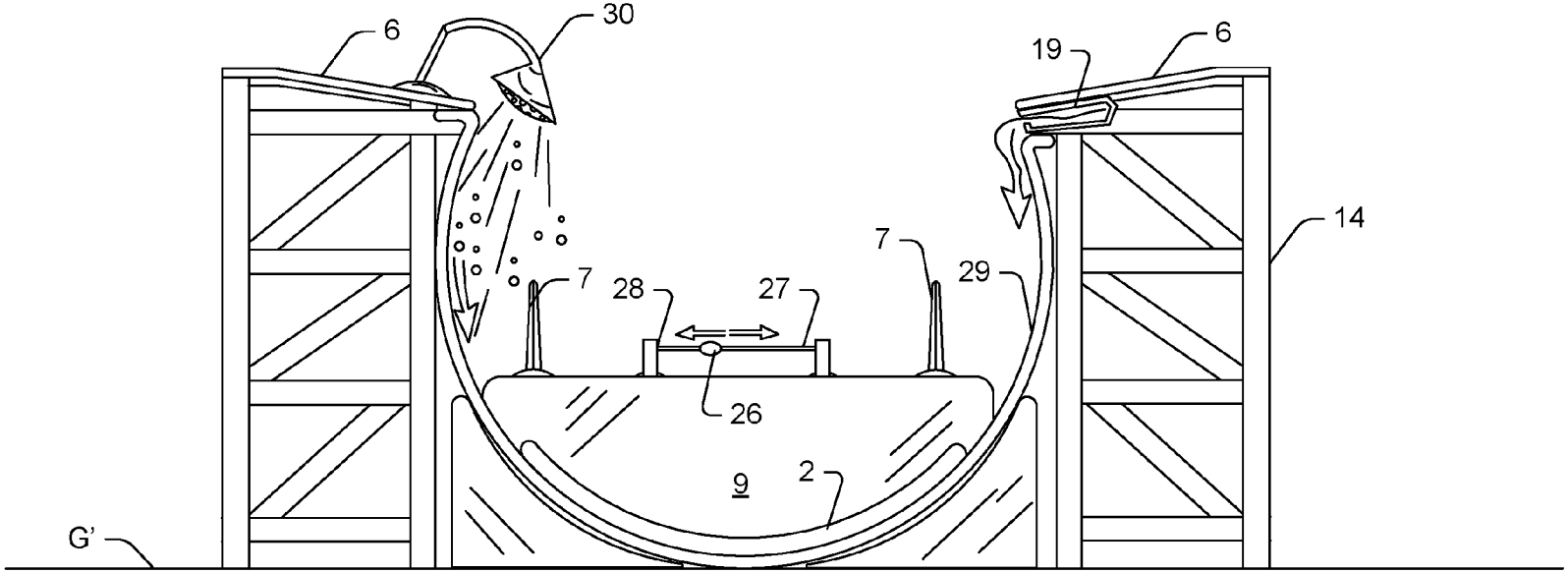

FIGS. 17*a* and 17*b* show another alternative flume. In this example of the wave simulator the flume is formed into to a partial pipe or tube 29. A full tube/pipe may also be used. A water spray nozzle 30 may be provided to supply water on the over-vertical parts of the tube 29. The heights of the walls of the tube 29 may vary widely, as shown. For example, both walls of the tube 29 may be over-vertical, as shown in FIG. 17*b*, or one wall may be lower than the other wall, as shown in FIG. 17*a*. Where an over-vertical tube section is used, an upper deck platform 6 may not be needed, depending on the ride operator's preference.

Figure 17C:
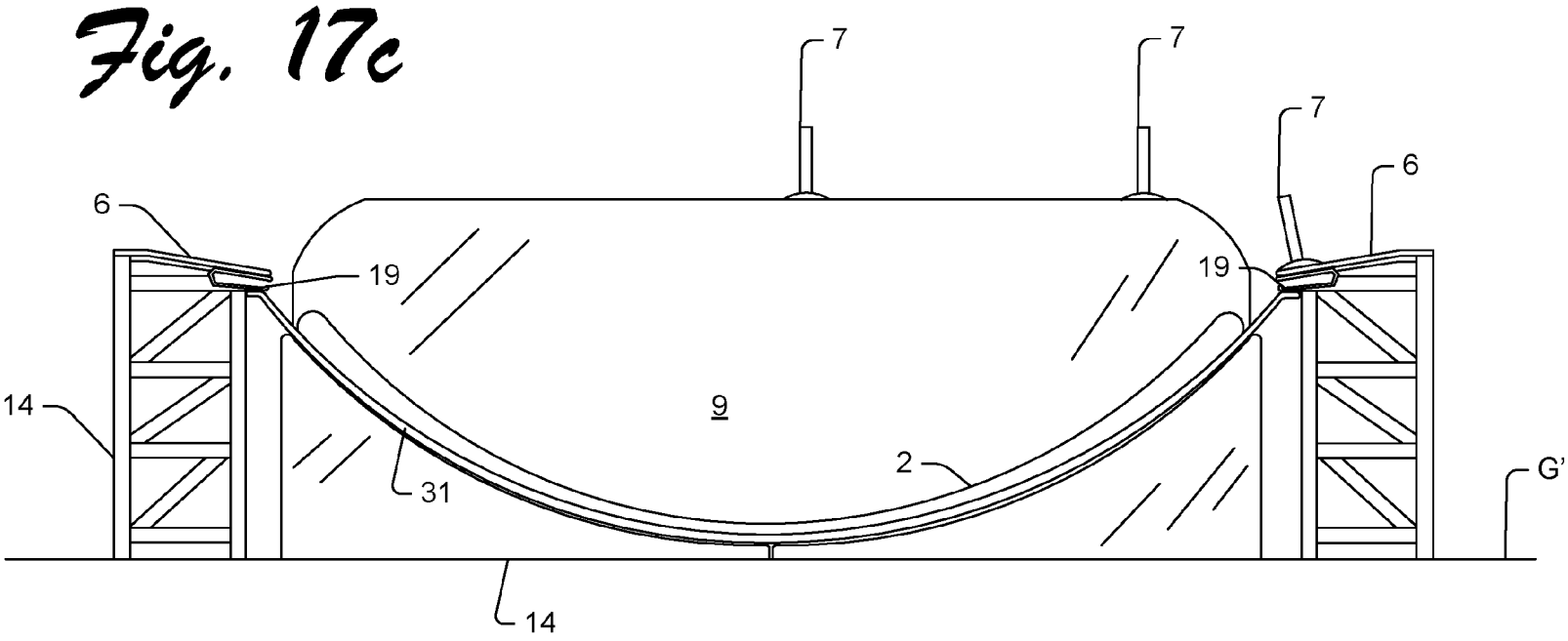
FIG. 17*c* shows in side cutaway view a parabolically shaped version of the wave simulator.

FIG. 17*c* shows a parabolically shaped flume 31 for use as the riding area of the wave simulator. This example may provide for a unique and enjoyable surf simulation according to the wave simulator.

Figure 18:
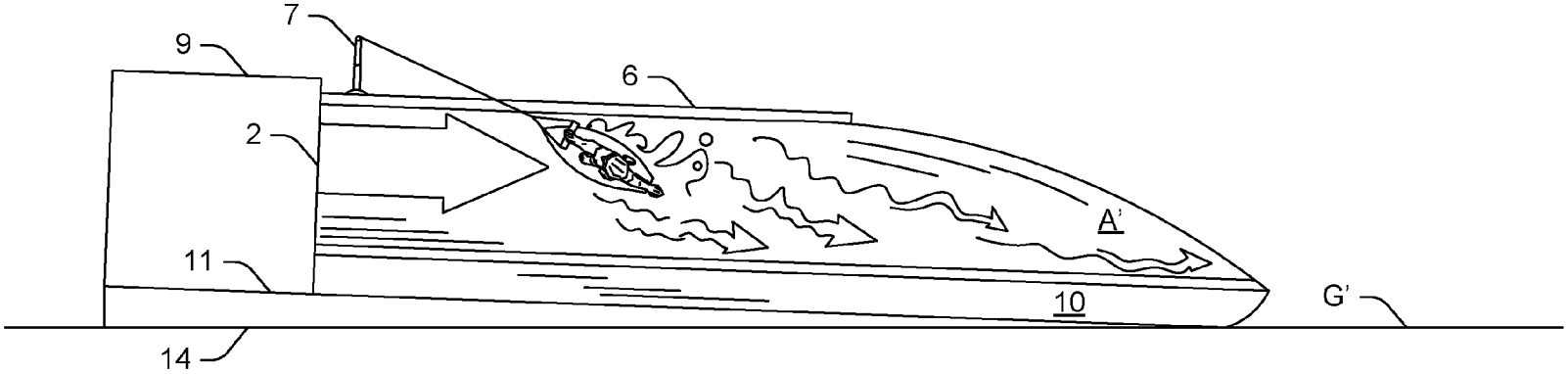
FIG. 18 shows an angled example of the wave simulator to improve flow characteristics of the wave simulator.

FIG. 18 shows an example wherein the attraction that is the wave simulator may be tilted at a desired angle relative to the horizontal. By angling the flume in this fashion the flow of water may be more readily cleared from the surf-riding area towards the exit area A'. The means of angling the wave simulator may be via adjustable means such as pedestals (not shown), jacks or a set-angle scaffolding 14 as shown.

Figure 19A:
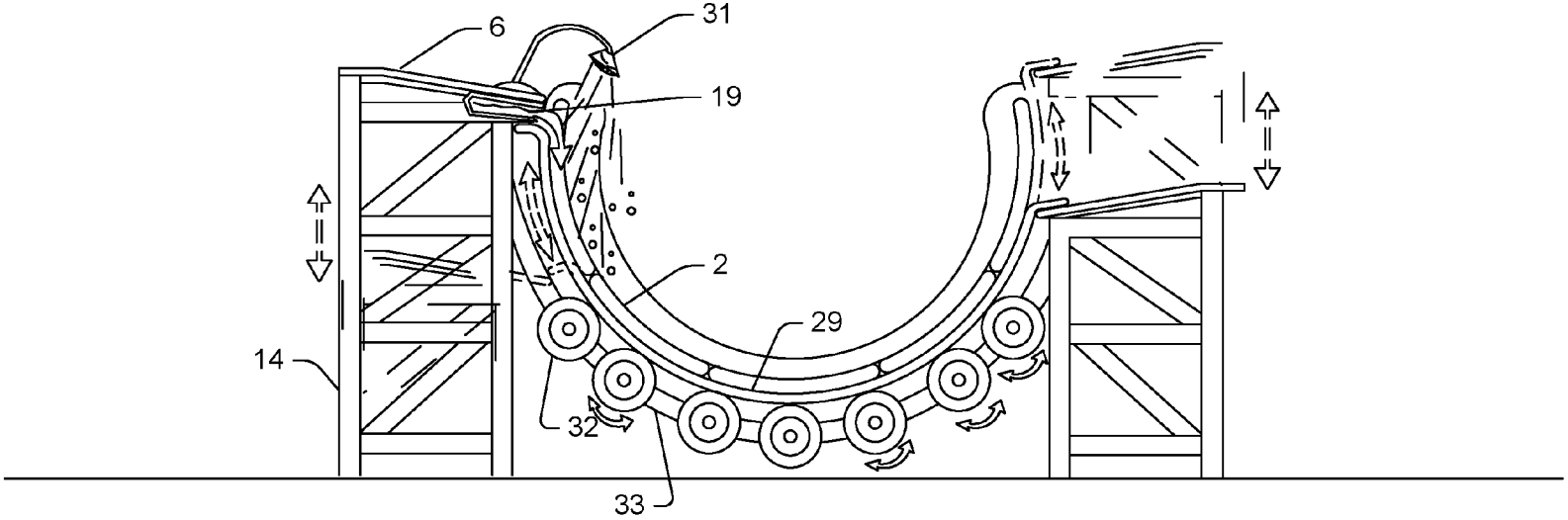
FIG. 19*a* shows in side cutaway an adjustable partial pipe/arc section version of the wave simulator.
Figure 19B:
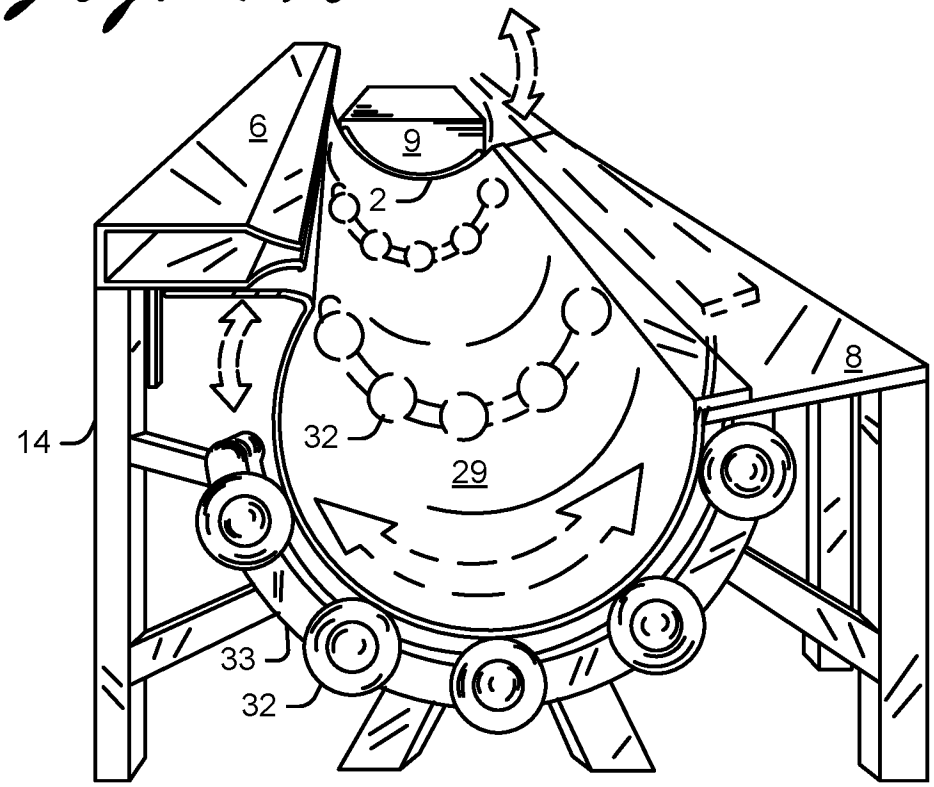
FIG. 19*b* shows a side perspective partial cutaway view of FIG. 19*a*.

FIGS. 19*a* and 19*b* show an example of the wave simulator where a tube or pipe 29 (in the Figures a partial pipe is depicted) is mounted on roller wheels 32, which are in turn mounted on a frame 33, which is attached to a scaffolding/support structure 14. By utilizing telescopic or otherwise changeable members for a support structure 14, and by sliding the partial pipe 29 in this manner a "dual-wave" type of surfing simulator may be achieved. When the pipe is higher on the right-hand side (looking towards the vent 2 from the other end of the pipe) then the right side becomes the "wall" of the wave, and this simulates a right breaking wave, or "right hander". Therefore, the reverse setup, that is, the left side being higher than the right, then simulates a left-hander, or left-breaking wave. By using a pipe 29 on rollers in this fashion both types of waves can be successfully simulated in one single version of the wave simulator. The upper secondary flume 19 and spray nozzle 31 are only illustrative of the versatility of the many different ways to get a flow of water onto the inclined riding surfaces of the wave simulator.

Figure 20A:
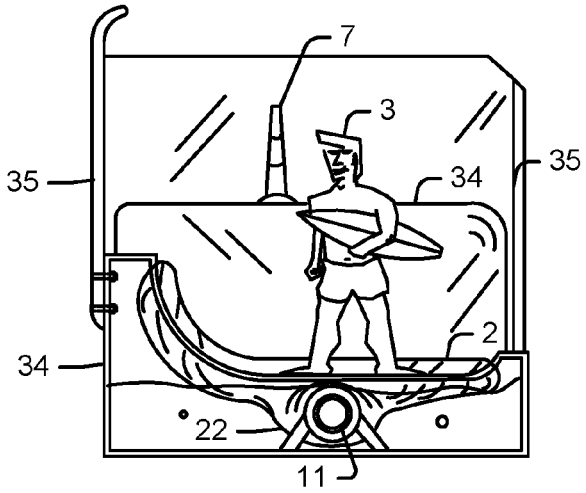
FIGS. 20*a* and 20*b* show a side partial cutaway and plan view, respectively, of a compact and portable version of the wave simulator.
Figure 20B:
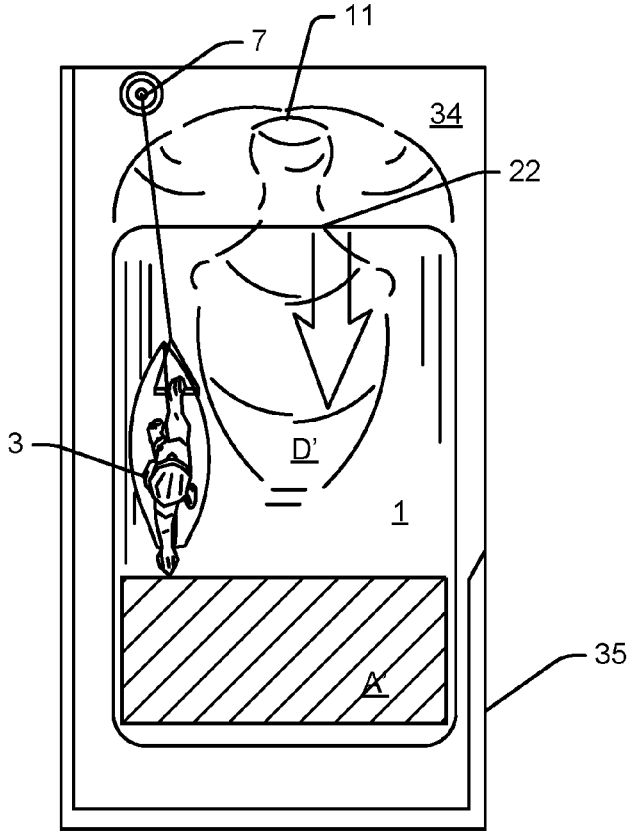

FIGS. 20*a* and 20*b* show a compact example of the wave simulator. A fiberglass or thermoplastic casing 34 is employed as shown to be the channel for water, the pump housing and also as the outer ride surfaces. Other materials may of course be used to manufacture a casing 34, such as stainless steel, for example. A casing 34 may be formed by many forms of plastic molding, including but not limited to rotomolding or injection molding. A submersible pump 11 is disposed within the water-containing cavity of casing 34 as shown, with a curvilinear duct system 22 connecting the pump with a vent 2 as shown. Clear plastic spray shields 35 may be employed to keep spray and overflow from the wave simulator from leaving the ride area of this example of the wave simulator. A smaller version of the wave simulator may be desirable for indoor versions and domestic models. The scale shown is only for example and the wave simulator may of course be made larger or smaller than shown depending upon the needs of the end-user of the wave simulator.

FIGS. 21*a* and 21*b* show an exemplary pump and curvilinear duct system of the wave simulator. A pump 11 is connected to a duct system 22, which itself is comprised of a round ducting 36 that itself is connected to a fan-shaped duct 37 that communicates the flow into the shape and depth of the desired wave simulation. As shown, multiple complex curvatures make up the ducting to morph the flow from the pump into the vent 2, which may be part of the duct 22 as shown here. The duct 22 is normally made of stainless steel, although other materials may of course be used. Although a one-duct/one-pump system is shown here, multiple pumps and ducts may be employed, as shown in FIG. 11.

Figure 22A:
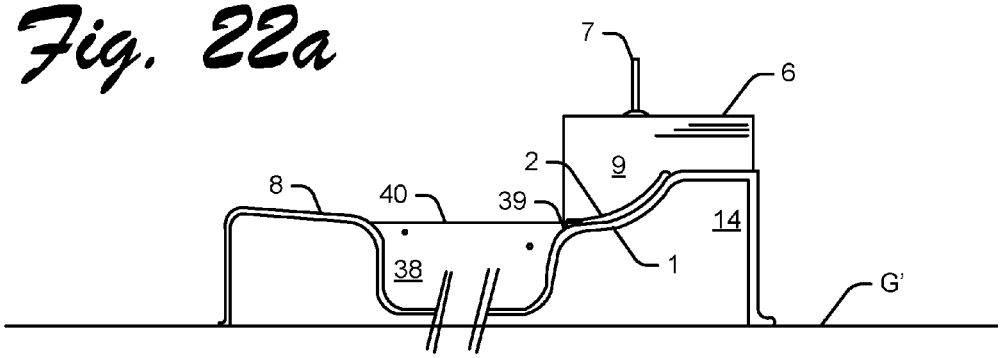
FIGS. 22*a* and 22*b* show in side-cutaway and plan view in partial cutaway, respectively, an example of the wave simulator that makes use of a deep pool for a realistic bottom turning trough for use by a rider of the wave simulator.
Figure 22B:
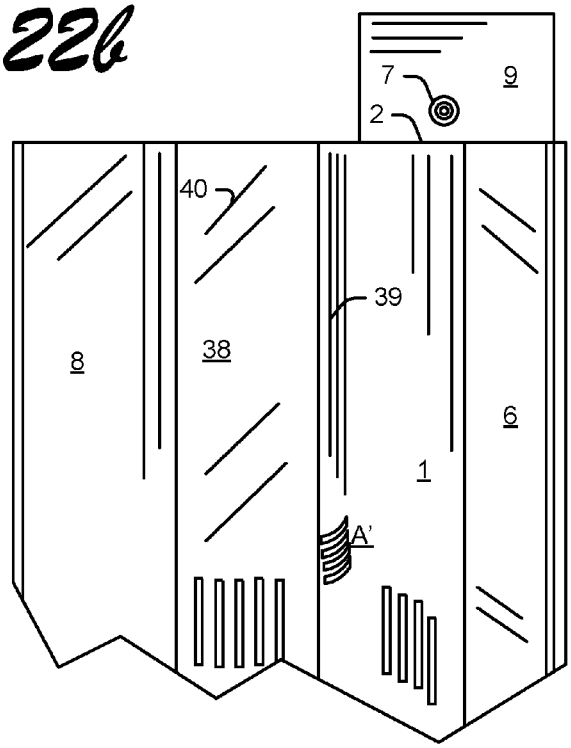

FIGS. 22*a* and 22*b* show another preferred example of the wave simulator. A pool 38 adjoins the flume at the edge of an area D'. A body of water 40 is disposed therein, and normally has a water level that may slightly overflow into area D' as shown. The aforementioned overflow may be from about 2 inches to about 10 inches of water. The section where the pool 38 adjoins area D' preferably has a rounded corner 39 as shown. The pool 38 may be used by a rider of the wave simulator to both exit the ride via a short swim to the platform 8, as a safety measure in case of a wipeout or failed ride, and also for extended bottom turns therein. A bottom turn in the pool 38 and re-entry to the water flow of the ramp 1 may give a more realistic wave-riding feeling, as the water in the trough of a real ocean wave is similarly still and unmoving, with the energy for a down-the-line surf ride normally being supplied by the wave's face as the wave moves forwards toward a shoreline. A pool 38 may be from about 3 feet deep to about 8 feet deep, and may be from about 3 feet to about 12 feet wide. A pool 38 is also normally from around 8 feet to about 20 feet long. A grate area A' may be disposed in either a downstream area of the ramp 1 and area D' as previously disclosed, or within the pool 38, or both, as shown in FIG. 22*b*. In one example, as shown in FIG. 22*b*, a grated area A' may be supplied near or on the rounded corner 39 to bleed turbulent and/or low velocity water at the juncture of area D' and the body of water 40.

As shown in FIG. 22*a* the platforms 8 and 6, ramp 1 (with its inherently attached area D'), a pool 38, and a support structure 14 may all be molded into one conformation as shown, for example, they may be molded out of fiberglass. In fact, the wave simulator may be molded in easily transportable sections that normally possess flanged ends so that the device can be assembled at a purchaser's preferred location.

All of the examples of the wave simulator are capable of achieving the core goal of the wave simulator, that is, a fun and exciting down-the-line wave riding simulation. As previously mentioned, many board sports have sprung up from the core board sport of surfing, and many of these new board sports use tow handles or handled apparatus to operate. Even though a tow handle is used with the wave simulator, most riders may enjoy the wave simulator, including non-handled board riders such as surfers, skateboarders and snow boarders. The stunts and tricks of most all board sports, including but not limited to skateboarding, snowboarding, wakeboarding, surfing, bodyboarding, windsurfing, and kite surfing, can be adapted to the wave simulator.

As thick and fast-moving a flow of water in the bottom turn area D" as is economically feasible is desirable, because if someone wipes out at the top of a ramp 1 then they have a safer fall into this thicker flow. In some examples it is more desirable to have as wide an area D' as possible, as on a real wave a rider draws power for maneuvers on the wave from the trough of the wave, and thickness of flow and a supercritical flow is normally needed to simulate that action There is a tradeoff, however, in that all of these aspects of the wave simulator tend to require more investment and operating cost to construct and run (larger pumps, more fiberglass for the flume, etc.). Space also becomes an issue, for example, in indoor venues such as Family Entertainment Centers. In that case a smaller bottom turn area D' may be utilized, as well as in fitness centers and other indoor facilities where the wave simulator may be used. Such indoor/compact models (or domestic backyard models, for that matter) of the wave simulator may use a much smaller and shortened length flume than other venues, and the upper deck 6 and lower deck 8 may be reduced as well, as shown in FIGS. 20*a* and 20*b*.

Examples of the wave simulator may allow complete novices as well as experienced board riders to quickly learn and enjoy a down the line simulated surfing experience.

As is normal for many of the board sports that enjoy riding waves, such as windsurfing and kite boarding, a rider may use a combination of a harness and harness lines attached to the tow handle 5, but a breakaway or pivotable harness hook may be used for safety reasons.

Any of the examples of the wave simulator may use transparent components or materials, for example, a transparent flume, so that spectators may view riders from as many angles as possible.

Any type of board may be used on the wave simulator as long as such board is capable of riding the wave-shaped flow of water, and the boards may or may not be provided with footstraps as desired. Fins may be used on the bottoms of the boards for stabilization of same in the water flow, or finless boards may be used, at the discretion of the rider.

Surfaces of the wave simulator may have curved or straight pipes or tubing, either alone or in parallel with other pipes or tubing, disposed on the substantially dry areas of the decks or the reservoir so that the rider may slide thereupon on the board. These are similar to sliders as used in wakeboarding, snowboarding, and skateboarding.

The examples shown and described herein are provided to illustrate various implementations, and are not intended to be limiting in any manner. Still other implementations are also contemplated, as will be readily appreciated by those having ordinary skill in the art upon becoming familiar with the teachings herein.

Figure 23:
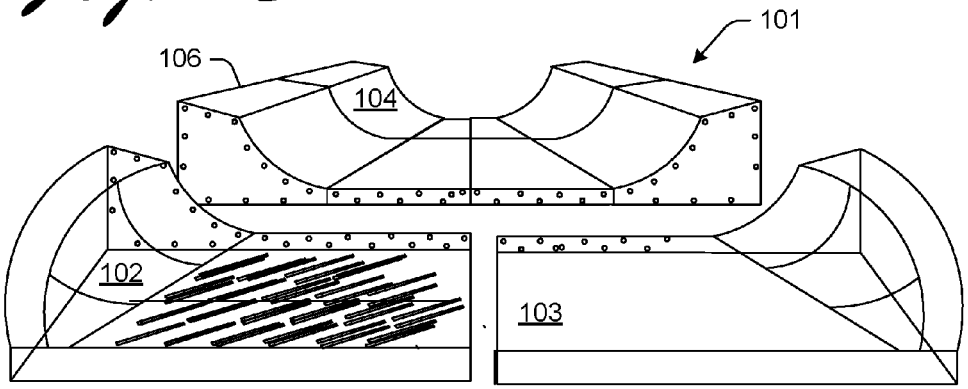
FIG. 23 is a partially ghosted perspective view of a modular down-the-line wave simulating half-pipe flume assembly according to the wave simulator.

Still other examples are contemplated. As shown in FIG. 23, a modular flume structure 101 is bolted together as shown. In the example shown in FIG. 23, a half-pipe shaped flume 101 is shown. End tapered pieces 102, and grated areas 103, are supplied and the very end of the flume 101. In FIG. 23, the end pieces 102 and grated end areas 103 are ghosted and unbolted for ease of viewing. The grated area 103 allows spent water flow to recirculate back to the wave simulator's pumps, and the end taper pieces 102 allow for spectator and rider access to the wave simulator's upper decks 106 and also allow riders to exit the ride when they are finished. The flume 101 is normally comprised of many flanged fiberglass or thermoplastic modular members 104, as shown, which are engineered to be interchangeable and movable to make a variety of flume structures according to the wave simulator.

Figure 24A:
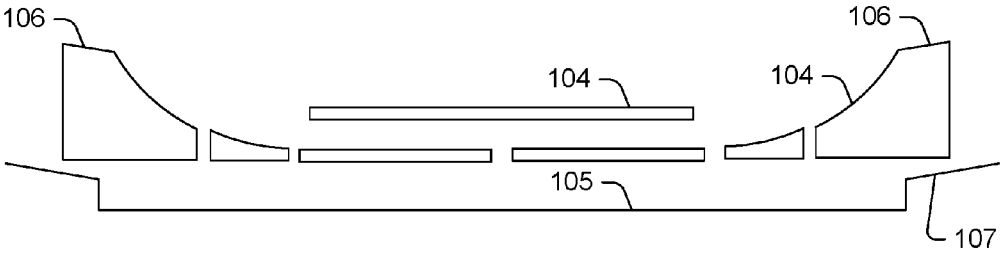
FIGS. 24*a* through 24*n* show profile views of exemplary combinations of modular down-the-line wave simulating flume members.

This example is shown in FIG. 24*a*, which shows different profiles for modular members 104 that can be fit in a plethora of combinations. Modularity of wave forming means is not unknown in the recreational wave-forming field, for example, U.S. Pat. No. 6,336,771 discloses modular and movable ramps and aerofoils to simulate a number of different standing waves for board riding.

As shown in the Figure, an open channel 105 may be provided, and the channel is normally constructed of any number of materials, but is most likely to be fabricated out of fiberglass or concrete. The outer decks 107 of the channel 105 may be used by riders to enter the wave simulation or as spectator viewing platforms.

The concept of a wave simulation system comprising a standard channel 105 in which modular wave simulation members 104 may be moved, repositioned and connected in multiple combinations is desirable, as a purchaser and end-user of the technology may then be able to make many different types of wave simulations. For example, in FIG. 24*b*, the modular ramp members 104 have been positioned into a wide half pipe configuration, which simulates both right- and left-breaking down-the-line waves at the same time, and riders may traverse from each type of down-the-line wave simulation as formed in the half-pipe shaped flume 101 as they desire. FIG. 24*c* shows a shorter half pipe configuration using modular ramp members 104. FIG. 24*d* shows a flume structure 101 that simulates a right-breaking down-the-line wave, or right-hander. Note how some of the rectangular modular members 104 have been stacked on the left side to make an entry/spectator deck 107.

Figure 24B:
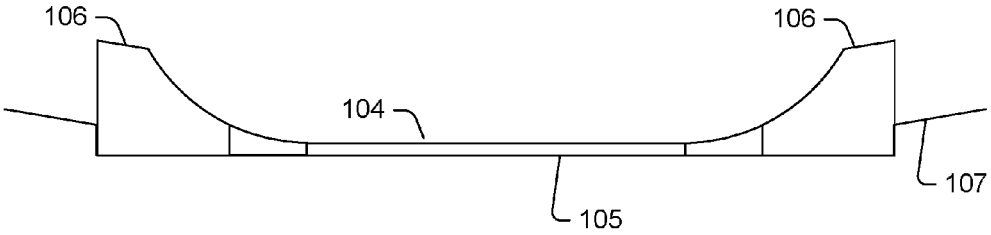
Figure 24C:
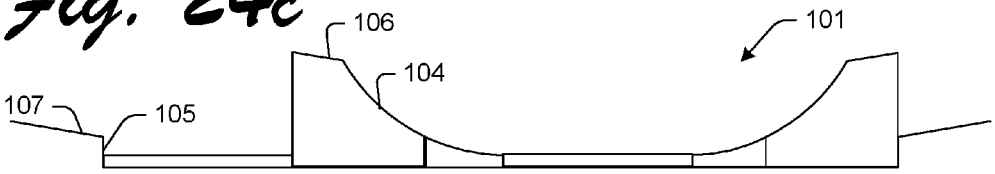
Figure 24D:
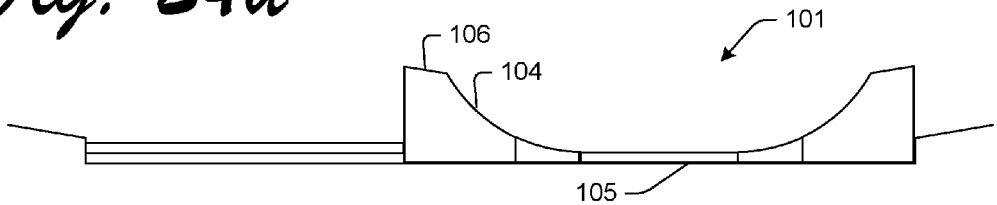
Figure 24E:
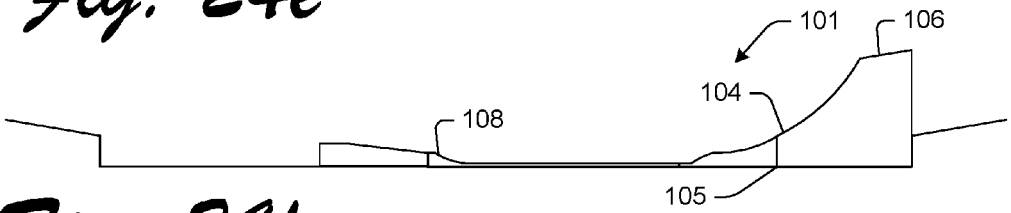
Figure 24F:
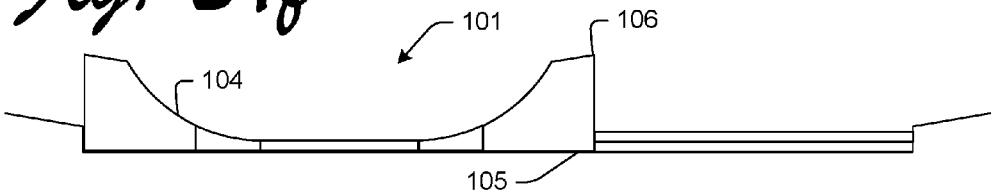

FIG. 24*e* shows a down-the-line right-hand wave simulation where a bottom turn pool 108 has been formed from shaped pool-forming members 104. FIG. 24*f* shows a down-the-line wave simulator structure similar to that in FIG. 24*d*, except the members 104 have been repositioned to, in this case, simulate a left-breaking down the line wave simulation.

Figure 24G:
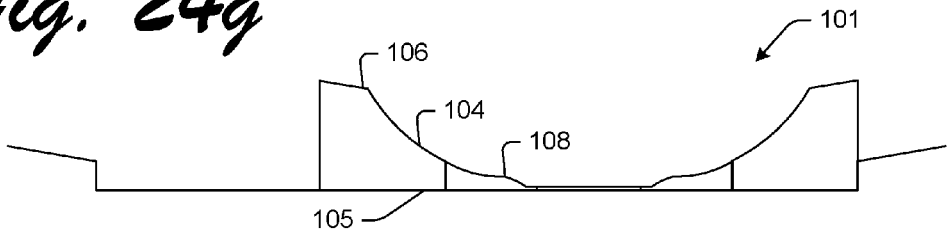

FIG. 24*g* shows a flume 101 that has been configured in a half pipe configuration with a deep bottom turn pool 108. A bottom turn pool 108 allows a rider to execute deeper and harder bottom turns, thus better simulating actual wave conditions in some examples of the wave simulator.

Figure 24H:
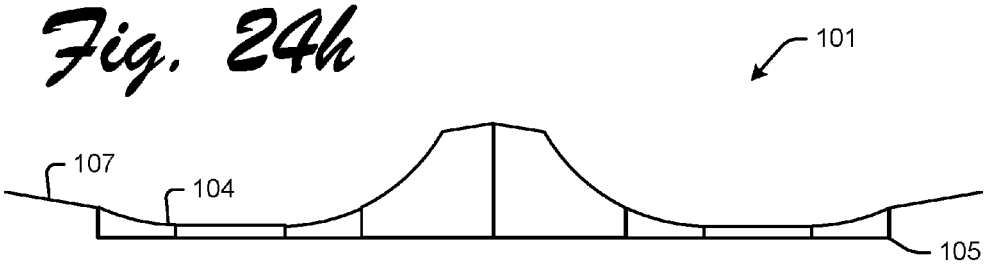
Figure 24I:
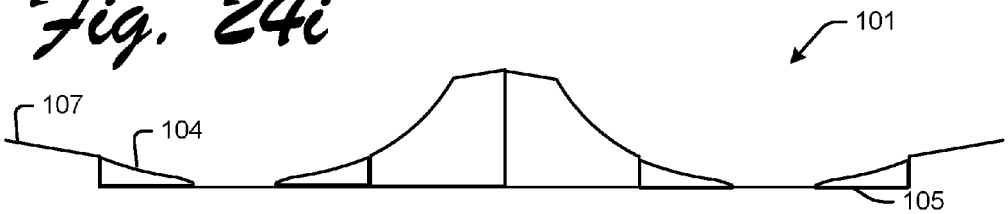
Figure 24J:
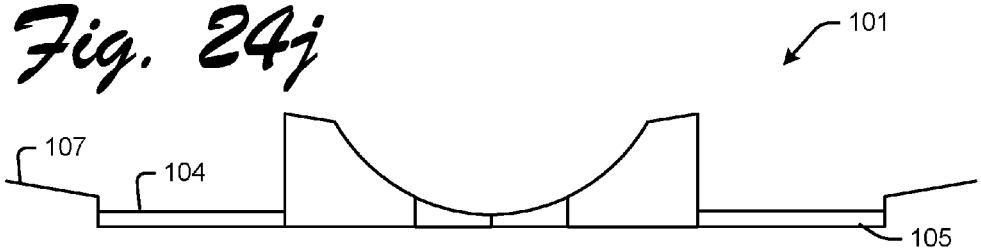
Figure 24K:
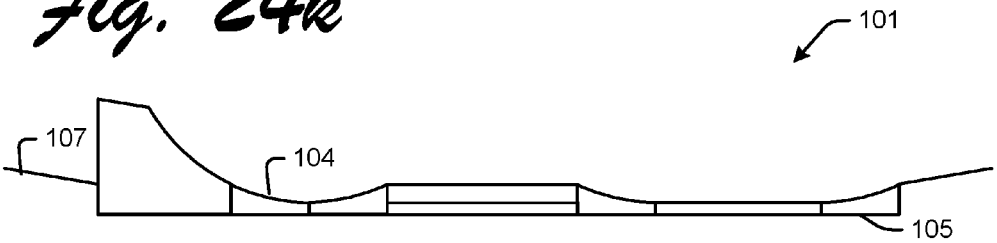
Figure 24L:
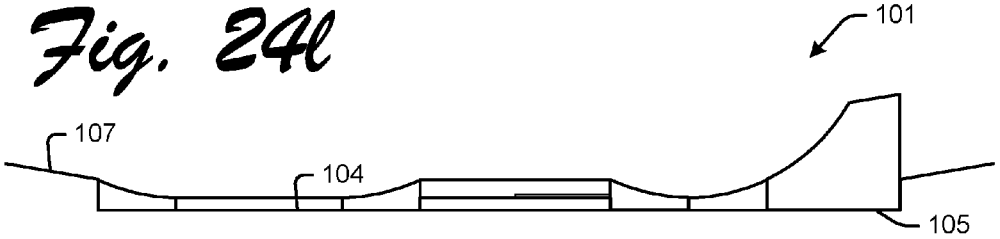

FIG. 24*h* shows a "spine ramp" configuration of the wave simulator, wherein a left-breaking and right-breaking wave simulation are disposed back to back. FIG. 24*i* shows another spine ramp configuration, but with deep bottom turn pools 108 having been formed in this example. FIG. 24*j* shows a constant-curvature half-pipe configuration of the wave simulator formed from the modular members 104. FIG. 24*k* shows a dual-use flume 101 comprised from the positioned modular members 104: a left-breaking down-the-line wave simulation on the left side of the channel 105 and a small training half-pipe on the right side of the flume structure 101 in a channel 105. FIG. 24*l* depicts a similar configuration to that of FIG. 24*k*, but in this case a right-hander down the line wave is simulated on the right side of the flume structure 101 in a channel 105.

Figure 24M:
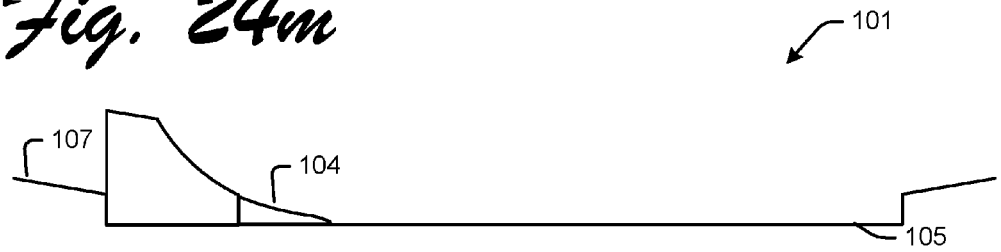
Figure 24N:
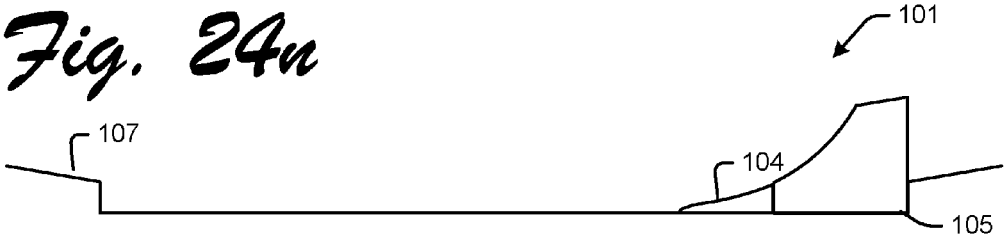

FIGS. 24*m* and 24*n* show left-hand and right-hand down-the-line wave simulators, respectively, wherein a combination of modular members 104 is placed in the channel 105 as shown. The channel 105 itself then becomes the bottom turn area for a rider. By placing opposite configurations of members 104 in the channel 105 at the same time a half pipe can also be formed using the channel as the middle of the half-pipe. By utilizing the channel in this manner the components of the wave simulator may be marketed as a retrofit kit to existing wave simulator channels already installed throughout the world today.

Of course, a channel 105 may not be necessary in examples of the wave simulator wherein the flume 101 is a standalone platform, with its own add-on components to achieve modularity of wave simulation, or in cases where a non-modular version of the wave simulator is constructed instead.

The flume 101 may be both a flume for containing a flow of water and also a wave-simulating ramp as well, in that the flow of water along the inclined part of the flume is ridden by a rider turning at some velocity in the substantially horizontal water flow provided in the bottom part of the flume 101 and then using that velocity to turn up and ride onto the inclined flow of water on the inclined wall of a flume 101, and then ride back into the horizontal area of the flume. The rider is positioned such that this wave riding action simulates that of a surf rider on a down-the-line type peeling ocean wave.

As may be readily apparent, many other combinations and configurations of a flume structure 101 can be fabricated from many differently shaped modular members 104. Differently shaped members 104 may be fabricated seasonally, so that a purchaser of a product made according to the wave simulator may be able to choose from a virtually endless variety of wave simulations that vary from year-to-year. Therefore, not only does the attraction never grow dull or unappealing to users of the product but manufacturing of units made according to the wave simulator may continue to not only new customers but also prior purchasers of the wave simulator.

Figure 25:
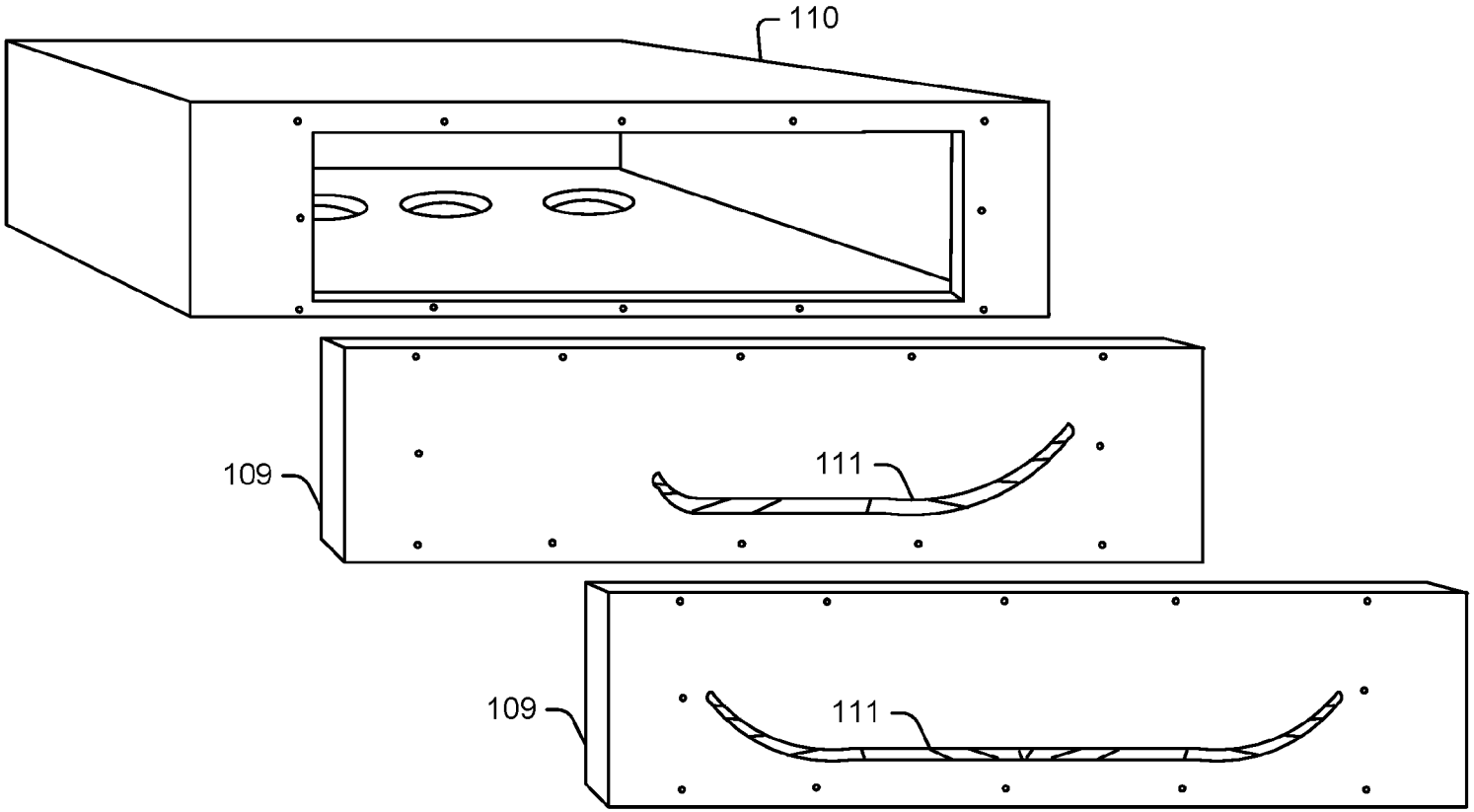
FIG. 25 is an exploded perspective view depicting vent plates for use in making the down-the-line wave simulating water flow for different types of modular ramp profiles according to the wave simulator.

To accommodate placing a wave-simulating fluid flow onto such an endless variety of combinations of flume structures 101 made from the modular members 104, many different vent plates 109 may be made available, as shown in FIG. 25. The vent plates 109 may have a specific vent shape 111 formed through the surface of the plate for a particular down-the-line wave simulating flume structure 101, for example, a right-hander wave or half-pipe, as shown in FIG. 25. A vent plate 109 may then be secured to the face of a reservoir 110 to place the desired wave-shaped flow onto the flume structure 101. The vent may, for example, be bolted to the surface of the reservoir 110. Other means may be used to secure the vent plate 9 to the face of the reservoir 110, for example, L-shaped channels (not shown) affixed on either end of the front of the reservoir 110 wherein the vent plate 109 is merely slid into place and locked via clamps or the like on the front of the reservoir 110. A rubber gasket may be affixed to the periphery of the face of a plate 109 where contacting the reservoir 110 so as to assure that no excess flow leaks from around the edges to simulate the wave-shaped flow on the ramp. The vent plate 109 may be made of many suitable materials, such as stainless steel, fiberglass or plastic. Ramps may have separate vent plates 109 with vent shapes 111 formed therethrough. When a ramp is positioned in a flume 105 adjacent a plate 109 the flow that emanates from the vent 111 is allowed to flow directly across the adjacent surface of flume 101.

The vent 111 itself may have shaped edges to produce as laminar, that is "glassy smooth", a wave simulating flow of water as is possible. Many different vent plates 109 may be provided that may have the same general profile, but vary in aspects such as thickness of vented water flow via a larger aperture, upper barrel-forming curvatures, or tubular wave-forming ability via variations in the vent plate shape. Larger aperture vent shapes 111 tend to simulate a slower but more laminar, that is, "smooth", wave flow, which tends to be better suited for actual finned surfboards, whereas smaller bore vents 111 tend to simulate faster and more turbulent water flows, which tend to be better for Skimboard- and kite board or wakeboard-type board riding.

A wave simulation flume structure 101 may be integrally attached to a vent plate 109, so that they are essentially one conformation. A vent plate 109 may be, for example, molded as part of a modular flume member 104, and the rest of the flume structure 101, comprised of other modular members 104, are then bolted thereto to complete the flume 101 structure.

Figure 26A:
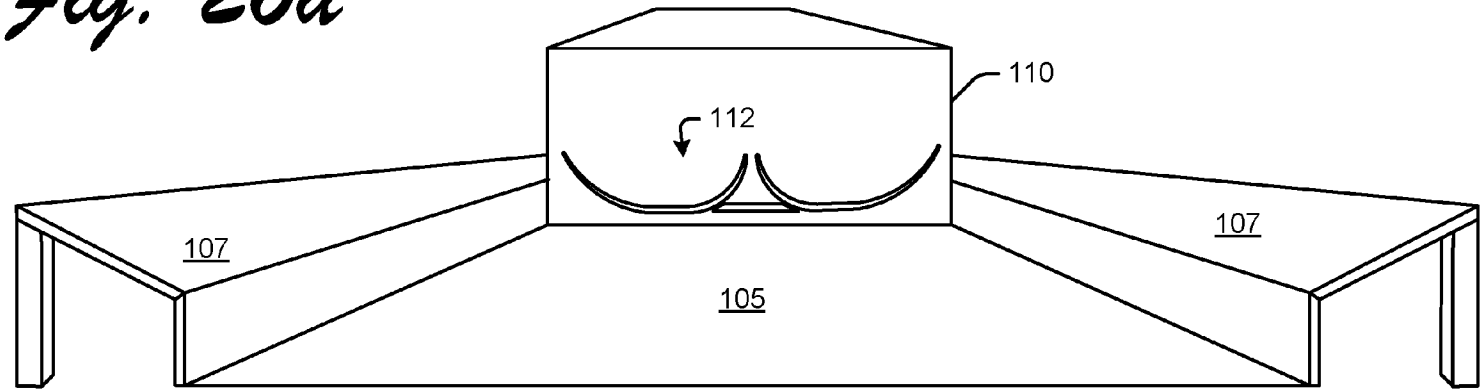
FIGS. 26*a* through 26*d* show perspective views in partial cutaway of a multi-aperture vent array according to the wave simulator.
Figure 26B:
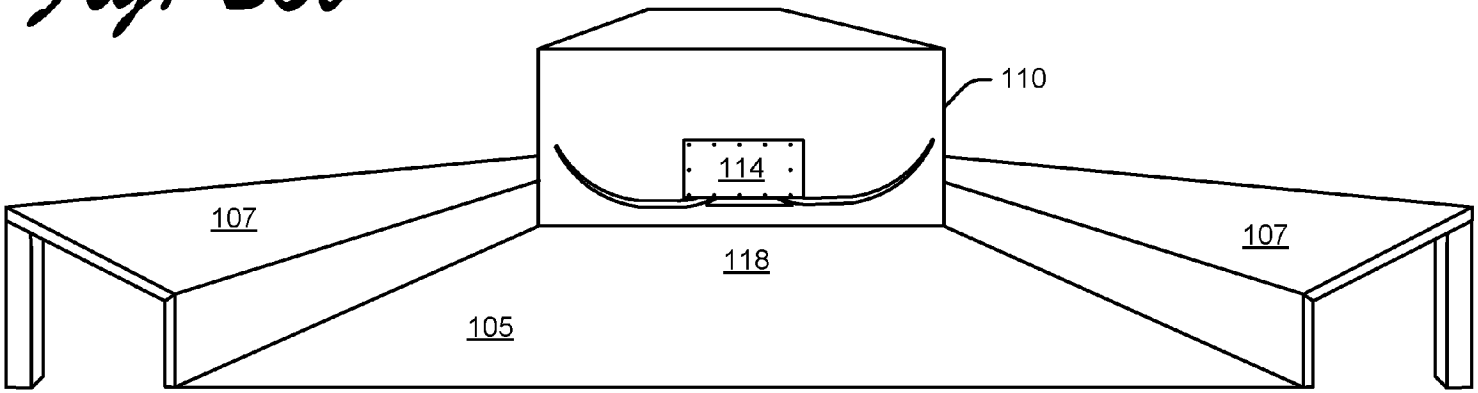

Another means of providing a vent for the wave-simulating water flow of the wave simulator is shown in FIGS. 26*a* through 26*d*. As shown in FIG. 26*a*, a reservoir 110 may have a multi-aperture vent array 112 disposed thereon as shown. The vent array 112 may be in the pattern shown in the Figures, or other patterns of apertures 111 may be designed and implemented as desired. As shown in FIG. 26*b*, a vent cover 114 has been affixed by any suitable means, such as by bolts, for example, to a portion of the reservoir 110 so as to block specific portions of the vent array to shape the flow of water that emanates from the array.

FIG. 26*b* shows a vent array with a vent cover 114 that allows a half-pipe-shaped flow to emanate from the vents 112 and onto a half-pipe flume structure 101, similar to those shown in FIG. 24*b*, 24*c* or even 24*j*.

A vent plate cover 114 may have an insert or inserts formed on the face thereof that mate perfectly with the apertures of the vent array 112 that it is designed to block, for example, shaped and welded steel pieces may be conformed on the face of a vent plate 114 and rubber gasket material attached thereto, or other suitable types of protruding pieces may be formed on a plate 114 to aid in flow blockage.

Figure 26C:
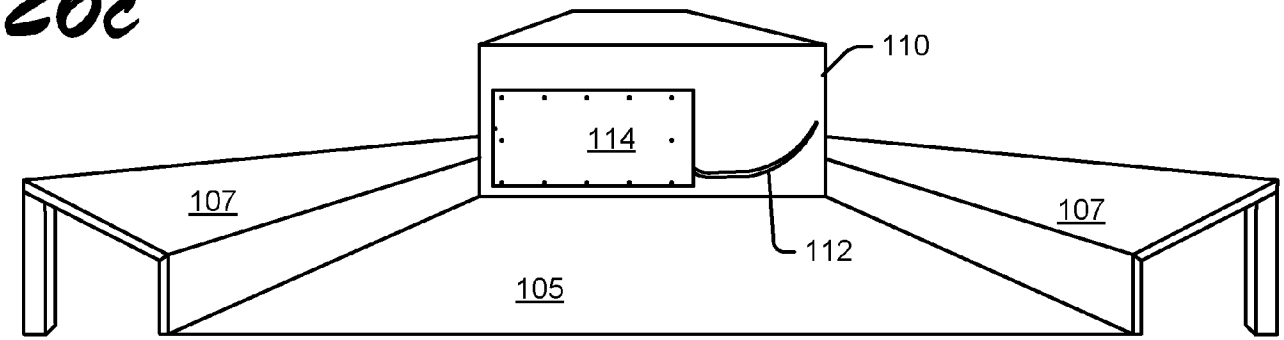
Figure 26D:
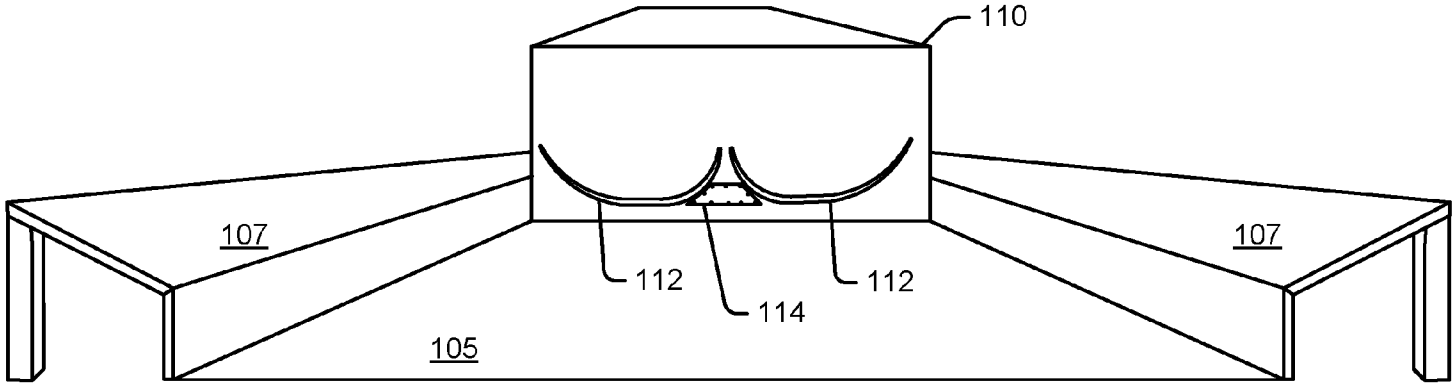

FIG. 26*c* shows another, differently shaped vent cover 114. This particular cover 114 is shaped to generate a flow from the array 112 that may simulate a right-breaking wave upon a flume structure 101, which may be similar to that shown in FIG. 24*e*. The cover 114 shown in FIG. 26*c* may also be reversed, that is, "flipped", and then moved and reaffixed to the reservoir 10 to block the portion of the flow that is making the right-breaking down the line wave simulation, in which case a left breaking wave flow may be simulated by the newly uncovered portions of the vent array 112. Such a left-breaking wave shaped flow could be implemented with a flume structure 101 similar to that shown in FIG. 24*k*. FIG. 26*d* shows yet another differently shaped vent cover 114. The cover 114 shown in FIG. 26*d* blocks a central portion of the vent array 112 to allow the creation of a spine-ramp type dual flow that may be used for supplying a flow of water upon a flume structure 101 shaped not unlike those shown in FIGS. 24*h* and 24*i*.

Of course, the pattern of the vent array 112 as shown in the Figures is only exemplary of a typical pattern, and any pattern that is desirable may be used. A vent array pattern 112 may be cut into a vent plate 109, so that multiple vent array patterns may be made available for use in the operation of the wave simulator.

Figure 27A:
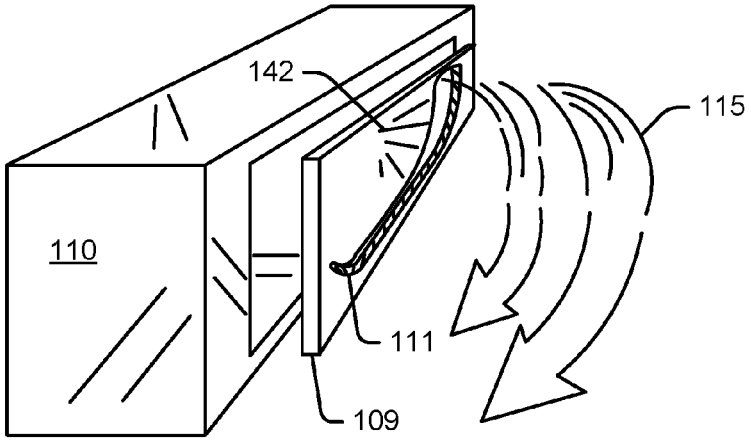
FIGS. 27*a* and 27*b* show an exploded side-perspective and plan view in partial cutaway, respectively, of a shaped vent that simulates a barreling wave according to the wave simulator.
Figure 27B:
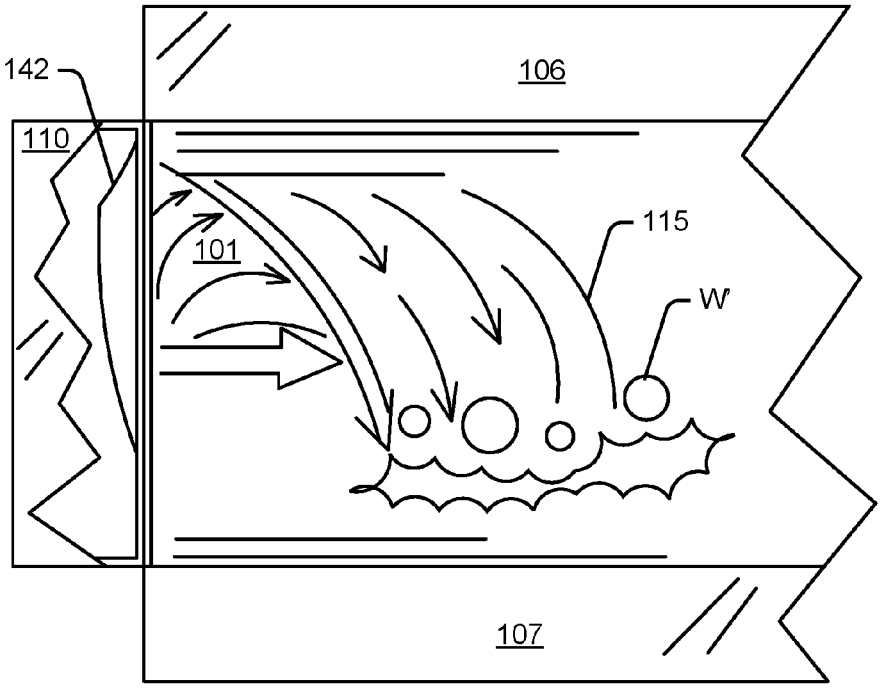

As shown in FIGS. 27*a* and 27*b*, the vent plate 109 may be formed in such a way so as to simulate a barreling wave formation 115. By forming an area 142 of the vent plate 109 in such a manner that a part of the plate 109 that is closest to the upper rim of the vent 111 is substantially biased towards the reservoir 110 as shown, a tubular wave 115 may be formed from a flow of water according to the wave simulator. The barreling wave 115 may be ridden within or upon by surf riders of the wave simulator. The more the area 142 of the vent plate 109 (or the upper portion 142 of any vent according to the wave simulator) is canted towards the reservoir, the larger and more angled the barrel wave simulation 115 becomes, the angle causing the lip of the barrel 115 to throw more towards the center of the flume 101. The barreling wave-forming area 142 of a vent plate 109 may of course also be formed into the surface(s) of a vent array pattern 112. The area 142 may be static, as shown, which may cause the same type of barrel wave 115 to be simulated, or mechanical means (not shown), such as a pulley, wire and motor assembly, or even a linkage and motor assembly, may be employed to cause a deformable or otherwise movable area 142 to be manipulated in real-time so that a changeable barrel wave 115 might be simulated. Such mechanical means may also be used to stop the barrel wave 115 from being simulated so that novice surfers, who may not want a barreling wave, may ride the wave simulation of the wave simulator. In the case of an example of the wave simulator that employs vent plate(s) 109, a different style of vent plate may simply be chosen and installed for those who do not want a barreling wave simulation. Differently angled areas 142 may be provided on different vent plates 109 to simulate different barreling tube waves on the same flume 101 profile.

Figure 27C:
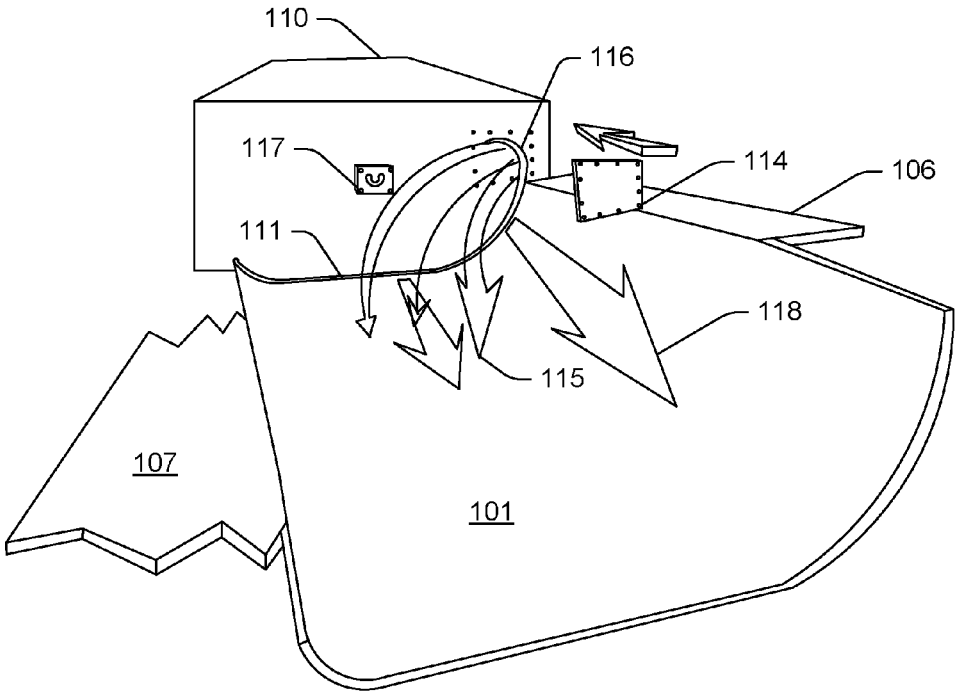
FIG. 27*c* shows a perspective view in partial cutaway of a vent aperture that can simulate a tubing barrel wave according to the wave simulator.

FIG. 27*c* shows a vent shape 111 that makes another type of simulated tubular barrel wave. By including as part of the cut vent shape 111 an over-vertical arc vent section 116 in what would be the crest of the down-the-line wave, the water flow that is emitted from the reservoir 110 through this uppermost over-vertical curvature 116 of the vent 111 throws out into the flume 101 in a barreling wave simulation 115, and can therefore be ridden in by riders of the wave simulator in a manner not unlike actual barreling ocean waves. The curvature 116 may be covered by a cover 114 as shown, and the barreling wave 115 may then cease. FIG. 27 depicts the vent arc 116 being part of a vent 111 cut directly into the face of a reservoir 110, but of course the arc 116 could be part of a vent array 112 or a vent 111 positioned upon a vent plate 109.

Also shown in FIG. 27*c* is a U-bolt assembly 117 mounted to the surface of the reservoir 110, to which a tow rope may be attached by any suitable means, and the tow rope and handle assembly (not shown) may be used by a rider of the wave simulator to ride the down-the-line wave simulation. The U-bolt 117 is usually mounted center to the flume 101 so that a rider of the wave simulator may be able to pivot back and forth across the down-the-line wave simulating flow.

Figure 28A:
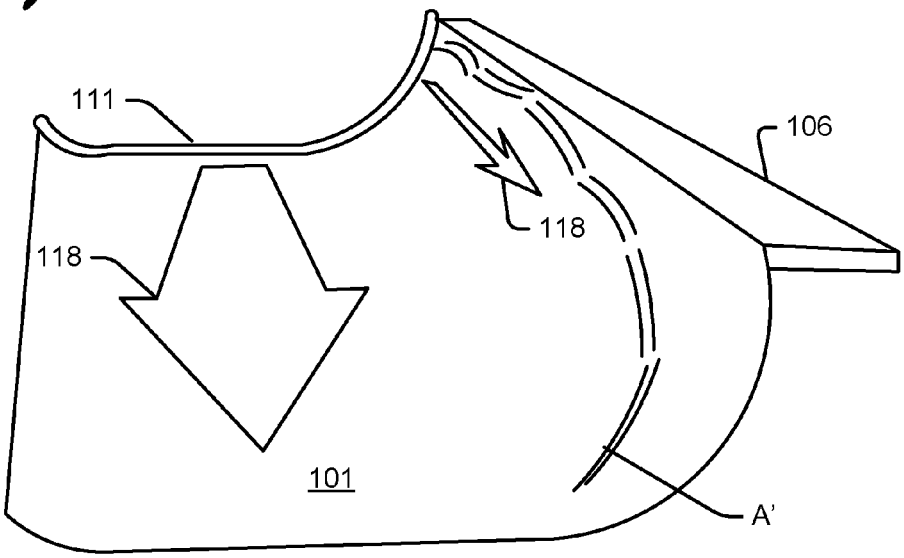
FIGS. 28*a* and 28*b* show perspective views in partial cutaway of a down-the-line wave simulating flume according to the wave simulator.
Figure 28B:
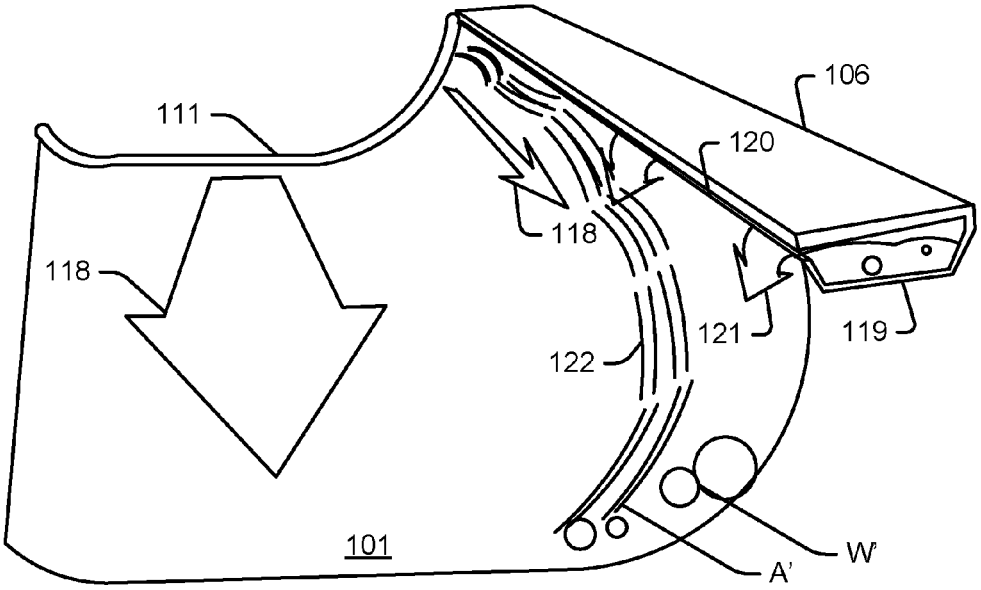

FIGS. 28*a* and 28*b* show a phenomenon that occurs in the wave simulation of the wave simulator. When a down-the-line wave simulating water flow 118 is dispersed from a vent 111 across the surface of a flume 101 the forces of friction and gravity eventually cause the inclined part of the flow to traverse downward in an arc A', as shown best in FIG. 28*a*. This makes a lip of water that is not unlike an ocean wave's lip, and can be used by riders to perform maneuvers upon. Many variables effect the down-the-line wave simulating water flow 118 of the wave simulator, with its attendant water arc A'. The velocity and thickness of the water flow 118 is a prime factor, as is the angle of the incline of the flume 101. The less the incline of the flume 101, the longer the distance the water flow 118 stays upon the inclined wall of the flume 101, and vice versa. More inclined versions of the wave simulator, such as flumes 101 with an incline greater than 30 degrees, for example, are ideal for faster and barreling down-the-line wave simulations, whereas flumes 101 possessing less than 30 degrees inclination tend to be better for the less experienced board riders and for slower flow wave simulations according to the wave simulator. The velocity of the water flow 118 though a vent 111 onto the flume 101 has a similar effect, that is, the higher the velocity of the flow 118, the longer the simulated wave flow can be made upon the length of the flume 101. The length of the rider's tow rope is a function of the aforementioned factors, such that the tow rope may be shortened or lengthened based upon a given length of ridable wave simulation water flow 118 of the wave simulator, which varies based upon the aforementioned factors.

As shown in FIG. 28*b*, an upper trough of water 119 may be positioned under an upper deck 106, with a vent 120 allowing a flow of water 121 to flow down the upper inclined part of the flume 101. A pumping system (not shown) may be used to provide a constant water flow into the trough 119, and control means (not shown) may be used to control the rate of this water flow, or to shut it off completely as desired. A pipe and valve assembly, or even a channel (not shown), may be used to connect the trough 119 to a reservoir 110 as the means of supplying water to the trough 119. The flow of water from the trough 119 via its vent 120 is not pressurized, and so the water flows naturally down the flume 101 due to the force of gravity. As the rate of water flow from the trough 119 is increased, the increased flow rate may serve to thicken the lip of water A', for a different surf simulation experience. If the water flow from the trough 119 is increased in conjunction with an increase in velocity, and preferably an increase in thickness, of the down-the-line wave simulating water flow 118 from the vent 111, a barreling water wave simulation 122 is formed by the confluence of the two water flows, and a rider of the wave simulator can ride within the tubular wave and also perform maneuvers upon this wave simulation as well. By varying the rate of flow from the trough 119, as well as the rate of flow from the vent 111, a varying wave simulation may be realized. A barreling wave 122 may be made to disappear, reappear, grow or shrink using the varying of the flow rates in this manner. The drop angle, thickness, and position of the water arc A' may also be varied in similar manner, creating an unpredictable and exciting down-the-line surf riding simulation. Whitewater formations W' may also be formed as shown here, and may be used to perform "floater" maneuvers thereupon by surf riders.

Figure 29:
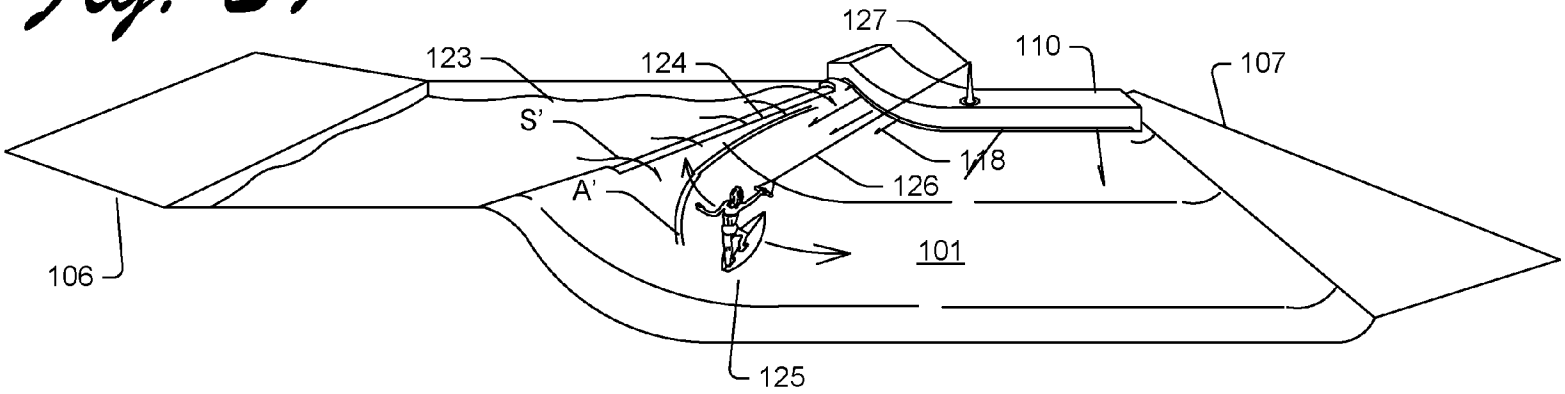
FIG. 29 shows a perspective view of a down-the-line wave simulation according to the wave simulator that is provided with an upper pool and weir.

FIG. 29 shows an example of the wave simulator wherein an upper pool 123 is positioned adjacent to the top of a flume 101, as shown. A weir 124 provides for a flow of water 121 from the upper pool 123 downward across the surface of the flume 101, as shown by streamlines S' in Figure. The depth of a weir 124 may be from about 2 inches to about 10 inches deep in the upper wall of the flume 101, and normally from about 3 feet to about 20 feet in length. The downward flow of water from a weir 124 makes formations not unlike those previously discussed in relation to FIG. 28*b*, that is, simulated barreling waves, thicker lips of water, etc. However, having a weir 124 and upper pool 123 combination as shown adds an element of authenticity to the wave simulator insofar as the combination better simulates conditions of an actual ocean wave. To wit: a wave rider on an actual ocean wave has a body of water behind the wave that the rider can kick out into and also perform turns and other maneuvers on. The pool and weir combination as shown in FIG. 29 successfully mimics this condition in the wave simulator. A wave rider 125 may utilize a tow rope 126 attached to a stationary point, for example, a post/stanchion 127, as shown, to ride the down-the-line shaped wave simulation flow 118, the downward flow of water from the weir 124, and also the water arc/lip/tubular barrel wave as represented by arc A' in FIG. 29. A surf rider of the wave simulator may also utilize a standing wave or hydraulic jump instead of a tow rope. A pumping system (not shown) is used to resupply the body of water in a pool 123, and the pump may be controlled to increase or decrease the water level in the body of water disposed in an upper pool 123 so as to increase or decrease the downflow of water from a weir 124, thus influencing the simulated down-the-line wave simulation of the wave simulator in a manner as previously discussed in relation to the example of the wave simulator as shown in FIG. 28*b*.

An upper pool 123 is normally from about 2 feet to about 8 feet deep and from about 4 feet to about 20 feet wide, and constructed from materials such as concrete or fiberglass. The pool 123 is usually from about 8 to about 40 feet long.

Figure 30:
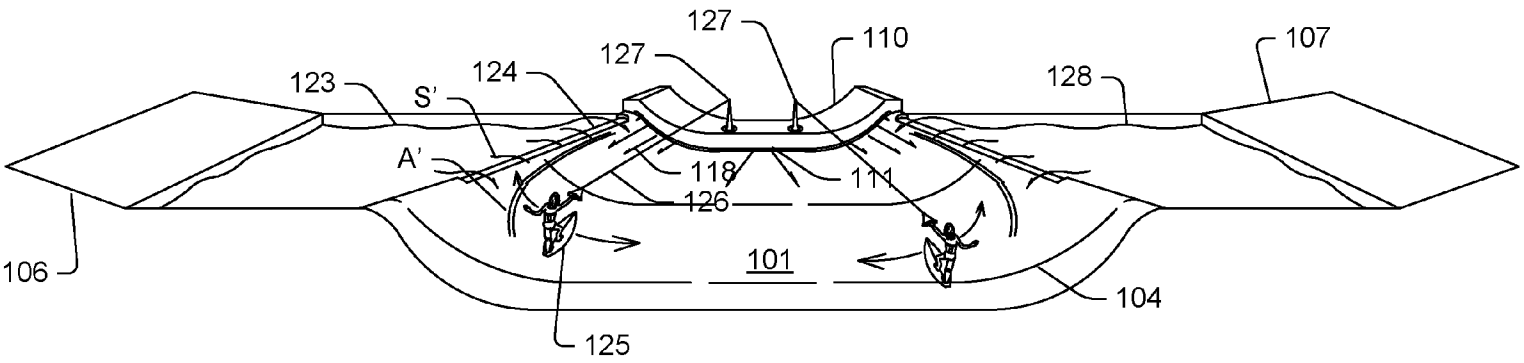
FIG. 30 shows a perspective view of a half-pipe version of a wave simulator according to the wave simulator.

FIG. 30 shows a half-pipe example of the wave simulator that utilizes upper pools of water 123. As shown in the Figure, two surf riders may utilize such a half-pipe configuration at the same time, or a single surf rider may ride the half-pipe, traversing from the left side of the half pipe (the left-hand down-the-line wave simulation) to the right side of the half-pipe (the right-hander wave simulation). The water flow rates via the reservoir(s) 110 via vents 111, and/or the downward water flow from upper pool(s) 123 via weir(s) 124 may vary from one side of the half pipe to the other as desired.

Figure 31:
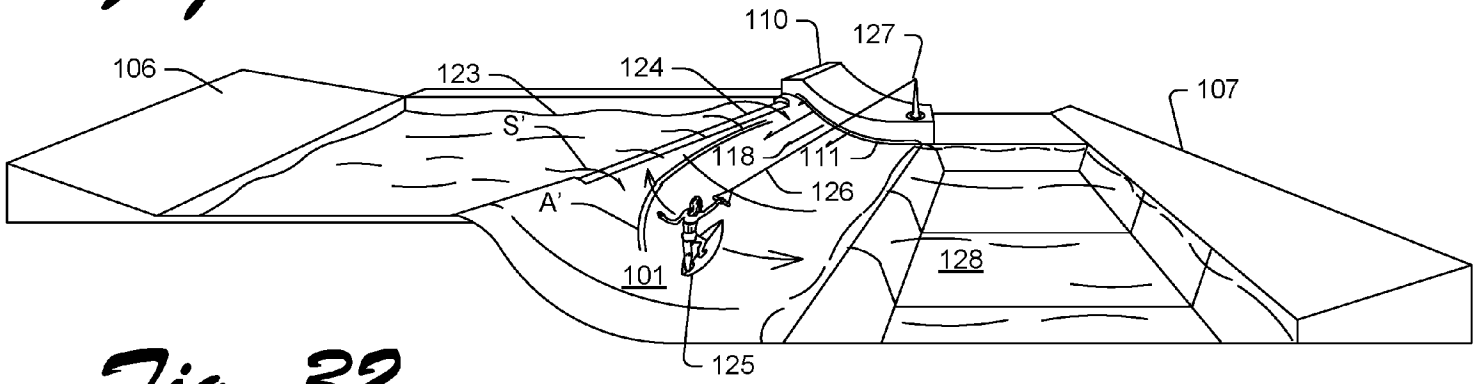
FIG. 31 shows a perspective view of a down-the-line wave simulator according to the wave simulator that is provided with an upper pool and weir as well as a lower pool of water.

FIG. 31 shows an example similar to that shown in FIG. 29, with the addition of a lower pool of water 128. The lower pool of water may further the authentic wave riding feeling of the wave simulator, allowing the surf rider 125 to not only perform extended bottom turns into the still pool of water 128, but also allows the surf rider 125 to exit the surf simulator via either the lower pool 128 or upper pool 123, not unlike the still areas of water in front of and also behind an actual ocean wave upon which surf riders may perform maneuvers and also into which a surf rider in the ocean might exit an ocean wave ride. The water level in the lower pool 128 preferably comes right up to the lowermost edge of a vent 111, so that a seamless surf ride from the wave simulation flow 118 to the water in the pool 128, and back to the flow 118, may be achieved by a rider of the wave simulator. To this end, the walls of a lower pool 128 are constructed about 2 to 4 feet higher than the lowermost part of a flume 101.

Figure 32:
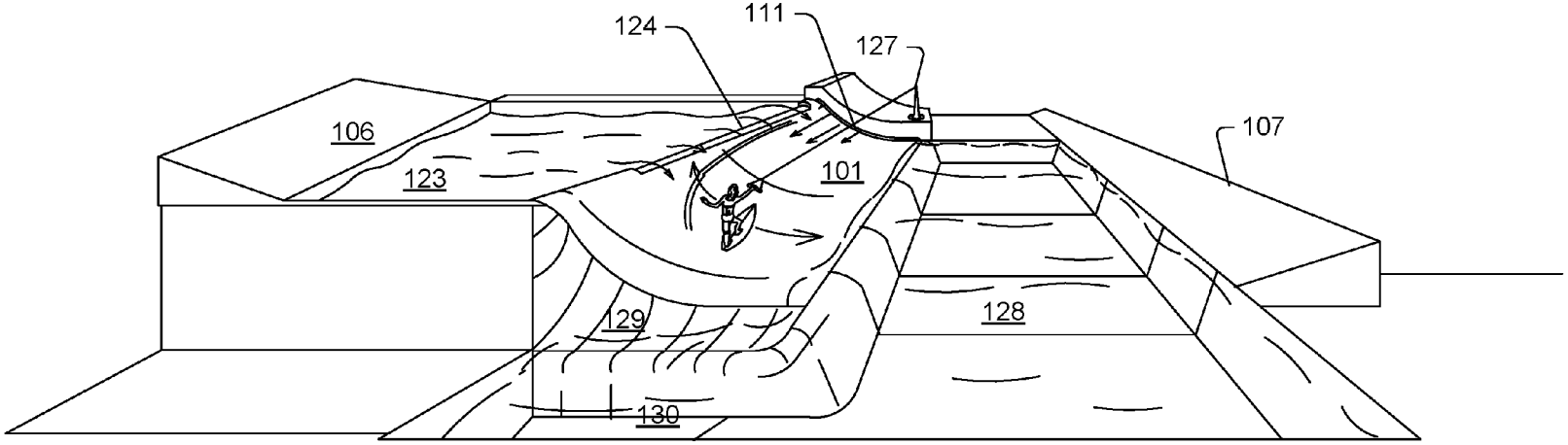
FIG. 32 shows a perspective view of a down-the-line wave simulator according to the wave simulator that has an upper pool and weir, a lower pool of water and a splash-down pool and slide combination for the safety of a rider of the wave simulator.

FIG. 32 shows an example of the wave simulator that is similar to that shown in FIG. 31. A downstream waterslide 129 and a splash-down pool 130 have been added for added safety of the surf riders of the wave simulator. As shown, a splash-down pool 130 may adjoin a pool 128, or may be a separate pool as desired. The waterslide 129 is formed at the downstream end of a flume 101, and may be conformed thereon, for example, the slide 129 may be conformed into or upon a modular member 104. By utilizing a downstream waterslide 129 that communicates into a splash-down pool 130 as shown, a rider who has a fall or mishap while riding the down-the-line wave simulation may safely exit the ride on the slide 129 and into the pool of water 130.

Both pools 128 and 130 are normally from about 2 feet to 8 feet deep and from about 4 feet to around 20 feet wide, and constructed from materials such as concrete or fiberglass. The lower pool 128 is usually from about 10 to about 40 feet long and the splashdown pool 130 is normally from about 15 to about 30 feet long. Either one or both pools 128 and 130 normally have grates and/or drains (not shown) mounted in their sidewalls and/or bottoms that allow for water to reach the pumps that communicate with a reservoir 110, for example, a grate or series of grates in the vertical pool wall(s) may be integrally connected to a channel or hollow area (not shown) underneath a ramp 101 that allows water to flow to the pump(s) of the wave simulator.

Figure 33:
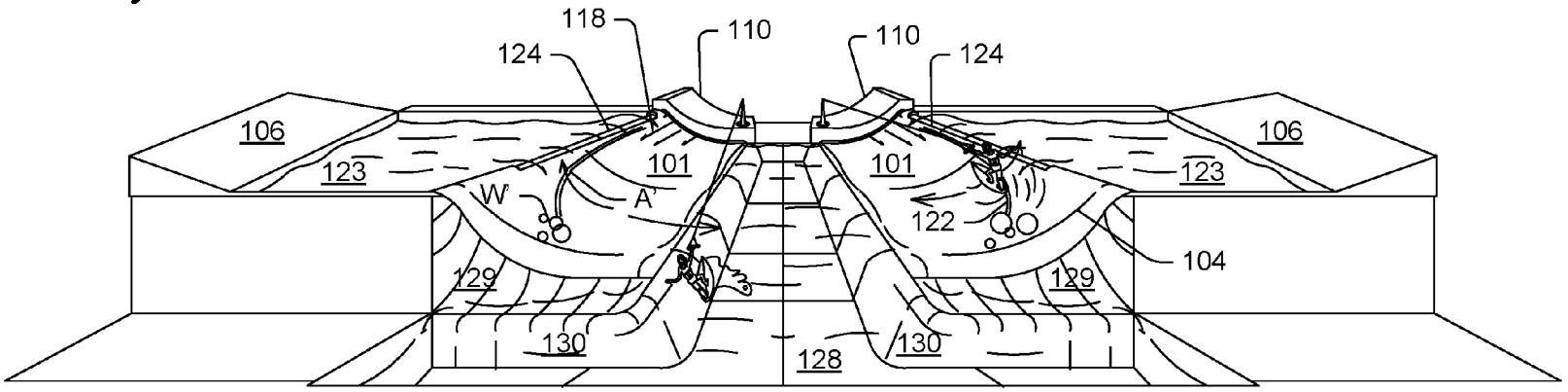
FIG. 33 shows a perspective view of a down-the-line wave simulator according to the wave simulator with upper pools and weirs, a lower pool of water and splash-down pools and slide combinations for the safety of riders of a half-pipe version of the wave simulator.

FIG. 33 shows an example of the wave simulator that is similar to that shown in FIG. 32, but in a half-pipe configuration. Two riders may ride such a version of the wave simulator, as shown, or a single rider may ride the half-pipe as desired. The water flow rates via the reservoir(s) 110 and/or the upper pool(s) 123 via weir(s) 124 may vary from one side of the half pipe to the other as desired.

Figure 34A:
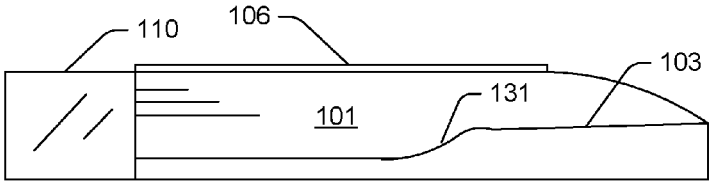
FIGS. 34*a* and 34*b* show a side-cutaway view and plan view, respectively, of an example of the wave simulator that makes use of a ramp to simulate a standing wave according to the wave simulator.
Figure 34B:
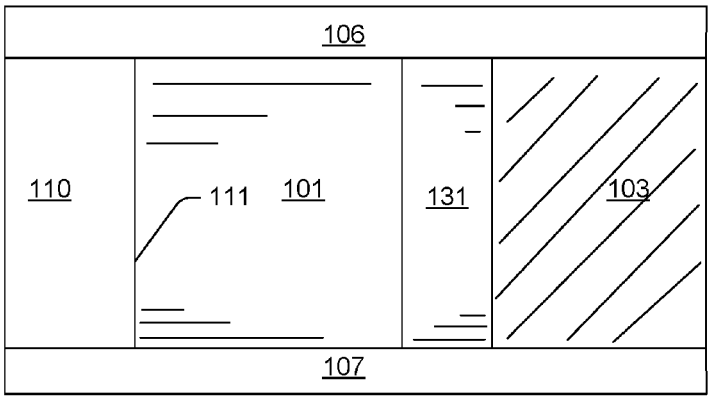

As shown in FIGS. 34*a* and 34*b*, a wave-forming ramp 131 is positioned in the flume 101 as shown. As the water flow 118 flows across the flume 101 via the reservoir 110, the water flow simulates a down-the-line wave on the flume 101, and, as the flow encounters the wave-forming ramp 131, water flow simulates a standing wave formation. The standing wave and the down-the-line wave simulation exist at the same time on the wave simulator; therefore, a rider of the wave simulator may not need a tow rope to ride this example of the wave simulator, as the standing wave keeps the surf rider in a position to ride both the standing wave and the inclined flow of the down-the-line wave simulation at the same time. A foil structure (not shown) may also be used to form a standing wave within the flume 101. A wave-forming foil is usually angled with respect to the floor of a flume 101 from about 15 to about 35 degrees and may be constructed of similar materials to the flume 101, for example, from fiberglass.

Figure 34C:
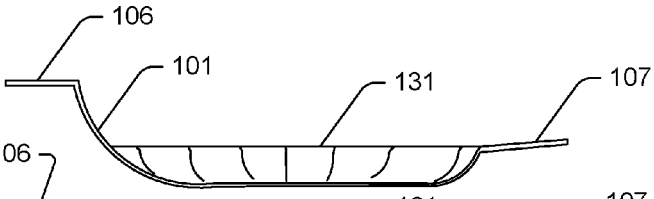
FIGS. 34*c* through 34*g* show cutaway views, looking from the direction of the down-the-line wave simulating flow vent of the wave simulator toward the rider exit area, of various flume and standing wave-forming ramp combinations according to the wave simulator.
Figure 34D:
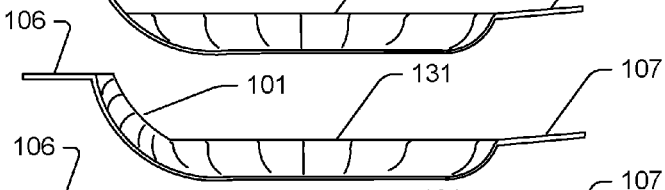
Figure 34E:
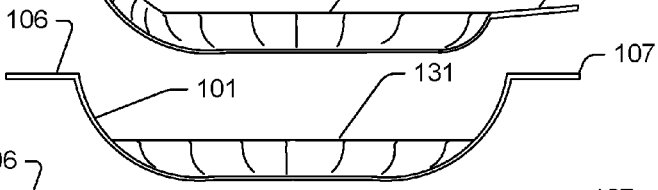
Figure 34F:
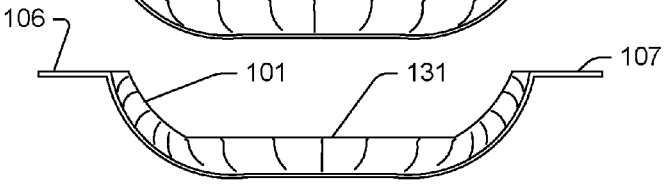
Figure 34G:
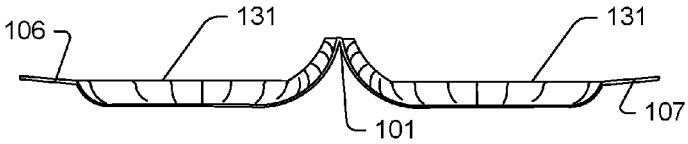

There are many possible combinations of a standing wave-forming ramp in conjunction with a down-the-line wave simulating flume 101. FIGS. 34*c* through 34*g* show some of these possible combinations. FIG. 34*c* shows an example wherein the standing wave-forming ramp 131 is formed substantially in the horizontal part of a flume 101. FIG. 34*d* shows an example similar to that in 34*c*, but the standing wave-forming ramp has been curved and extended up the inclined face of the flume 101, so that a standing wave may be formed on the incline as well. FIG. 34*e* depicts a half-pipe flume 101 with a standing wave-forming ramp 131 formed in the horizontal part of the flume 101 to make a standing wave in this horizontal area of the half-pipe down-the-line wave simulation. FIG. 34*f* shows a half-pipe wave simulation of the wave simulator wherein the standing wave-forming ramp 131 has been curved and extended up both faces of the half-pipe to make inclined standing waves up the face of the flume 101; alternatively, only one standing wave-forming ramp 131 may be curved and extended up only one face of a half-pipe flume 101 as desired. FIG. 34*g* shows a "spine ramp" configuration of the wave simulator with standing wave-forming ramps 131 formed in the horizontal portions as well as the inclined portions of the flumes 101. Many similar combinations of a flume 101 and a standing wave-forming ramp 131, or even a wave-forming foil, are possible.

A grated area 103 may be placed near the juncture where the flume 101 and the ramp 131 converge in order to remove any undesirable accumlulated water that may hinder either the wave flow 118 or the creation of a standing wave by a ramp 131.

Figure 35A:
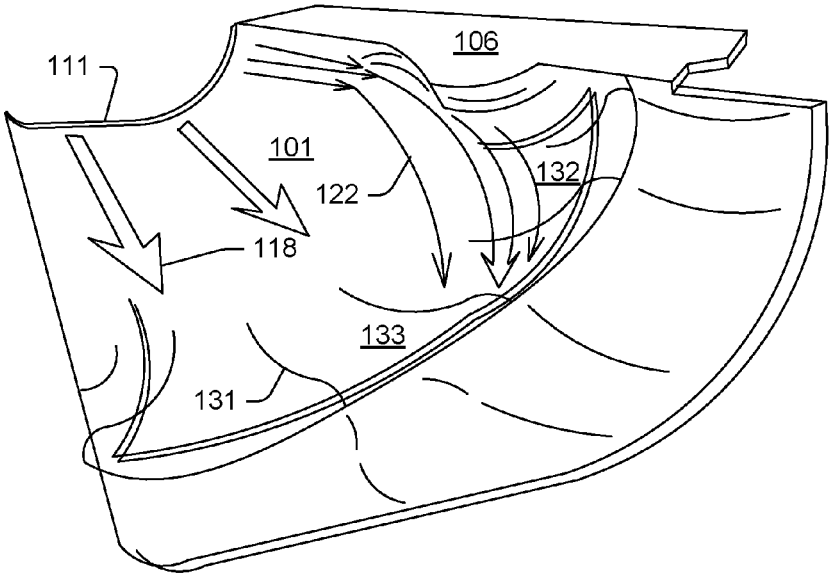
FIG. 35*a* shows a perspective view in partial cutaway of a flume of the wave simulator with a barreling wave forming member and a standing wave-forming ramp.
Figure 35B:
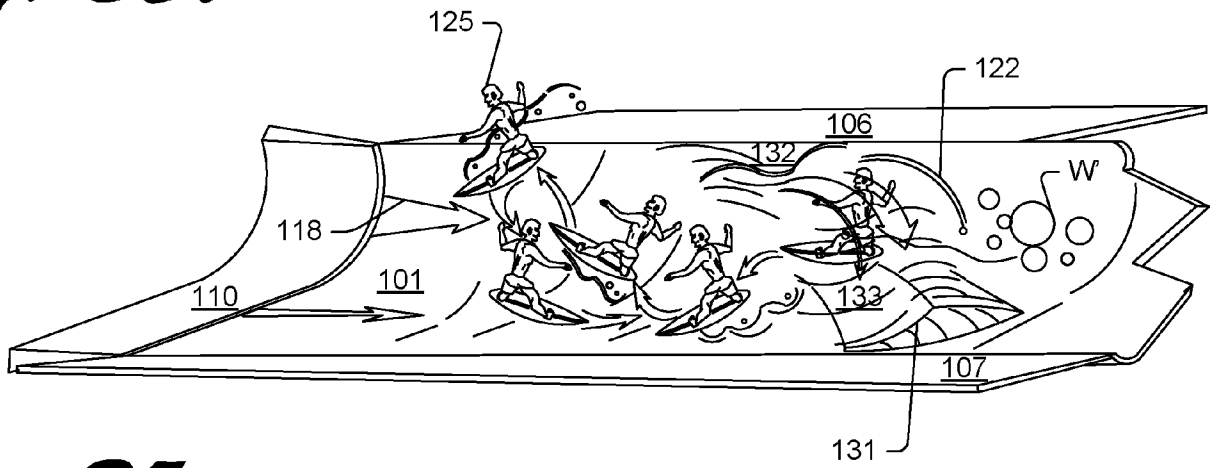
FIGS. 35*b* and 35*c* show side perspective views in partial cutaway of a flume of the wave simulator with barreling wave simulations and standing waves formed from the down-the-line wave simulating flow.
Figure 35C:
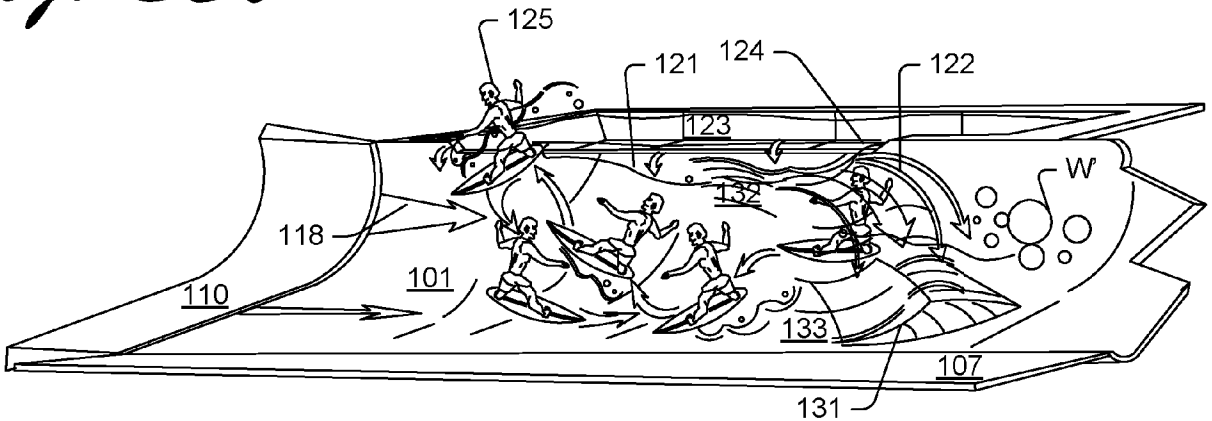

As shown in FIG. 35*a*, a standing wave-forming ramp 131, conformed onto the flume 101 in this instance, may be positioned adjacent to a barreling wave-forming component 132. A tubular wave-forming component 132 may be either molded directly into a down-the-line wave simulating flume structure 101, for example, structure 101 may be molded into a modular member 104, or the barreling wave-forming means 132 may be made into a separate component and then affixed to the surface of the flume 101 by any suitable means. The component 132 is curved and formed so as to simulate a throwing tubular wave 122 from the down-the-line water flow 118. The wave-forming ramp 131 and member 132 may be placed upon the flume 101 in close proximity, as shown in the Figures. This allows a rider 125 to ride inside the barreling wave 122 while riding the standing wave 133 at the same time, as best shown in FIGS. 35*b* and 35*c*. A rider 125 may also pump and carve upon the face of the down-the-line simulated wave flow 118, as shown. As shown best in FIG. 35*c*, an upper pool 123 may also be provided, with a downward water flow 121 from a weir 124 enhancing the nature of the barreling wave and also the down-the-line wave simulation as well. The downward flow 121 from the weir 124 has been found to make the barreling wave simulation more realistic, as the two flows converge (the down-the-line wave simulation flow 118 and the downward weir flow 121). The flow 121 tends to thicken and smoothen the lip of the barreling wave 122, as well as the body of the tubular wave 122 itself. Also, having the pool 123 at the top of the wave simulation gives the rider 125 another surface of water in which to turn and carve, and also to exit into as desired. Thus, the pool 123 may increase the safety of this example of the wave simulator as well. Of course, a lower bottom-turn pool 128 and/or a splash down pool 130 may also be used with this example of the wave simulator. The standing wave 133 may of course be ridden in conjunction with the wave simulation flow 118 without being proximate to the barreling wave 122.

Figure 36A:
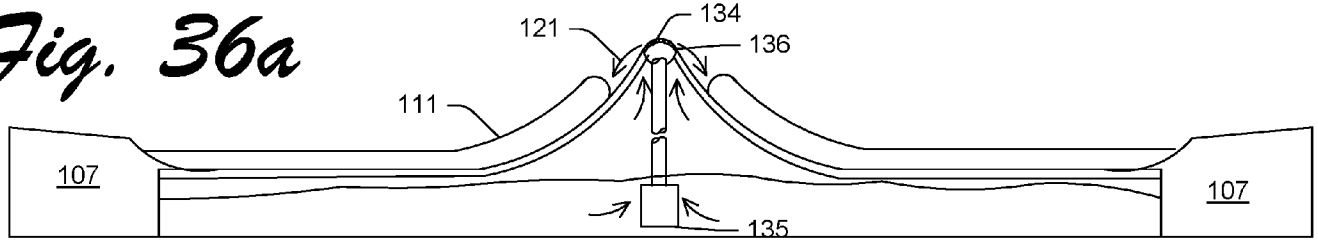
FIGS. 36*a* and 36*b* show a cutaway and plan view, respectively, of a dual-sided "spine" flume according to the wave simulator.
Figure 36B:
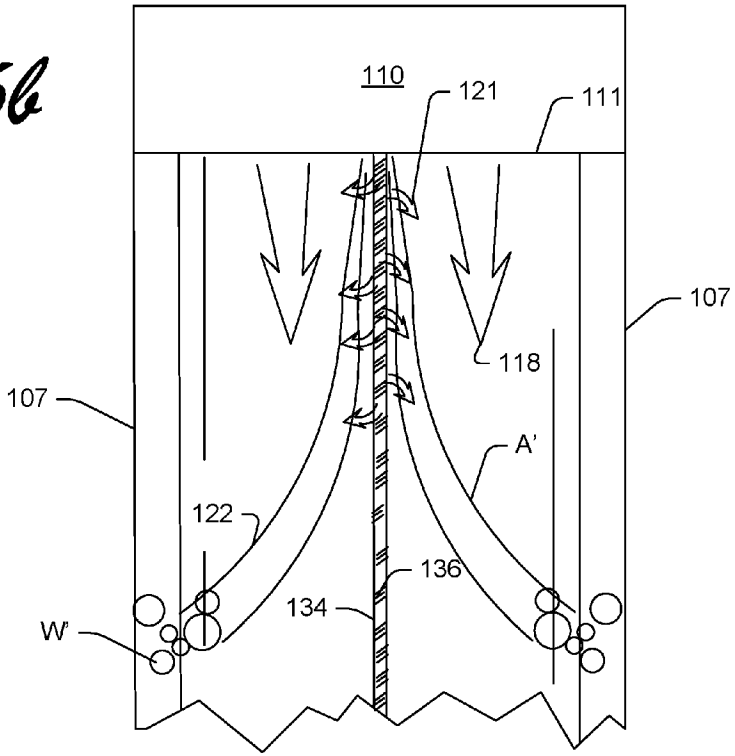

As shown in FIGS. 36*a* and 36*b*, a "spine ramp" combination of two flumes 101 may be provided with a downward flow 121 from a top channel 134 via a pump and pipe assembly 135. A grate 136 may be supplied to cover the channel 134, or the flow 121 may be allowed to flow freely from the channel 134. In either case, the flow 121 enhances the wave simulation of this example of the wave simulator in a similar manner to the example shown and as previously described in relation to FIGS. 28*a* and 28*b*, that is, the flow of water from the recess 134 via the pump 135 is not pressurized, and flows naturally down the flumes 101 due to the force of gravity. As the rate of water flow from the channel 134 is increased, the flow rate may serve to thicken the lip of water A', for a different surf simulation experience. If the water flow from the channel 134 via pump assembly 135 is increased in conjunction with an increase in velocity, and preferably an increase in thickness, of the flow from the vent 111, a barreling water wave 122 is formed by the confluence of the two water flows, and a rider of the wave simulator can ride within the tubular wave and also perform maneuvers upon this wave as well. By varying the rate of flow from the pump 135 to the channel 134, as well as the rate of flow from the vent 111, a varying wave simulation may be realized. A barreling wave 122 may be made to disappear, reappear, grow or shrink using the varying of the flow rates in this manner. The drop angle, thickness, and position of the water arc A' may also be varied in similar manner, creating an unpredictable and exciting down-the-line surf riding simulation. Whitewater formations W may also be formed as shown here, and may be used to perform "floater" maneuvers thereupon by surf riders.

The shape and path of a water arc A', as well as the shape and path of the barreling wave 122 arc as shown in FIG. 36*b*, may be considered to be typical arcs/shapes/paths of these phenomena with regards to other aspects of the wave simulator, for example, the half-pipe example, the right-hander, and left-hander of the down-the-line wave simulation all have very similarly shaped arcs A'/barreling wave simulations 122 to those shown in FIG. 36*b*. Separate pumping systems 135 and channels 134 may be provided for each side of the spine ramp wave simulation according to the wave simulator, so that each side may have a different type of wave simulation at any one time. Separate pump controls (not shown), reservoirs 110, and vent shapes 111 may be supplied for each separate side of this variation of the wave simulator, and for any version of the wave simulator, for example, the half-pipe example.

A curved down-the-line wave simulation is shown in FIG. 37*a*. A down-the-line wave simulating flume 101 may be made in a circular conformation, or semi-circle, as shown in the Figure. The simulated wave flow then curves around and bends, creating a unique down-the-line wave simulation experience. Two riders or more may be accommodated by this example of the wave simulator. A single flow vent 111 may be provided for a single rider, as shown in FIG. 37*c*, or a double vent 111 array may be provided, as shown in FIG. 37*b*. With a double vent 111 array, a single rider may have a unique riding experience, as the rider may traverse from one side of the bowl-shaped flume 101 to the other, not unlike the half-pipe example of the wave simulator. Of course, two riders may ride a double vent array at the same time as well. Flow rates and other variable conditions may be made to vary from one side to the other of a double vent array according to this example of the wave simulator. Various previously described examples, such as the upper pools 123 with or without an attendant weir 124, lower pools 128, upper water flow trough(s) 119 with attendant vent(s) 120, barreling wave-forming members 132, or standing wave-forming ramps 131, may be used with this example of the wave simulator to simulate a wide variety of waves for rider enjoyment.

A circular curve need not be strictly followed and a number of complex curvatures may be used to form the surface of a flume 101 according to the wave simulator.

Figure 38A:
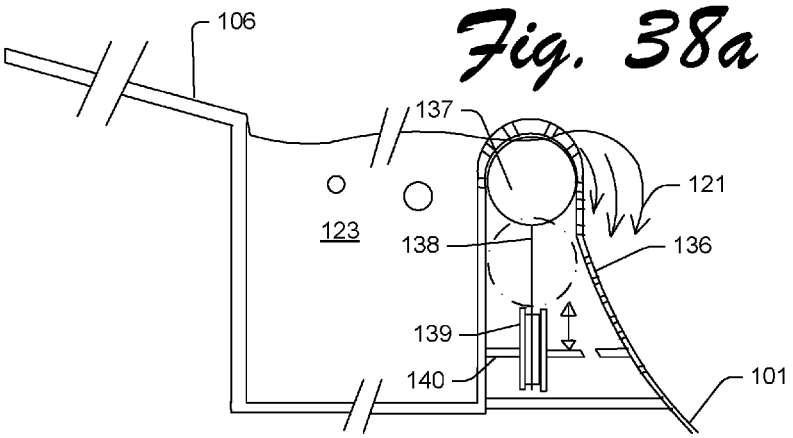
FIG. 38*a* shows a side cutaway view of a floating weir according to the wave simulator.
Figure 38B:
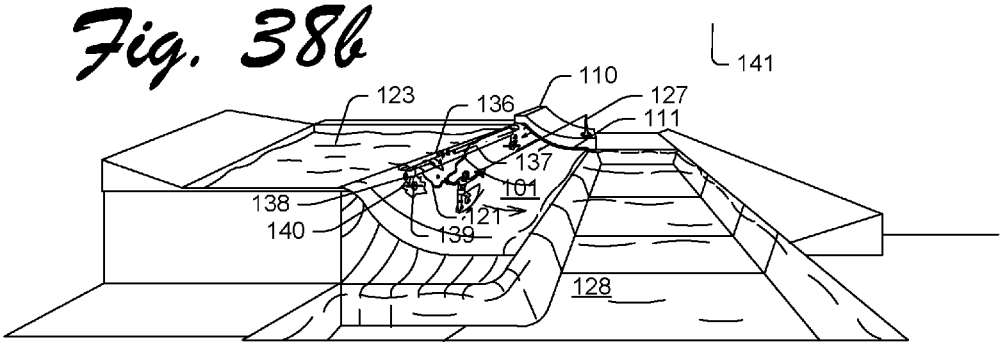
FIGS. 38*b* and 38*c* show a perspective view, in partial ghost/cutaway, of a floating weir according to the wave simulator.
Figure 38C:
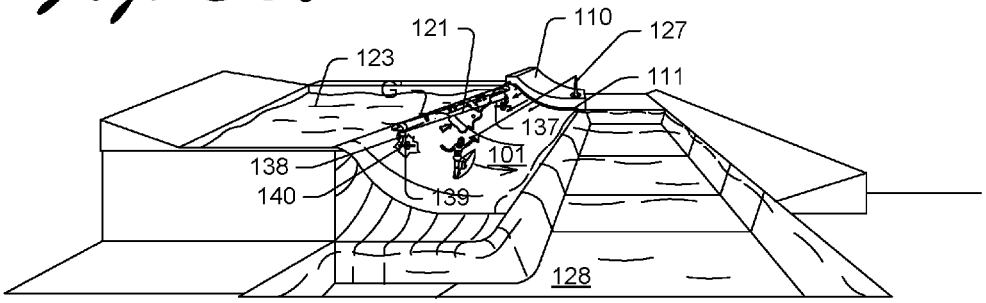

As shown in FIG. 38*a*, a variable-flow weir according to the wave simulator is shown. A grated or otherwise perforated surface area 136 is disposed as shown between the uppermost surfaces of a flume 101 and an upper pool 123 where the two converge. A floating weir block 137 is provided within the area between the pool 123 and flume 101, as shown. Weir block lines 138 are attached to both ends of the floating weir block 137 by any suitable means. Pulleys 139 allow free movement of the lines 138, and may be disposed as shown upon shafts 140. Mechanical means (not shown) are employed to raise and lower the two ends of the floating weir block 137 via the pulleys 139 and lines 138, such as motor and motor control assemblies. A lower containing wall 141 is affixed as shown to keep the water volume from the pool 123 from flooding other parts of the wave simulator. The pulleys 139 and lines 138 are preferably fabricated out of water-resistant materials, such as stainless steel or plastic, and the shaft 140 may be constructed out of similar materials. The floating weir block 137 may be made of a number of materials, such as epoxy-reinforced carbon fiber or fiberglass-wrapped foam, a reinforced closed-cell foam with or without an outer plastic shell, or other durable and buoyant materials. The weir block 137 may extend the entire length of the upper grated area 136. A round-shaped weir block 137 is shown in the Figures, but of course any shaped block 137 that is functional may be used. Now, as shown best in FIGS. 38*b* and 38*c*, the floating weir block 137 may be raised and lowered at either end by aforementioned means, and a downward flow 121 flows through the grated area 136 and down the flume 101. As each end of the block 137 is alternatively raised and lowered, the water flow simulates a dynamically moving downward flow 121, that is, where the floating weir block 137 is lowered more, more water flow 121 flows into the wave simulation, and the water flow 121 can be dynamically influenced by variably raising or lowering the ends of the floatable weir block 137. Subsequently, a traveling wave simulation is realized, insofar as the downward flow is able to influence the water flow of the wave simulator in previously mentioned ways, e.g., the effects of variable flow rates in both the downward flow 121 as well as the down-the-line wave simulation flow 118. Hence, traveling barrel waves 122 and other traveling wave characteristics may be simulated by this example of the wave simulator. Of course, the weir block 137 may be completely raised or completely lowered as desired to completely open or completely cut off an upper flow 121 from an upper pool 123.

Figure 39:
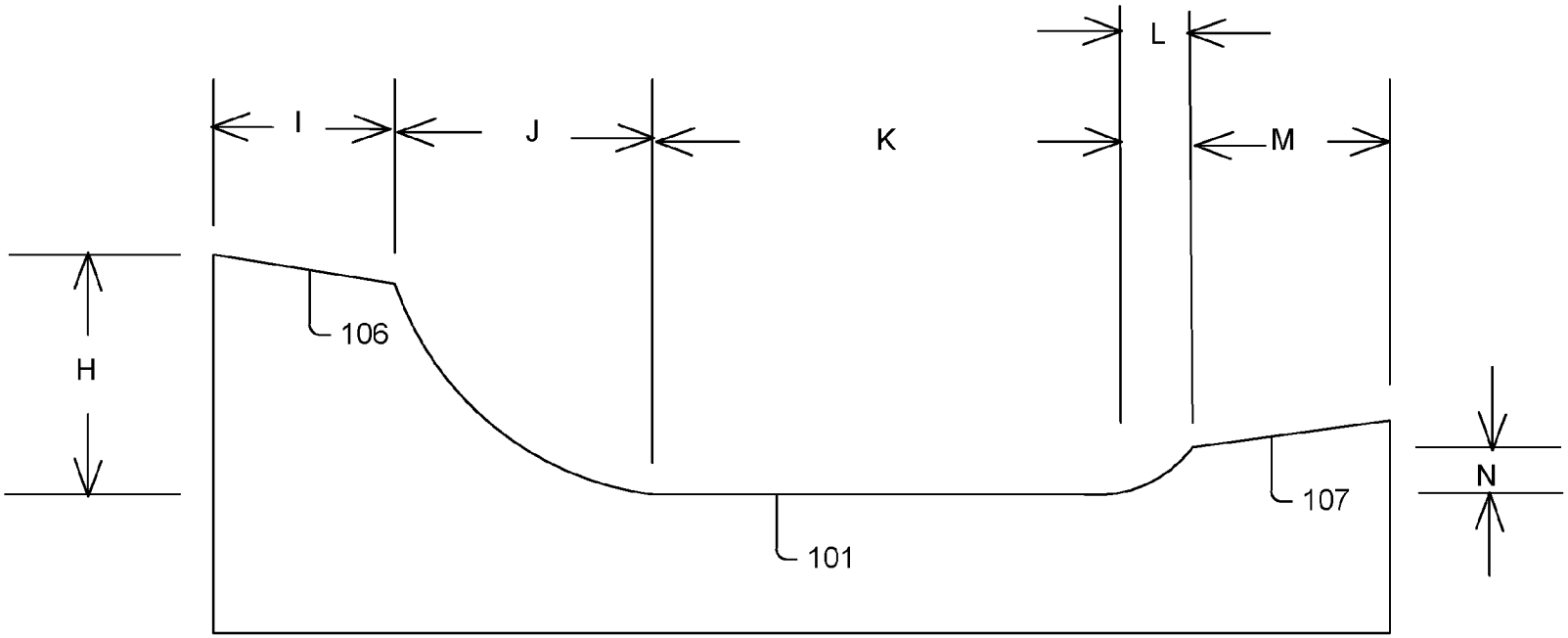
FIG. 39 shows a side profile view of a prototypical down-the-line wave simulating flume of the wave simulator.

FIG. 39 shows some prototypical measurements of common elements of a flume 101. Measurement H represents a typical height of the ridable wave simulating wall of the flume 101. H typically varies from about 2 feet to about 10 feet, but an average measurement might be considered to be around 4 feet high. Measurements I and M represent the widths of the upper and lower spectator and entrance/exit decks, or platforms. I and M typically measure from around 8 feet to about 15 feet in width. Measurement J represents the length of the ramp curvature, also referred to in the skateboarding and snowboarding ramp construction vernacular as the "ramp's transition." J normally measures from around minimally 3 feet to maximally about 15 feet, depending mostly upon the height of measurement H. Measurement K represents the substantially horizontal part of the flume 101 that a rider turns within. K normally measures around minimally 4 feet to maximally 20 feet, dependent mostly upon the height H of the flume 101 and the end-user application and available attraction footprint. Measurement L represents the width of the part of the flume 101 that is designed to contain the wave simulation water flow within the flume 101, and is normally from around 8 inches to around 3 feet in length. Measurement N is the height of the flow-containing lower portion of a flume 101, and is normally from about 8 inches to about 2 feet high. Of course, the aforementioned measurements are merely guidelines for a typical flume 101 of the wave simulator and any and all the aforementioned measurements may be changed to any measurement as desired. The length of a flume 101 may vary widely, from about 10 feet to about 60 feet, depending on many factors. A flume 101 may, of course, be made to any length desired. The flume 101 is normally constructed out of fiberglass, but many different materials may of course be used in the construction of a flume 101.

Figure 40A:
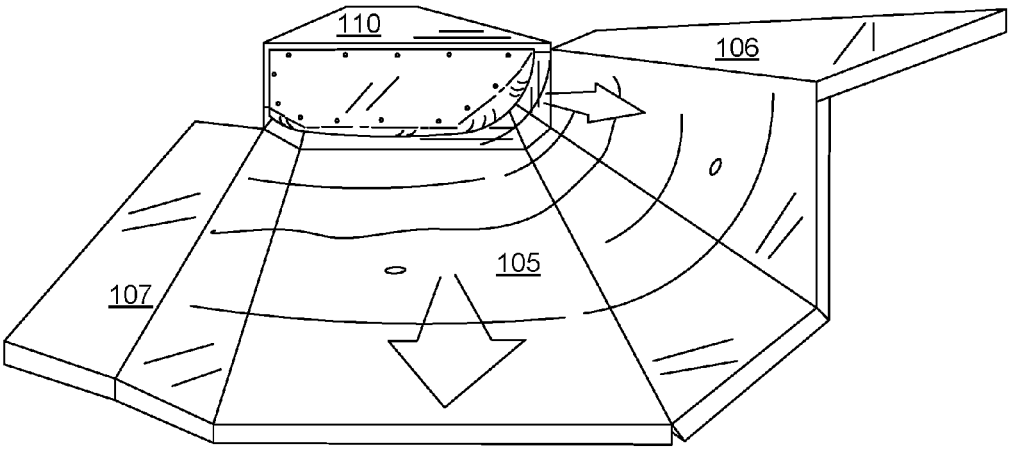
FIGS. 40*a* and 40*b* show perspective cutaway views of a wave simulator according to the wave simulator that utilize an open channel and a reservoir to generate a ridable flow of water.
Figure 40B:
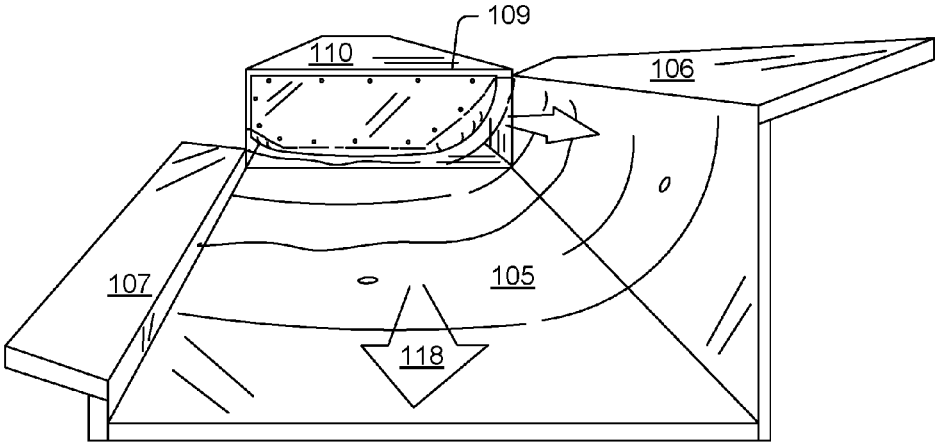

As shown in FIGS. 40*a* and 40*b*, an open channel 105 may be provided, along with a water reservoir 110, as shown. The face of the reservoir 110 that faces the open channel 105 may be provided with an orifice, as shown, the orifice normally comprising an inclined portion and a generally horizontal portion. An outlet plate 109 may be affixed over the face of the reservoir 110 as shown, to shape a flow of water from a reservoir 110 into an open channel 105. An open channel 105 may be shaped as shown in the Figures, or another suitably shaped open channel may be provided. The outlet plate 109 normally has a curved shape as shown to shape the flow of water into a desired concave wave shape. Many different shaped outlet plates 109 may be provided to simulate differently shaped waves, or the shape of the front orifice on a reservoir 110 may be already shaped to make a desirably shaped water flow according to the wave simulator. A thicker wave simulation may be provided by this example of the wave simulator, which may be desirable for not only safety reasons but also for a more enjoyable wave simulation, particularly for board riders who use finned boards, such as surfboards.

Regarding the thicker flow example of the wave simulator as shown in FIGS. 40*a* and 40*b*, the water-contacting edge of a vent plate 109 or that of a reservoir 110 front orifice can be bent inwardly, that is, towards to the water source, and by shaping/warping the plate/orifice in this manner a barreling wave is simulated according to the wave simulator. The more angled/warped the water-contacting edge of the reservoir 110 orifice or that of a vent plate 109 is, that is, the more biased away from the open channel 105, the more cavernous and open the barreling tube wave simulation may become. Barreling, tubular waves are prized by many surf riders, and so this example of the wave simulator may be particularly desirable to some users.

A changeable character wave simulation according to the wave simulator is desirable, that is, a wave simulation that changes character during a surfer's ride on the simulated wave. For example, a wave simulation may change from a non-barreling wave simulation to a small barreling wave to a larger tubing barrel wave simulation, and back to an unbroken wave, and all during a surf rider's single ride on the wave simulation. This is accomplished by means of a movable and shaped gate attached to the face of the water flow means.

Figure 41A:
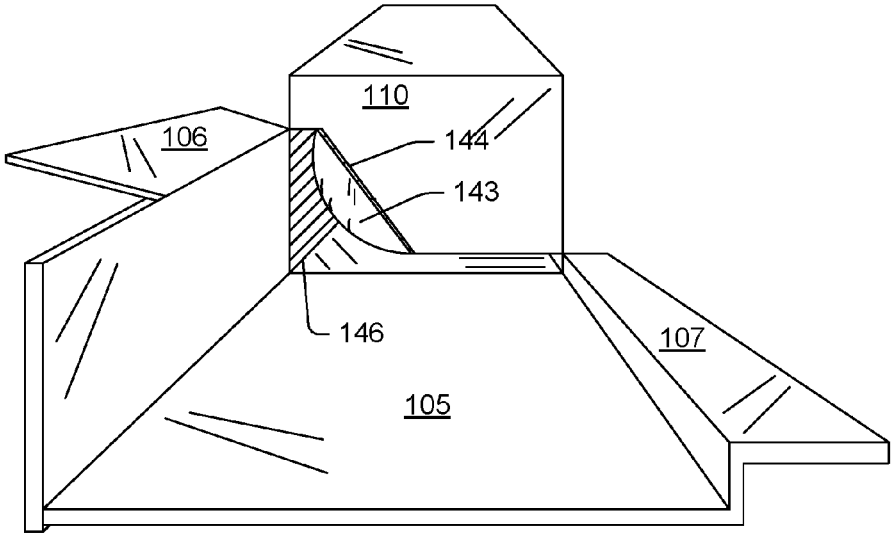
FIGS. 41*a* and 41*b* show perspective cutaway views of a wave simulator according to the wave simulator that use a movable gate to make a barreling wave simulation that can be changed in real-time.
Figure 41B:
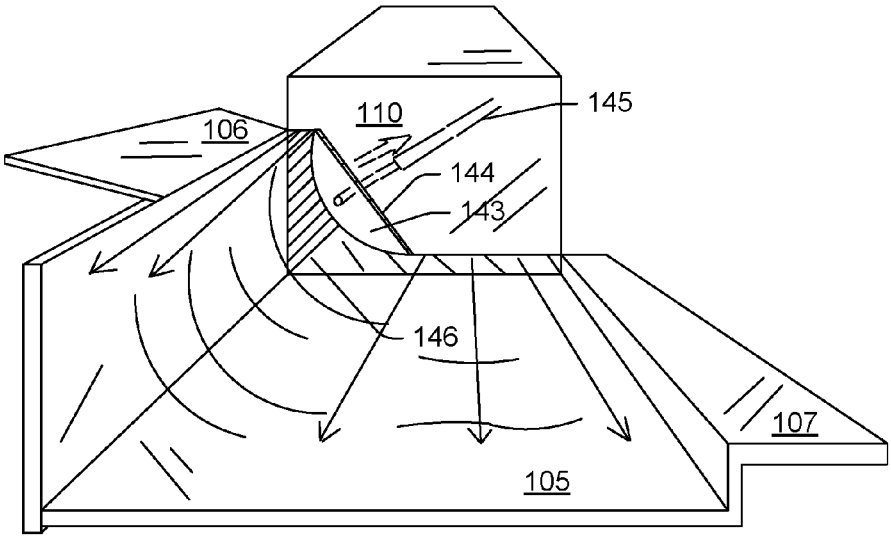

As shown in FIGS. 41*a* and 41*b*, a crescent-shaped gate 143 may be attached to the face of a reservoir 110 as shown by means of a hinge 144, so that the gate may be moved via a pneumatic or hydraulic actuator/cylinder 145. The cylinder 145 may be attached to the crescent gate 143 inside of a reservoir 110 as shown, or other means may be employed for the controlled movement of the gate 143, such as a cylinder 145 mounted outside of a reservoir 110 and mounted to a gate 143, a pulley and motor system or even a motor and linkage assembly (not shown). The gate 143 may be made of any number of materials, such as stainless steel or fiberglass, and may also be shaped for best hydrodynamic performance. A crescent gate 143 may be foil-shaped in cross-section, for example, or may also be scooped or concave shaped on the water-contacting face (the face of the gate 143 that faces towards the reservoir 110) so as to better facilitate the formation of a laminar tubular barreling wave simulation according to the wave simulator. A number of different gates 143 may be made available, each different from the other with respect to plan shape, cross-sectional profile, concavity, convexity, foil, edge fillet, chamfer, and other changeable characteristics, so that differently shaped wave simulations may be made by the wave simulator merely by changing the type of gate 143 mounted to the face of the reservoir 110.

Figure 42A:
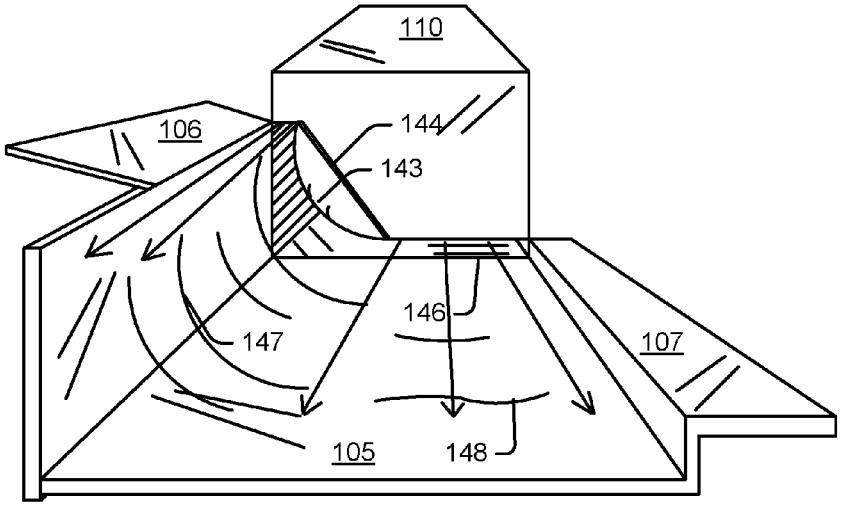
FIGS. 42A and 42B show downstream partial cutaway and side-cutaway views, respectively, of a movable gate barreling wave simulator according to the wave simulator.
Figure 42B:
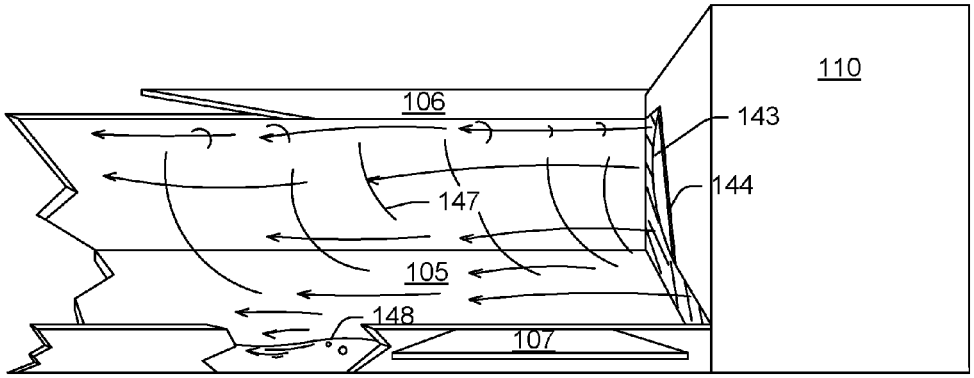

As shown in FIGS. 42*a* and 42*b*, the gate 143 may lay in the same vertical plane as the face of the reservoir 110, in which case a wave may be simulated without a barrel wave in the water flow. Either a static means, such as a stop wedge or wedges (not shown), or mechanical means, such as an actuator 145, may be used to keep the crescent gate 143 in this vertical position. The wave simulation encompasses both an inclined, and generally concave, water flow 147 and a substantially horizontal water flow 148. When the gate 143 is in the vertical position, as shown in the Figures, the wave simulation is unbroken, with no barreling tube wave formed.

Figure 43A:
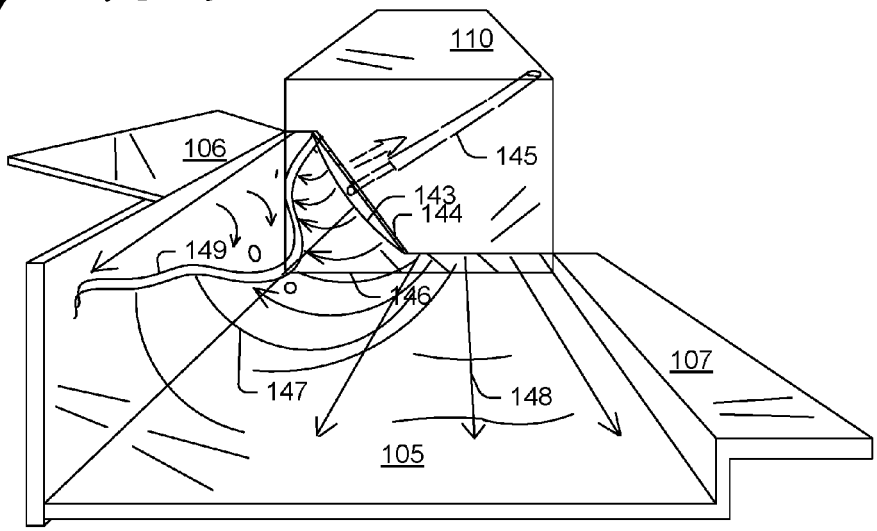
FIGS. 43*a* and 43*b* show similar views to those as shown in FIGS. 42*a* and 42*b*, with the barrel-forming gate having been moved to make a small barreling wave simulation.
Figure 43B:
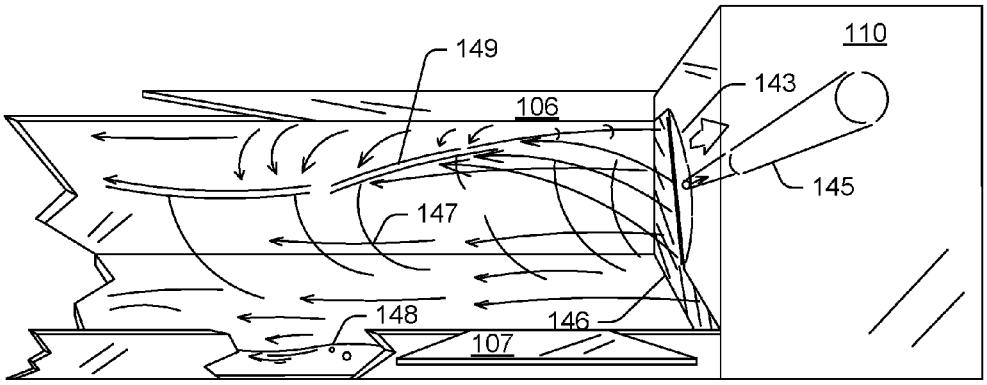

As shown in FIGS. 43*a* and 43*b*, the gate 143 may be moved inwardly into the recess of the reservoir 110 via the actuator/cylinder 145. When the gate 143 is moved inwardly from an angle of about 5° to about 10° relative to the vertical face of the reservoir 110, as shown in the Figures, a small to medium bore barreling tube wave 149 may be formed, for the riding therein and thereon by surf riders of the wave simulator.

Figure 44A:
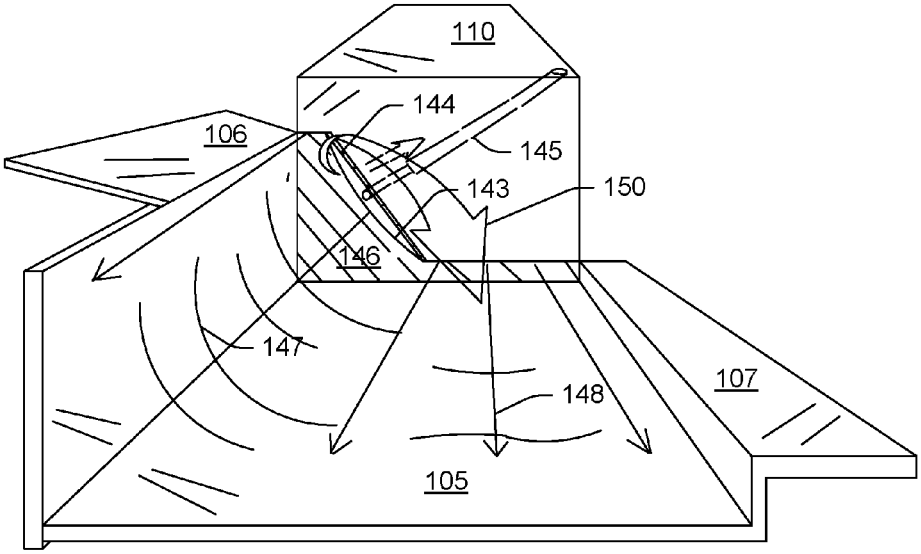
FIGS. 44*a* and 44*b* show similar views to those shown in FIGS. 43*a* and 43*b*, with the barrel-forming gate having been moved to make a large barreling wave simulation.
Figure 44B:
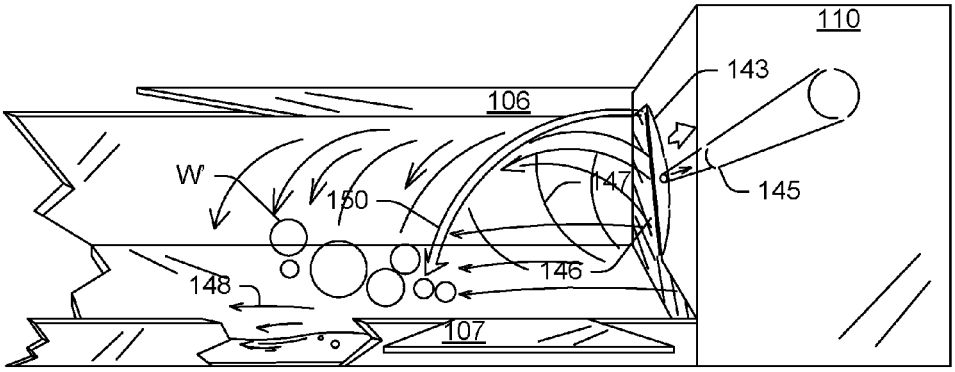

As shown in FIGS. 44*a* and 44*b*, the gate 143 may be moved inwardly from an angle of about 12° to about 40° relative to the vertical face of the reservoir 110. In general, the farther the gate 143 is moved inward into the recess of the reservoir 110, the larger the barreling wave simulation may become. For example, a medium to large bore barreling tube wave 150 may be formed for the riding therein and thereon by surf riders of the wave simulator.

A control panel and motor assembly (not shown) may be provided to control the movement of the barreling wave-forming gate.

Figure 44C:
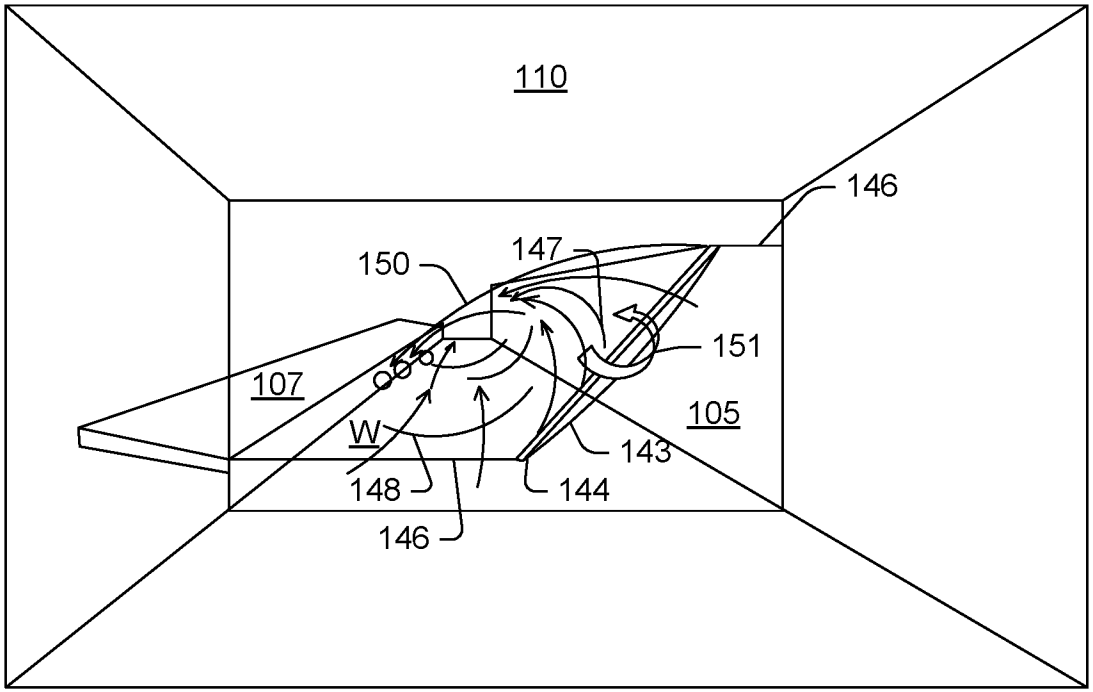
FIG. 44*c* shows a transparent "ghosted" view of the wave simulator from within the reservoir looking towards the open channel, with a barrel-forming gate making a large barreling wave simulation according to the wave simulator.

FIG. 44*c* shows a different view of the large bore tube wave 150 as simulated by the wave simulator. As can be shown from inside a reservoir 110, when the gate is angled into the reservoir 110, it causes changes in the water flow from the reservoir orifice 146 into the channel 105. A vortex flow 151 is generated by the angling of the gate 143, and the vortex flows around the edge of the gate 143 and into the channel 105, creating a ridable barreling wave simulation 150. The angling of the gate 143 creates an acceleration and rotational curving of the water flow from the reservoir and around the edge of the gate 143, forming the water flow into a horizontal vortex not unlike that of a tornado turned on its side. The horizontal vortex flow 151 is extruded around the angled edge of the shaped gate 143 which simulates the tubular barrel wave according to the wave simulator. By varying the angle of the gate 143, the vortex flow 151 becomes weaker or stronger, thereby creating smaller or larger tubular wave simulations. The angle of the gate 143 may be changed in real-time while a surf rider is on the wave simulation of the wave simulator, thereby better simulating surfing waves as found in nature, which change from barreling waves to non-barreling waves and back during a surf rider's ride thereon, with the size of the barreling waves also changing during a surfer's ride upon an ocean wave.

The aforementioned deep flow and movable crescent gate barreling wave example of the wave simulator may of course be used in conjunction with other previously disclosed examples of the wave simulator, for example, a deep flow half-pipe or spine ramp-style configuration may be realized, and of course lower bottom turn pools 128, upper pools 123, and/or downstream splashdown pools 130 may be employed with a deep flow/crescent gate barrel wave version of the wave simulator.

Figure 44D:
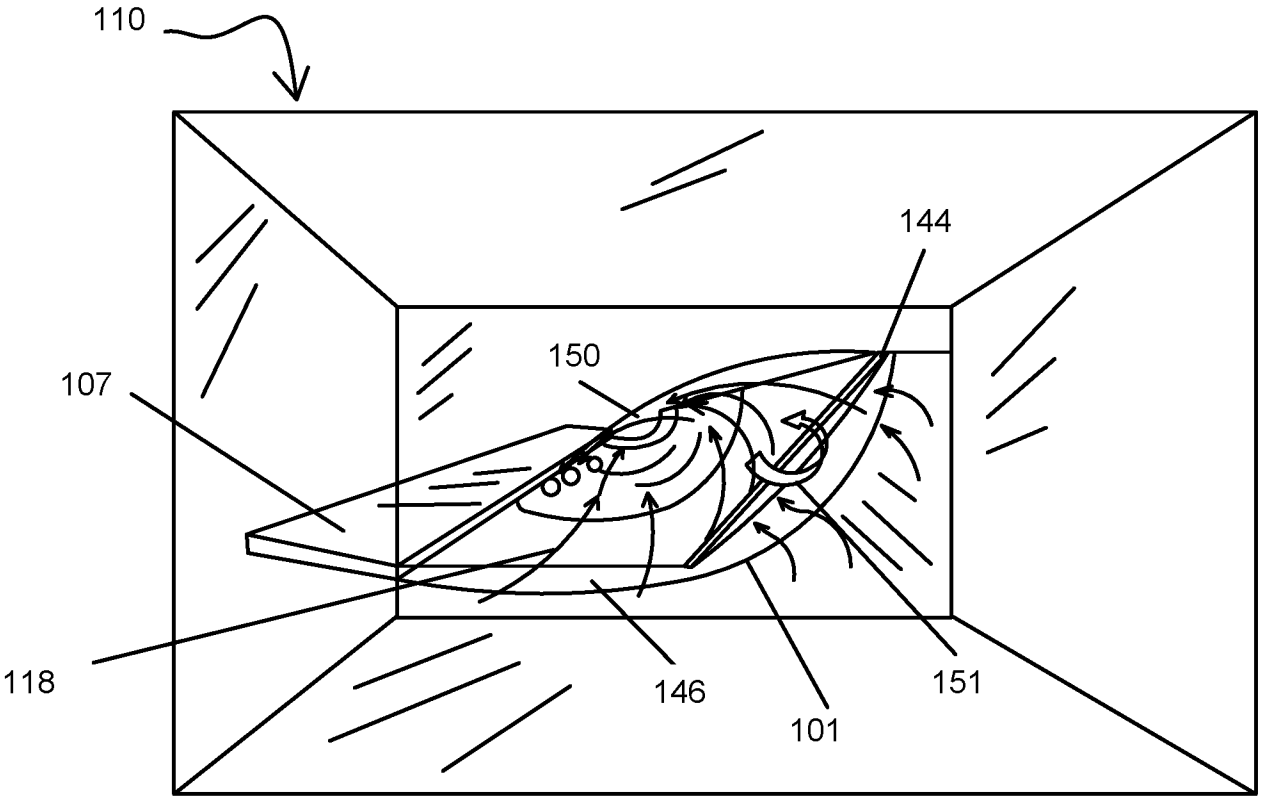
FIG. 44*d* shows a transparent "ghosted" view of the wave simulator from within the reservoir looking towards the open channel, with a barrel-forming gate making a large barreling wave simulation upon a flume according to the wave simulator.

A movable gate may be used to make a barreling tube wave in conjunction with a flume 101. As shown in FIG. 44*d*, a flume 101 may be utilized in conjunction with the crescent gate 143, with a barreling wave being formed thereupon by the movements of the gate 143 as previously described. A double-barreling tubular half-pipe may also be realized using two flumes 101 in accordance with two crescent gates 143.

Figure 44E:
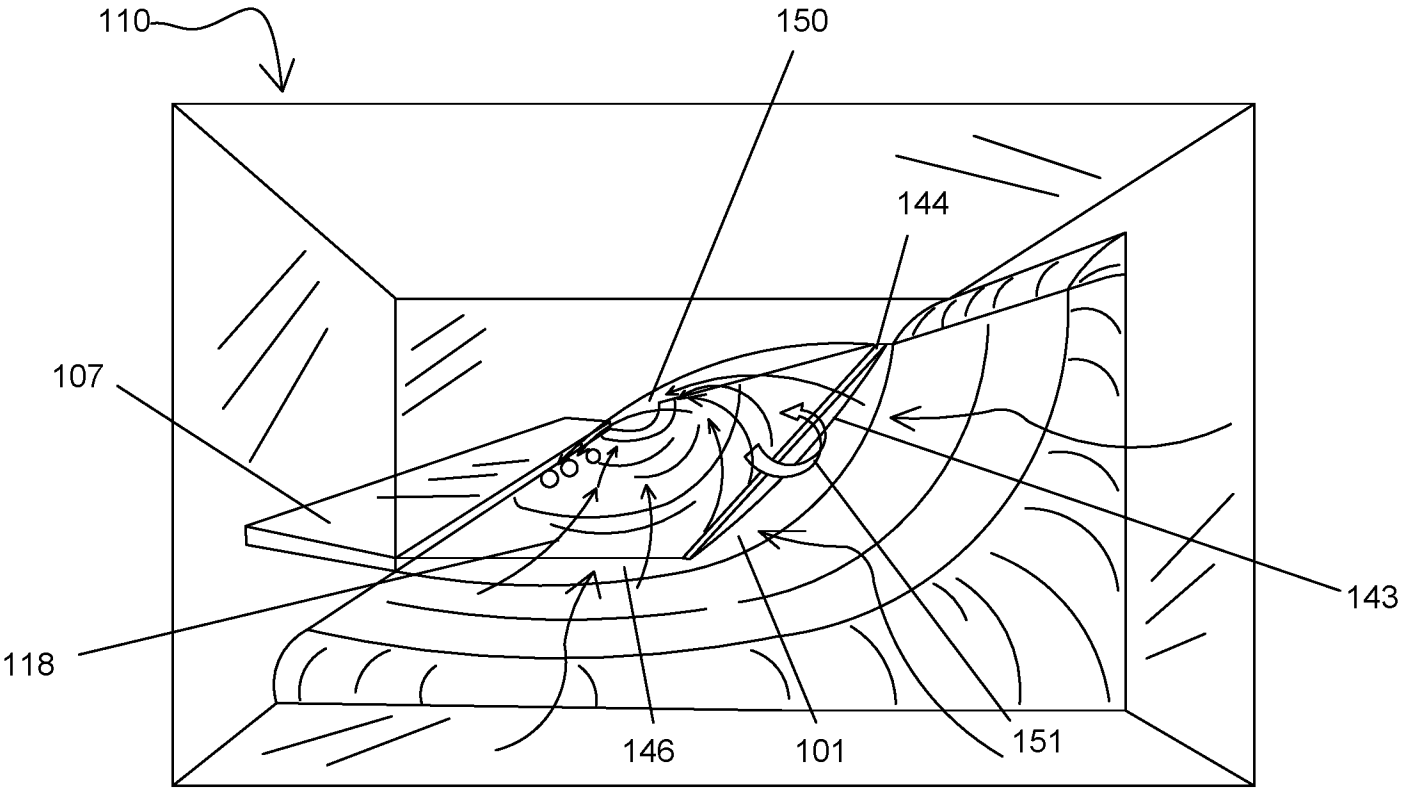
FIG. 44*e* shows a transparent "ghosted" view of the wave simulator from within the reservoir looking towards the open channel, with a barrel-forming gate and interior flume making a laminar barreling wave simulation upon a flume according to the wave simulator.

As shown in FIG. 44*e*, a flume 101 may actually "extend" into a reservoir 110, with a "quarter bullnose" curved section at the end of the interior section of the flume 101 connecting the flume 101 to the inside of the reservoir 110. A generously curved fillet may be used to complete such a flume/reservoir interface. The extension of the flume 101 into the reservoir causes the water flow to align with the surface of the flume well prior to its exiting the orifice 146, which may aid in imparting a laminar flow quality to the wave simulation water flow of the wave simulator. A laminar, that is, "smooth", wave simulation is highly desirable, as a smooth flow is easier for a surf rider to execute maneuvers thereupon.

Figure 45A:
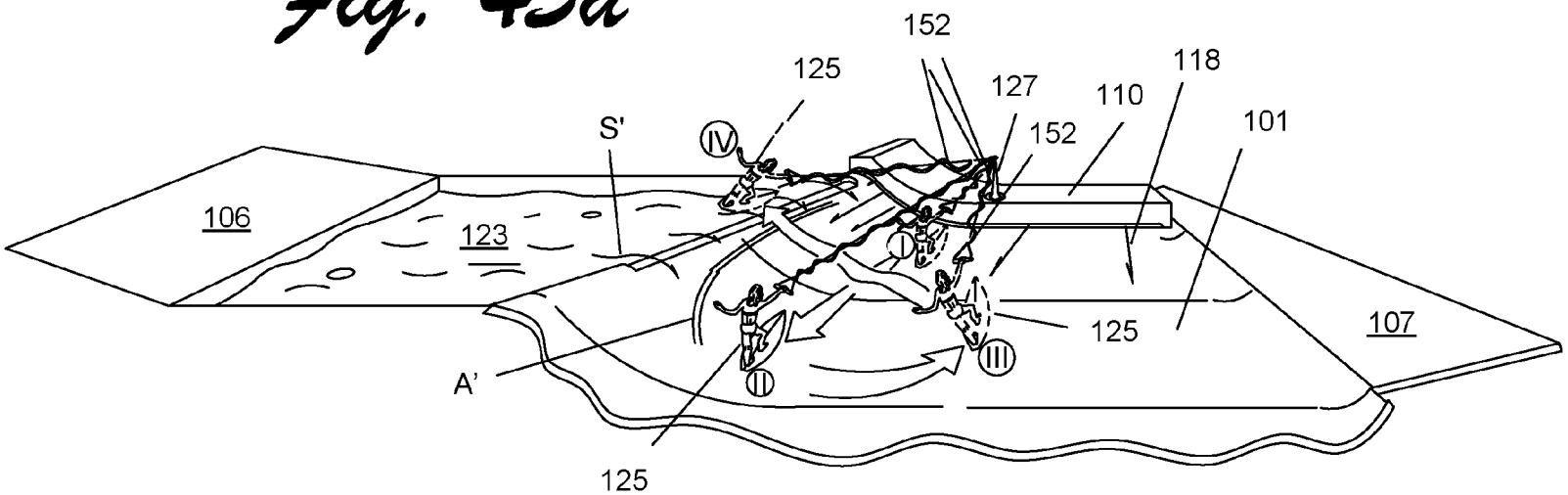
FIG. 45*a* shows a cutaway perspective view of a prototypical time lapse ride upon a wave simulator according to the wave simulator that makes use of an elastomeric "bungee" cord to allow for rider controlled forward motion board riding on the simulated wave flow of the wave simulator.
Figure 45B:
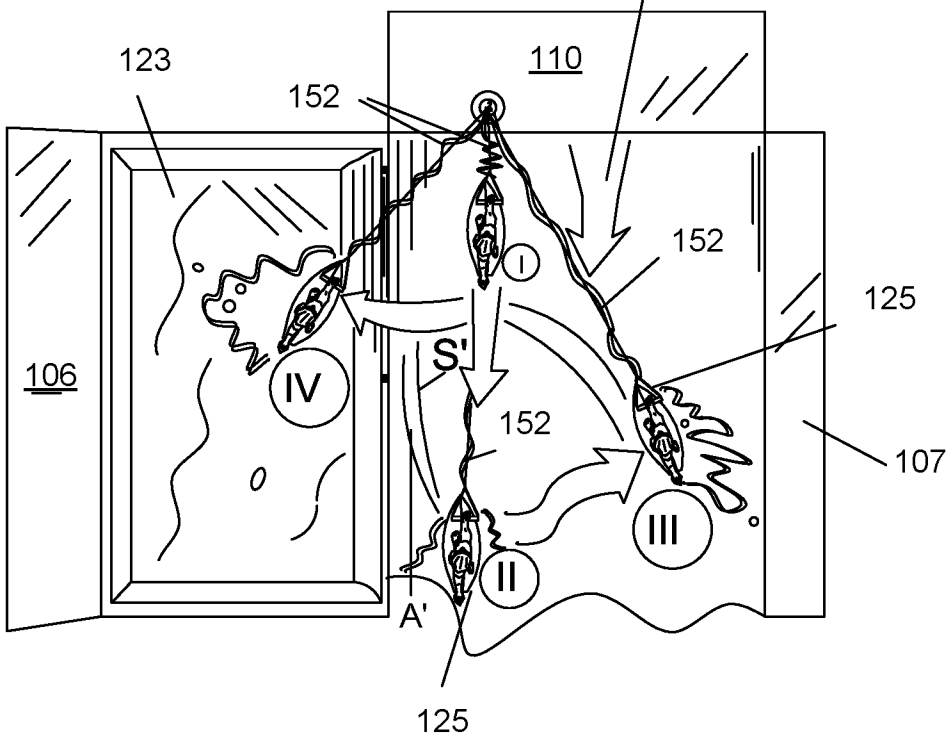
FIG. 45*b* is a plan view of the prototypical time lapse ride as shown in FIG. 45*a*.

As shown in FIGS. 45*a* and 45*b*, an elastomeric "bungee" cord and handle assembly 152 may be utilized to better simulate the down-the-line wave simulation according to the wave simulator. To wit, as a surf rider 125 enters the wave simulator at a point I, the rider may place the board and/or body in the water flow 118 in such a manner that the elastomeric bungee cord 152 stretches out and places a rider 125 upon the wave simulation at a point II. Now, at this point there is substantial potential energy stored in the bungee cord handle assembly 152, and the rider 125 is positioned so that she may then elect to release the rail of the board and plane the board onto the upper surface of the water flow 118, which until this point has been holding the rider in position. Now, the potential energy stored in the elastomeric fibers of the bungee cord assembly 152 is released, propelling the rider 125 forward to a point III, where she may begin to set the rider's board into a "bottom turn", in a similar manner as do ocean-borne wave riders just prior to a maneuver/stunt upon a wave. The rider 125 may elect to angle the rider's board and go for a maneuver/stunt upon and/or over the breaking wave arc A' to a point forward from the rider's previous location on the wave simulation of the wave simulator, in this case, to a point IV inside the upper pool 123. By varying foot/leg pressure upon and relative angle(s) of the respective board(s) in the wave simulation flow of the wave simulator, as well as using their body(ies) and/or limbs to impart varying desirable degrees of drag in the water flow 118 so as to extend the bungee cord handle assembly 152, surf rider(s) 125 may extend and or retract the elastomeric bungee cord/handle assembly 152, alternatively loading the cord up with energy and subsequently releasing it in the execution of a forward-moving stunt, turn or maneuver on the inclined water flow of the down-the-line peeling wave simulation. This example of the wave simulator is desirable to more truly simulate a down-the-line wave riding experience insofar as that surf rider's on actual ocean waves move forward and laterally with a natural down-the-line wave, and they can perform maneuvers as they move with and surf the wave. The use of the elastomeric bungee cord and handle assembly 152 herein allows a rider 125 to not only realistically simulate an ocean wave's "forward-and-lateral" surf riding motion but also to control the motion at will, and repeat and vary the motion as they desire and for any duration of time they desire, via the aforementioned positioning and/or manipulation of their body and/or board in the water flow in conjunction with the bungee cord handle assembly 152 of the wave simulator. In barreling tubular wave simulations as provided by the wave simulator, a bungee cord handle assembly 152 may be used to get more deeply tubed as the rider "stalls" his or her body to extend the cord and get more deeply barreled, and when they release the stall they may move forward towards the water flow source and out of the tubular barrel wave simulation.

Figure 45C:
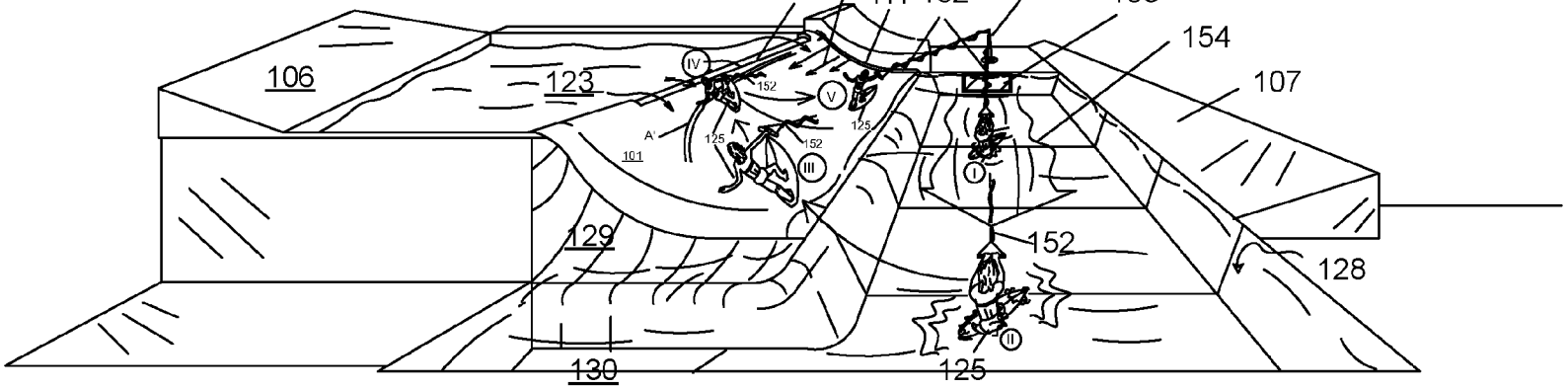
FIG. 45*c* shows a perspective view of a prototypical time lapse ride upon another example of a wave simulator according to the wave simulator that makes use of a bungee cord to allow for rider controlled forward motion board riding on the simulated wave flow of the wave simulator.

FIG. 45*c* shows another example of the wave simulator that makes use of a bungee cord for rider enjoyment. A water flow 154 may be provided within a bottom turn pool 108 adjacent a flume 101. The flow may emanate from a flow grate 153, and may be provided by a pumping system (not shown). The water flow has sufficient force to move a rider 125 from one a position I to a position II farther from the flow grate 153. At this point, the bungee cord 152 is fully stretched, and the rider is in position to release the energy stored within the bungee cord 152, the position normally comprising a crouched stance upon the board, and at least partially submerging, and preferably fully submerging, the board. To start the ride, a rider 125 lifts the board up onto the surface of the water within the pool 108, and then the rider may start to plane across the surface of the water in pool 108, riding towards the reservoir 110 and the flow grate 153. A rider 125 may elect to bottom turn and ride up the flume structure 101 to a position III on the water flow on the structure 101. Using the forward momentum as provided by the stored energy in the bungee cord 153, the rider 123 may then move to perform a maneuver upon the water arc A' at a position IV on the flume 101, and may then ride forward to a position V on the flume 101. From the position V a rider 125 may elect to enter the lower pool 108 and re-load the bungee cord with energy to ride the wave simulator again, or may elect to re-load the bungee cord with potential energy from the water flow emanating from the reservoir 110, or may simply exit the riding surface and end the ride.

The use of a bungee cord and handle assembly according to the wave simulator is not limited to the exemplary examples described and illustrated herein. For example, a combination of half-pipes, ramps, and water flows of various thicknesses and flow speeds may be provided in any combination according to the wave simulator for a fun and thrilling board riding experience. A one-way course may be provided, for example, where the bungee cord is stretched and the rider is launched into the course comprised of ridable structures according to the wave simulator. A portion of the horizontal water flow of a wave simulator according to the wave simulator may be made fast and/or thick to provide a rider of the wave simulator a means of quickly imparting potential energy to the bungee cord and handle assembly 152. A portion of the horizontal flume 101 according to the wave simulator may extend longer than the inclined riding surface, the extended portion to be provided with a water flow, of course, to more fully load the bungee cord and handle assembly 152 with as much potential energy as possible, so as to provide for a longer duration of a ride and a more thrilling simulated down-the-line surfing experience.

The water flow of the wave simulator may be made to be either subcritical or supercritical, or of different velocities at different portions of the wave simulator. For example, the water flow may be supercritical in the horizontal flow 148 and substantially subcritical in a portion of the inclined flow 147. Such a difference in flow velocity is primarily a factor of both the relative bore sizes of the areas of a reservoir orifice 146, which comprises an inclined opening and a horizontal opening, and the flow rate from the pumps located in the reservoir 110. The smaller the bore size and the greater the flow rate, the more supercritical the flow may become, and vice versa. Different flow types are desired in different surf riding circumstances. Different thicknesses of water flow may also be provided, with a preferred thickness of water flow being from about 3 inches to about two feet in thickness.

Many different types of boards and board riders may enjoy the wave simulation as provided by the wave simulator, so that not only stand-up riders such as surfers, skateboarders, snowboarders, wake boarders, and windsurfers, but also lay-down and other board riders, such as knee boarders and body boarders, may use the wave simulation as provided by the wave simulator.

Many cross-board sports maneuvers may be executed on the wave simulator, for example, board slides may be performed on the upper deck 6 or the lower deck 107, or along the periphery of an upper pool 123. A number of tricks, stunts and aerials performed in the myriad board sports disciplines may be adapted to be executed upon the wave simulation of the wave simulator. The upper and lower spectator/entrance-exit decks of the wave simulator have precedence in similar decks used for similar purpose in the board sports of skateboarding and snowboarding, for example, such decks have been used for decades on half-pipes and other skate/snowboard structures.

A stanchion 127 of the wave simulator, used to secure a tow rope 126 or a bungee cord tow assembly 152, may be made to be telescopic in nature and therefore made to be a variable height as desired.

Still other examples of a wave simulator are also contemplated. FIGS. 46*a* through 46*e* show alternative wave simulator 200, in cutaway, having various illustrative configurations of pools, ramps, and open channel profiles and combinations thereof. In this example, the alternative wave simulator 200 may include lower platform 201, lower pool 202, vent 203, upper pool 204, and upper platform 205. In another example configuration, the alternative wave simulator 200 may include barrel forming gate 206 (FIGS. 46*c*-*d*) or reservoir with wave shaped vent 207 (FIG. 46*e*). These features have already been described above, and therefore will not be described again with reference to these Figures.

Figure 46A:
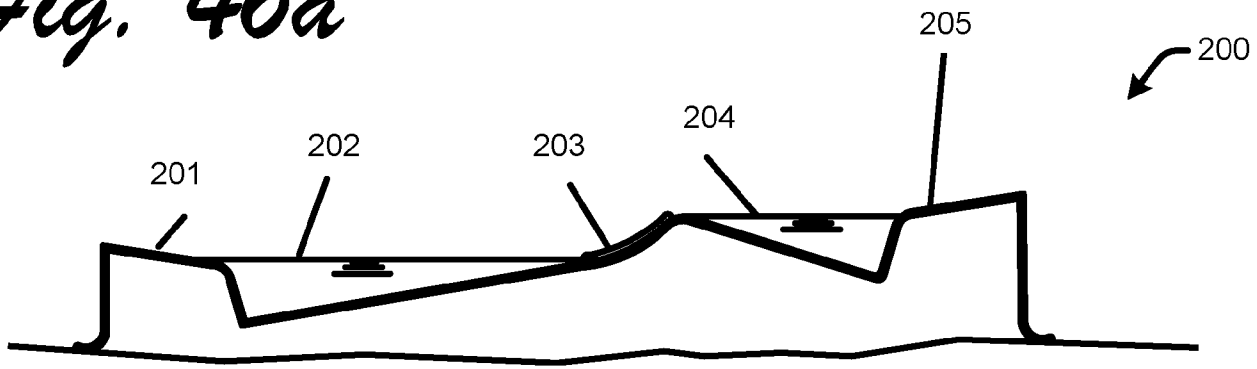
FIGS. 46*a* through 46*e* show, in cutaway, example alternative pools, ramps, and open channel profiles and combinations thereof.

As shown in FIG. 46*a*, a lower pool 202 may be made to be of very shallow depth where adjoining the wave simulation ramp flume, and gradually slope to a deeper depth farther from the ramp flume. As shown in the Figure, a flat bottom turn area of a ramp flume may not be present in this example, and instead the lower pool's sloping floor may seamlessly adjoin the lowermost edge of the ramp flume. When there is no flat area present in the ramp flume, the uppermost edge of the pool's sloping floor and the lowermost edge of the ramp flume usually adjoin each other at the same angle. As also shown in the Figure, the upper pool 204 may also encompass a "zero entry depth" sloping bottom pool type.

Figure 46B:
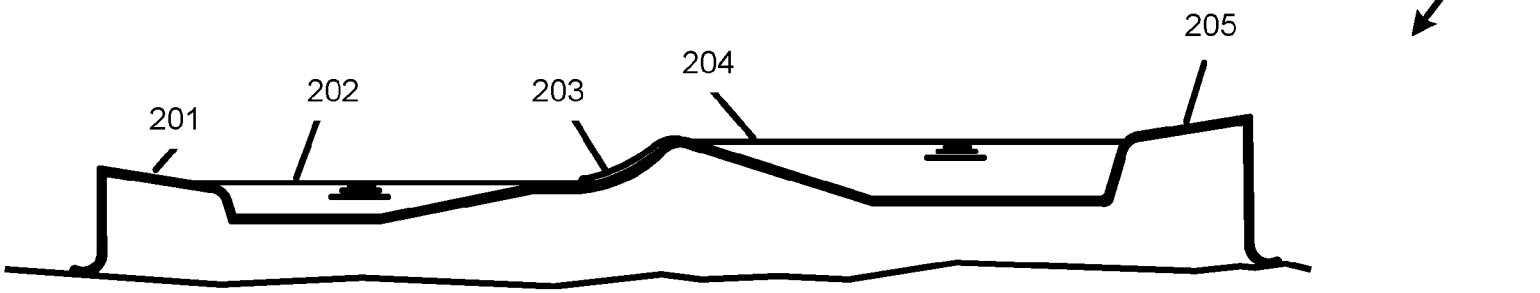
Figures 46C, 46D, 46E:
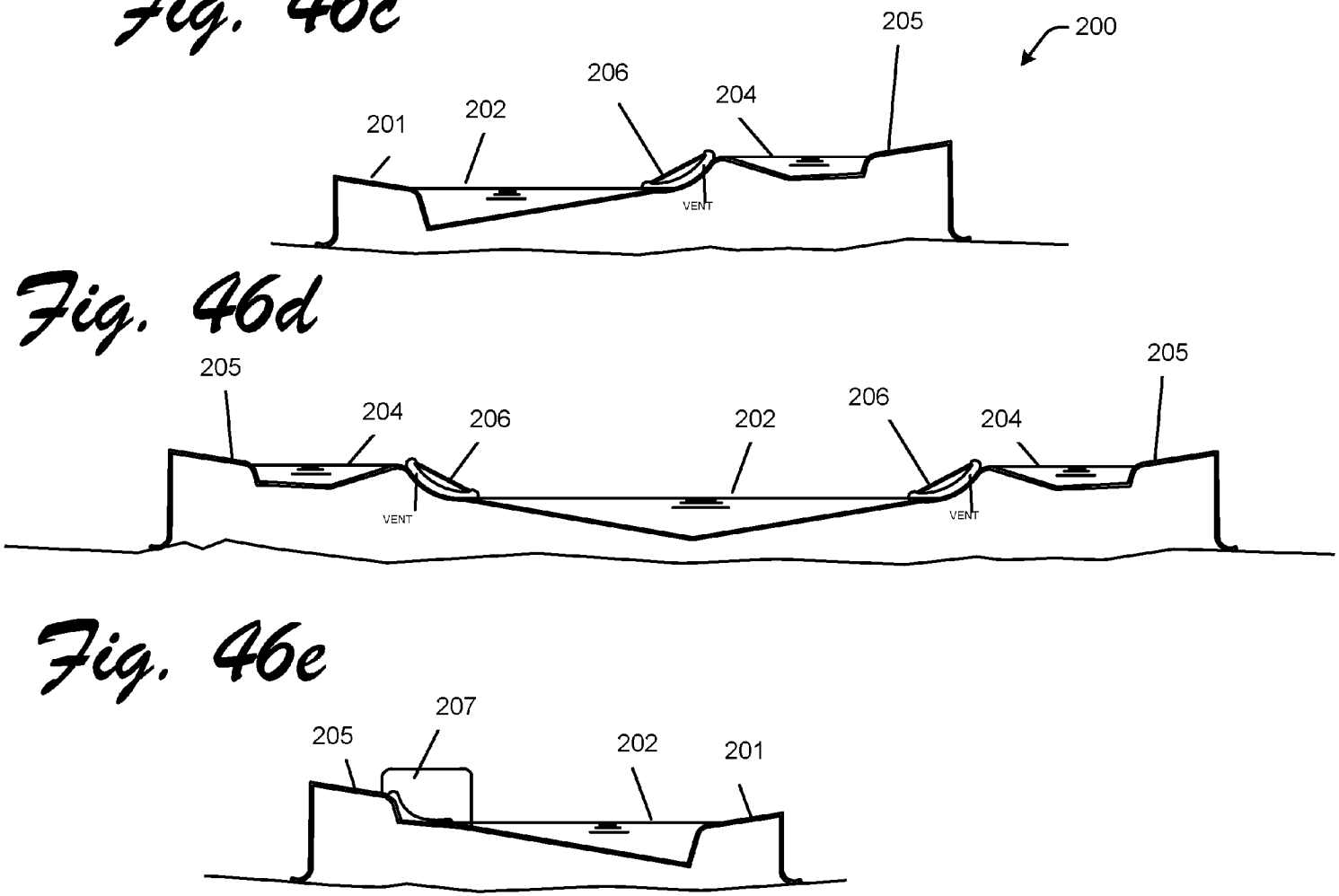

FIG. 46*b* shows another profile wherein the zero depth upper and lower pools 204 and 202, respectively, have flat pool bottoms in addition to the side sloping walls. Unlike the configuration shown in FIG. 46*a*, the ramp flume in FIG. 46*b* possesses a relatively flat bottom turn area that connects the sloping pool to the ramp flume.

As shown in FIG. 46*c*, a combination of zero depth entry and flat bottomed/sloping floor pools 202 and 204 may be used. Also shown in FIG. 46*c* is a hybrid crescent gate and curvilinear ducted vent combination, wherein a movable tubing barrel-wave-forming gate has been affixed to the upper rim of the outlet of a curvilinear ducted vent.

FIG. 46*d* shows a dual-sided example that utilizes a single, dual-sloped zero-depth entry pool 202 so that two riders may ride at the same time.

FIG. 46*e* shows an open channel and sloping pool combination. A wave-shaped outlet may be used on a reservoir 207, as shown, to extrude a wave-shaped flow into and along the open channel. Alternatively, a shaped movable gate may be used on the reservoir as well. As previously described, a flat bottom turn area may or may not be used in this example, and instead the lower pool's 202 sloping floor may seamlessly adjoin the lowermost edge of the open channel. When there is no flat area present in the open channel, the uppermost edge of the pool's 202 sloping floor and the lowermost edge of the open channel usually adjoin each other at the same angle.

Either or both of the upper pool 204 and lower pool 202 may be furnished with a water flow means to enable a bungee cord board rider to use these examples in a manner as previously described. It will be recognized by those skilled in the art after becoming familiar with the teachings herein, that the pool and ramp/open channel combinations are merely illustrative of the myriad desirable combinations and shapes of a wave simulator, and of course other combinations, profiles and shapes are possible.

The wave simulator may make use of any number of materials to construct the ride surfaces, for example, an elastomeric material stretched over a frame may be used to make the ride surface, or the ride surface may be made of inflatable sections. Foam padding may be used on any of the ride surfaces or in the exit area of the wave simulator as deemed desirable for safety purposes.

A portable version of the wave simulator may of course be easily realized, and may be desirable for different venues.

The wave simulator may be scaled to any size and employed for any use imaginable. For example, the simulator may be scaled down and made into a child's toy for simulating surfing action with a child's fingers upon a very small surfboard, or a simulator may be made into a fountain-like structure. A "forever barreling" tubular wave sculpture/fountain may be also be provided, with or without a surf rider sculpture provided inside the tube section of a wave sculpture according to the wave simulator. For example, sculpted dolphins or whales may be provided upon either a tubular, non-tubular, or crescent-gated, changeable barrel-forming wave sculpture according to the wave simulator. A sculpture with a barrel-forming crescent gate may be provided with a motion control means and a control panel or box so that people can control the barrel formation at will, for enjoyment.

It is noted that the examples shown and described are provided for purposes of illustration and are not intended to be limiting.

The invention claimed is:

1. A wave simulator comprising:

a container for pressurizing water pumped therein; and an aperture positioned on a surface of the container that is formed to extrude a simulated wave shape;

wherein the aperture extrudes a simulated wave from the container along an open channel such that a crest of a simulated wave is extruded at the aperture at a point higher than the lower portion of the simulated wave;

wherein the aperture extrudes an entire profile of the simulated wave instantaneously from the aperture.

2. The wave simulator of claim 1, further comprising a removable faceplate, and water flows out of the removable faceplate.

3. The wave simulator of claim 2, further comprising a plurality of apertures on the removable faceplate, wherein each of the plurality of apertures have a removable cover so that the plurality of apertures can be covered and uncovered to extrude different simulated waves from the removable faceplate.

4. The wave simulator of claim 2, wherein a portion of the removable faceplate is contoured and shaped, relative to a flat plane, whereby properties of the simulated wave can be varied.

5. The wave simulator of claim 1, wherein the aperture is formed substantially in a shape of an obtuse triangle, wherein a side of the obtuse triangle that is located between two acute angles of the obtuse triangle is convex-shaped such that its midpoint is closer to an obtuse angle of the obtuse triangle than if the side of the obtuse triangle is a straight line.

6. The wave simulator of claim 5, wherein the obtuse angle of the obtuse triangle shape of the aperture is adjacent a bed of the open channel.

7. The wave simulator of claim 1, wherein the aperture is substantially triangle shaped, wherein at least one side of the triangle shaped aperture is convex-shaped such that its midpoint is closer to a base of the triangle than if the side of the triangle is a straight line.

8. The wave simulator of claim 7, wherein the base is adjacent a bed of the open channel.

9. The wave simulator of claim 1, wherein the aperture is substantially shaped as a right triangle, wherein a hypotenuse of the right triangle is convex-shaped such that its midpoint is closer to the right angle of the triangle than if the hypotenuse was a straight line.

10. The wave simulator of claim 9, wherein a right angle of the right triangle is adjacent a bed of the open channel.

11. The wave simulator of claim 1, wherein the open channel is shaped relative to a horizontal plane such that the open channel has a bend along its length, and at least one sidewall of the open channel is curved along the bend.

12. The wave simulator of claim 1, wherein the container has a similar shape as the aperture.

13. The wave simulator of claim 1, further comprising means to guide the flow of water in the container prior to the water being extruded from the aperture.

14. A wave simulator comprising:

a vessel for pressurizing water pumped therein;

an aperture positioned on a surface of the vessel that is formed to extrude a simulated wave shape;

wherein the aperture extrudes a simulated wave from the vessel along an open channel such that a crest of a simulated wave is extruded at the aperture at a point higher than the lower portion of the simulated wave;

wherein the aperture extrudes an entire profile of the simulated wave instantaneously from the aperture; and a larger body of water possessing a free surface that is adjacent the open channel.

15. The wave simulator of claim 14, wherein the open channel has at least one sidewall having an upper edge and at least one opposite sidewall having a lower edge, the at least one lower edge of the channel submerged in a larger body of water to share a common free surface, and at least a portion of the bed of the open channel is located below the free surface.

16. The wave simulator of claim 14, further comprising a second lower edge of the open channel located substantially at a second end of the open channel downstream from a first end of the open channel.

17. The wave simulator of claim 14, wherein water from the larger body of water is pumped into the vessel and through an aperture for extrusion.

18. The wave simulator of claim 14, further comprising a first aperture on a first half of a faceplate and at least a second aperture on a second half of the faceplate.

19. The wave simulator of claim 18, wherein the second aperture has a similar shape as the first aperture.

20. A wave simulator comprising:

means for pressurizing water pumped therein; and means for extruding a simulated wave shape through an aperture positioned on a surface of the means for pressurizing;

wherein the aperture extrudes an entire profile of a simulated wave from an aperture such that a crest of a simulated wave is extruded at the aperture at a point higher than the lower portion of the simulated wave.

* * * * *